US006830133B2

(12) United States Patent
Sneed

(10) Patent No.: US 6,830,133 B2
(45) Date of Patent: Dec. 14, 2004

(54) CONNECTOR BRACKETS

(76) Inventor: Terryle L. Sneed, 430 Foothill Rd., La Canada, CA (US) 91011

( * ) Notice: Subject to any disclaimer, the term of this patent is extended or adjusted under 35 U.S.C. 154(b) by 145 days.

(21) Appl. No.: 10/092,870

(22) Filed: Mar. 6, 2002

(65) Prior Publication Data

US 2003/0168291 A1 Sep. 11, 2003

(51) Int. Cl.[7] ..... B66B 7/02
(52) U.S. Cl. ..... 187/408; 187/406
(58) Field of Search ..... 187/406, 408, 187/414; 52/633, 235

(56) References Cited

U.S. PATENT DOCUMENTS 957,531 A * 5/1910 Winslow ..... 187/408
2,463,215 A * 3/1949 Strachan ..... 187/408
2,990,920 A * 7/1961 Hoffman, Jr. ..... 52/633
3,199,642 A * 8/1965 Clifford ..... 187/408
3,420,337 A * 1/1969 Magee ..... 187/408
3,842,554 A * 10/1974 Swick ..... 52/235
4,977,983 A * 12/1990 Garrido et al. ..... 187/408
5,469,938 A * 11/1995 Biewald et al. ..... 187/408
5,520,264 A * 5/1996 Korhonen ..... 187/408
5,611,179 A * 3/1997 Leek ..... 52/293.3
6,196,356 B1 * 3/2001 Sneed ..... 187/408
6,481,538 B2 * 11/2002 Blackaby et al. ..... 187/408

* cited by examiner

*Primary Examiner*—Eileen D. Lillis
*Assistant Examiner*—Thuy V. Tran
(74) *Attorney, Agent, or Firm*—James E. Brunton, Esq.

(57) ABSTRACT

An apparatus for quickly, easily and adjustably connecting elevator car and counterweight guide rail support brackets to the walls of an elevator hoistway and also to either vertically or horizontally extend structural beams that are disposed within the elevator hoistway. Installation of the apparatus requires no welding operations to be performed in order to connect the brackets to the walls or to the beams. The apparatus uniquely includes cooperating support and connector brackets each of which has a plurality of strategically arranged, indexable connector holes that permit the necessary degree of adjustment of the brackets to properly position the guide rails within the hoistway.

4 Claims, 30 Drawing Sheets

16
24
36
18
39
3
30
53
28
26
33b
32
33b
26
57
30
28
32b
28a
32a
32a
28a
32c
50a
14
14
50a
50
52
43
20a
42a
42
46
22a
55
20c
14b
64
62
14b
22c
20d
20e
22d
61
59
46a
22e
20b
72
22b
47
42
20
67
69
22
42b
70
71
79
76
78
77
78a
74
80
75
15
R-1
74a
R 66a
66
R-1
74a
66b
80
75
78a
74
78
76a
77
79
3

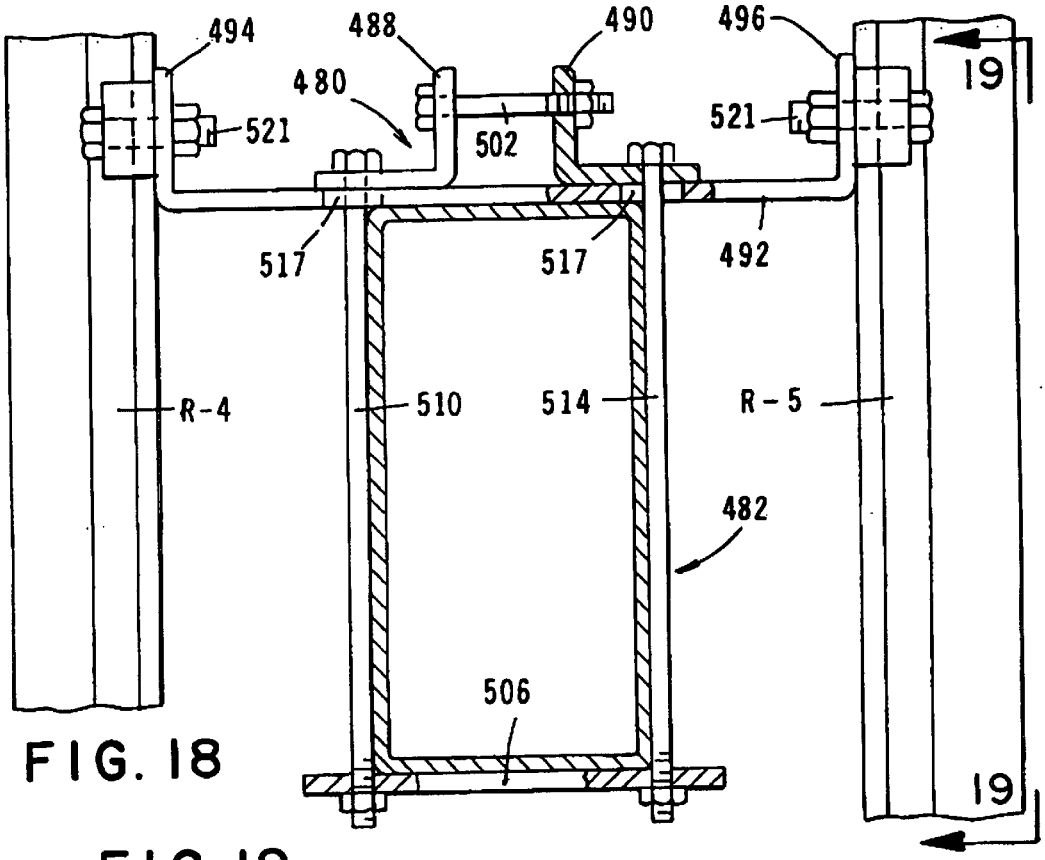
FIG. 18
FIG. 19
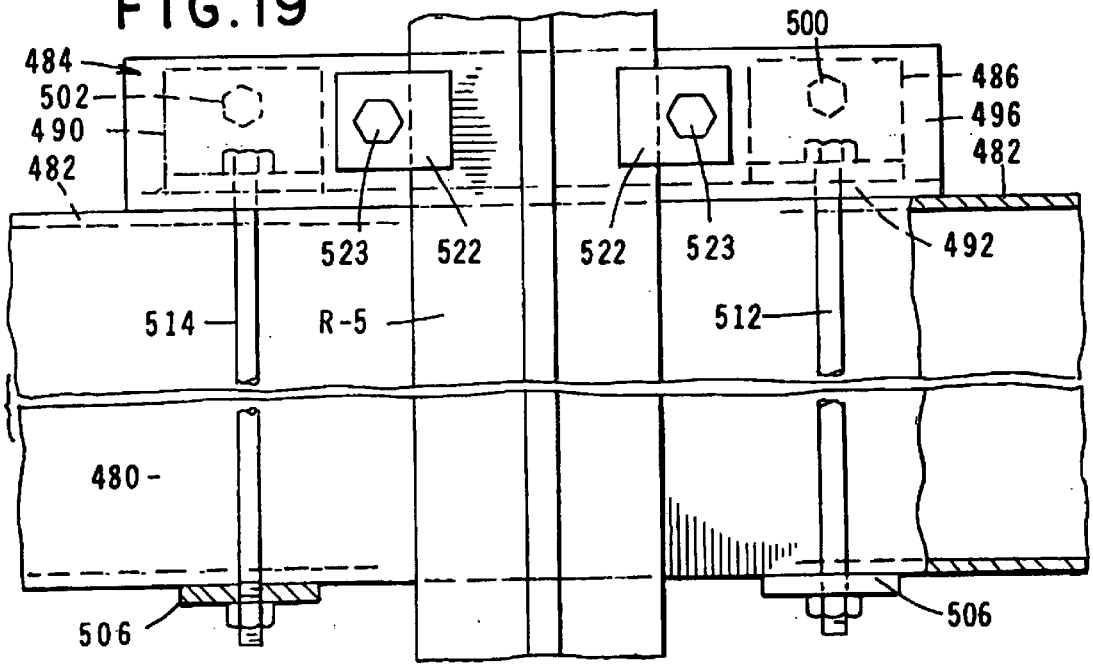

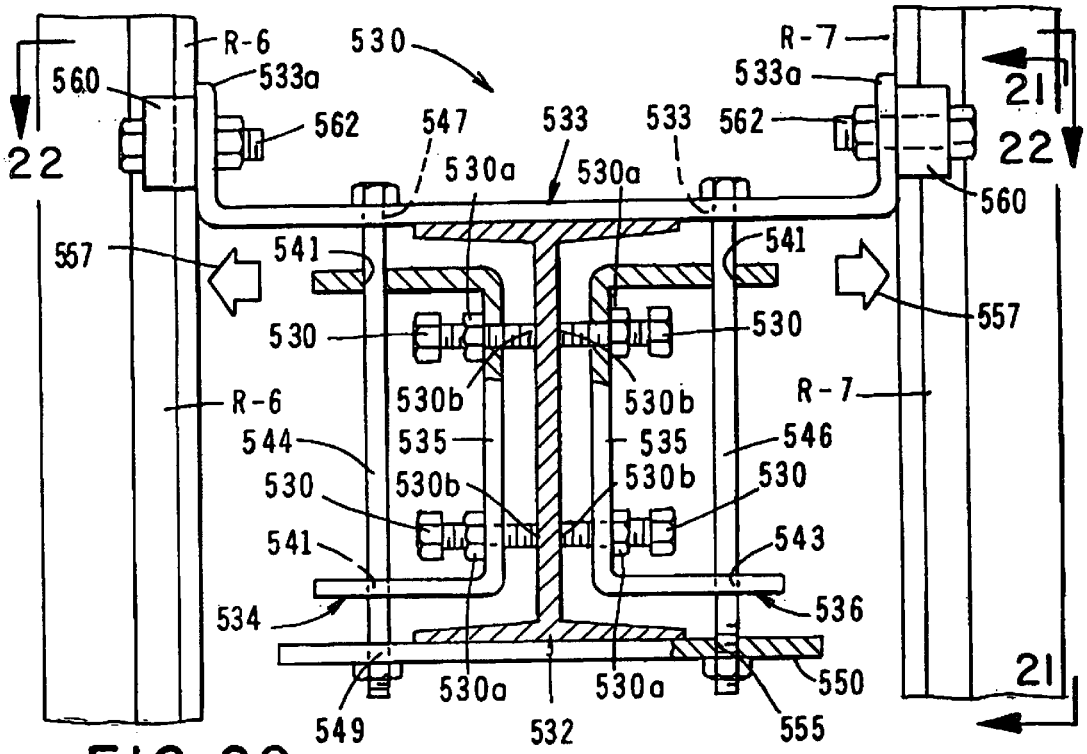
FIG. 20
FIG. 21
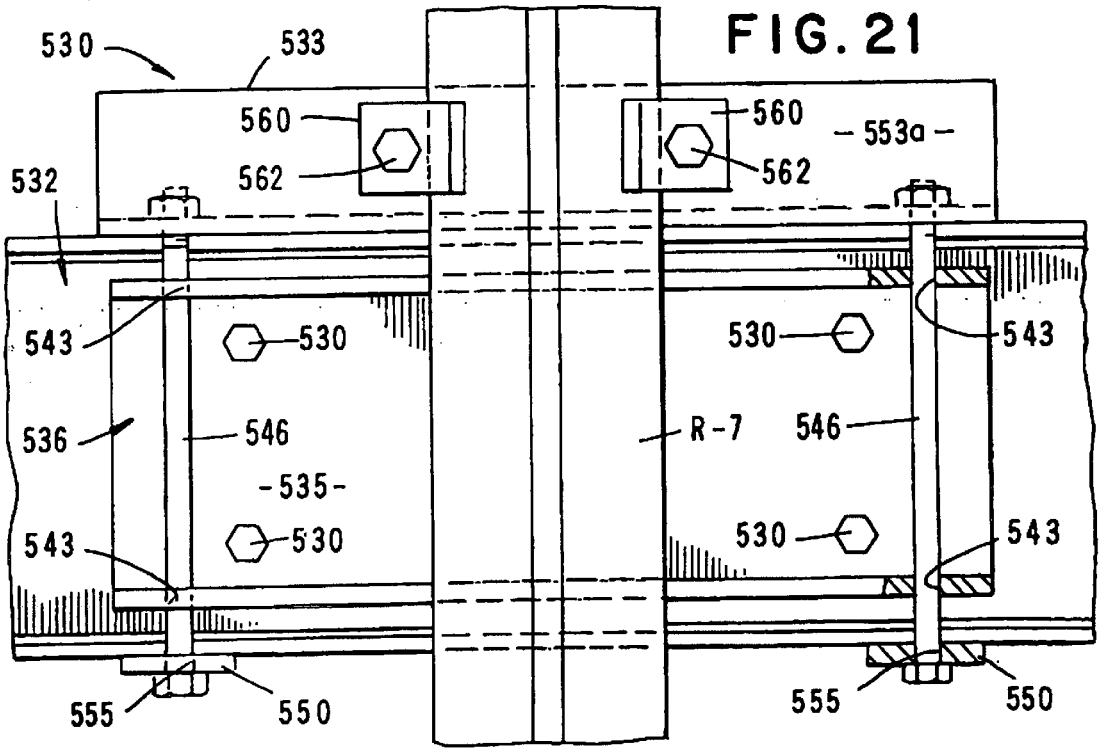

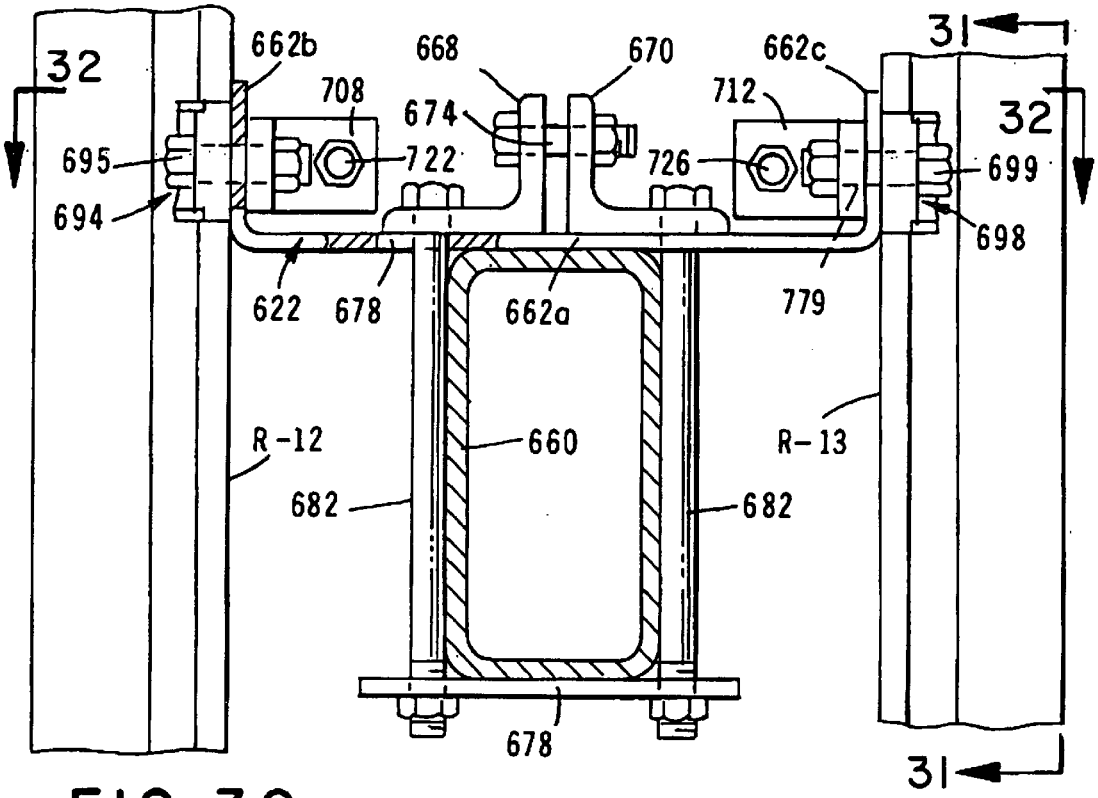
FIG. 30
FIG. 31
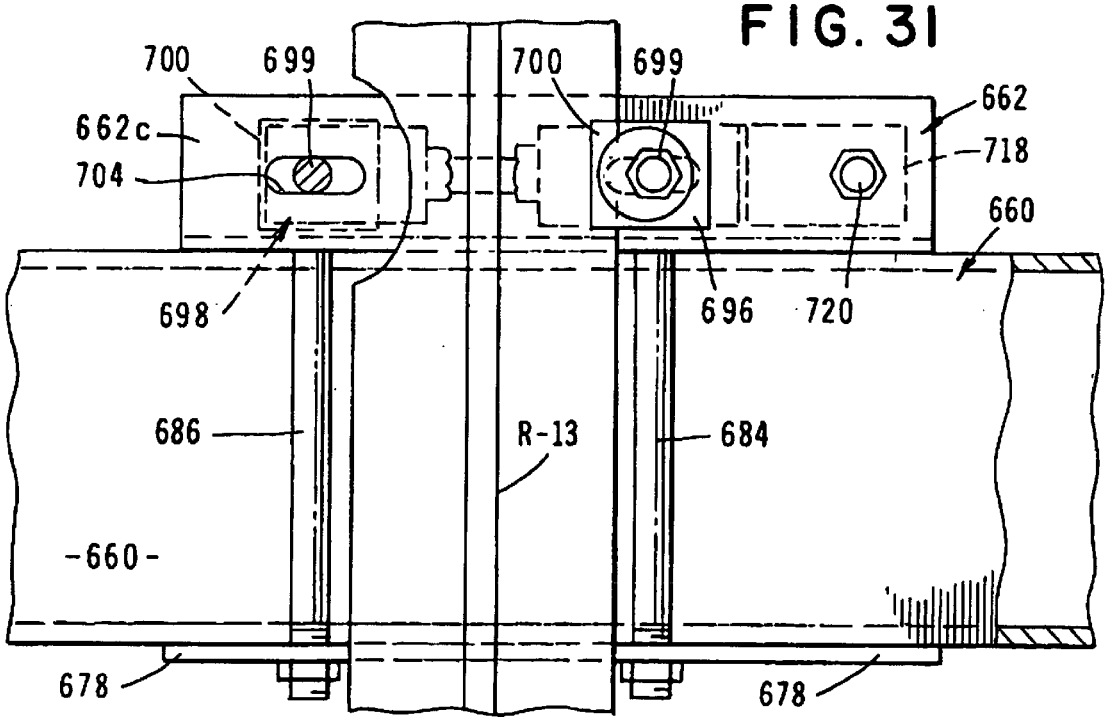

660
622
716
664
672
666
678
718
714
680
689
720
684
724
728
716a
692
716c
718a
718c
696
695
709
711
699
702
722
726
700
700
704
R-12
706
710
R-13
724
662a
728
708
712
700
674
704
702
700
695
699
698
689
698
662
682
668
670
686
711
662c
709
678
660

622b
622
702
662c
689
699
704
662a
704

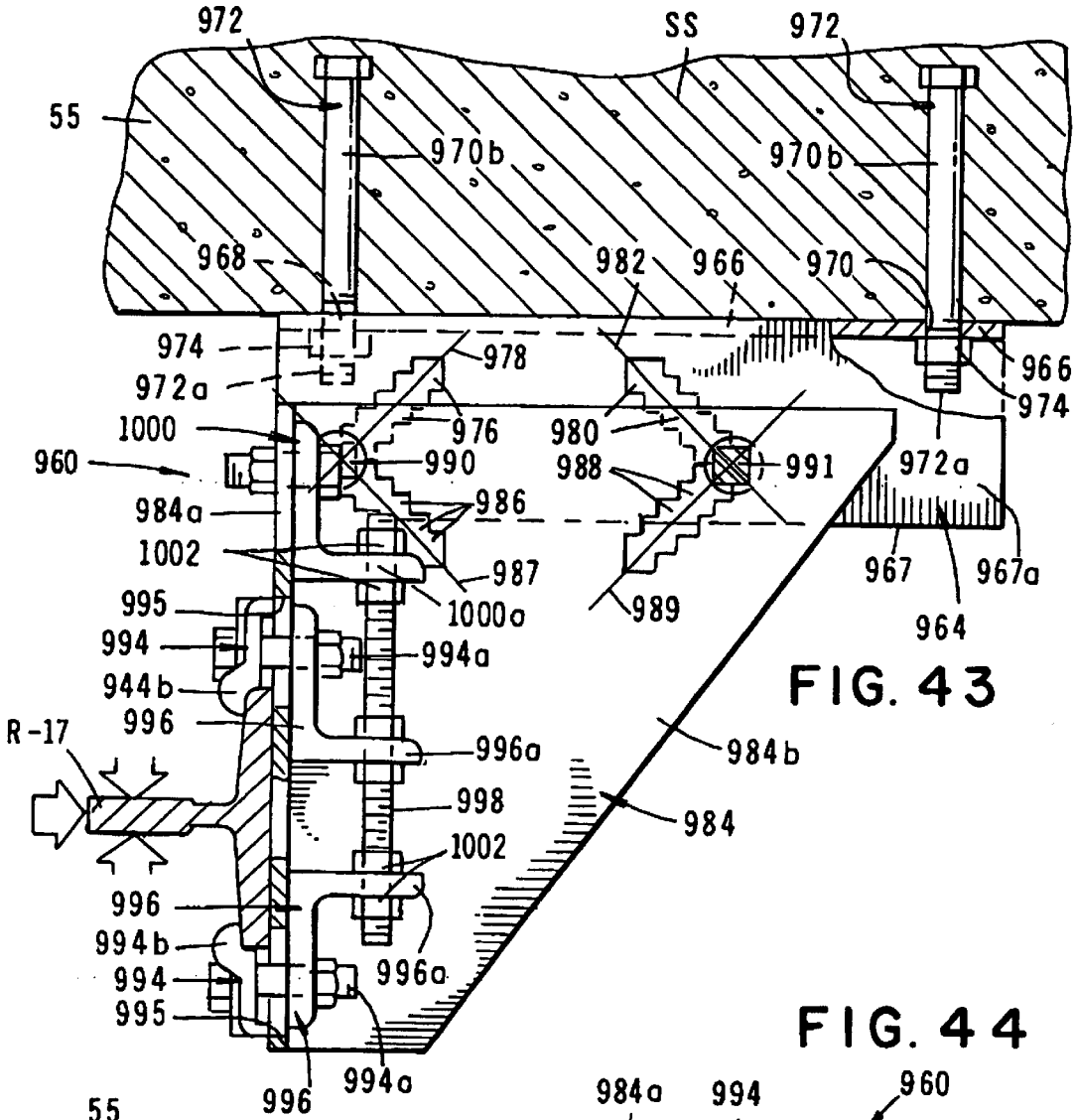
FIG. 43
FIG. 44
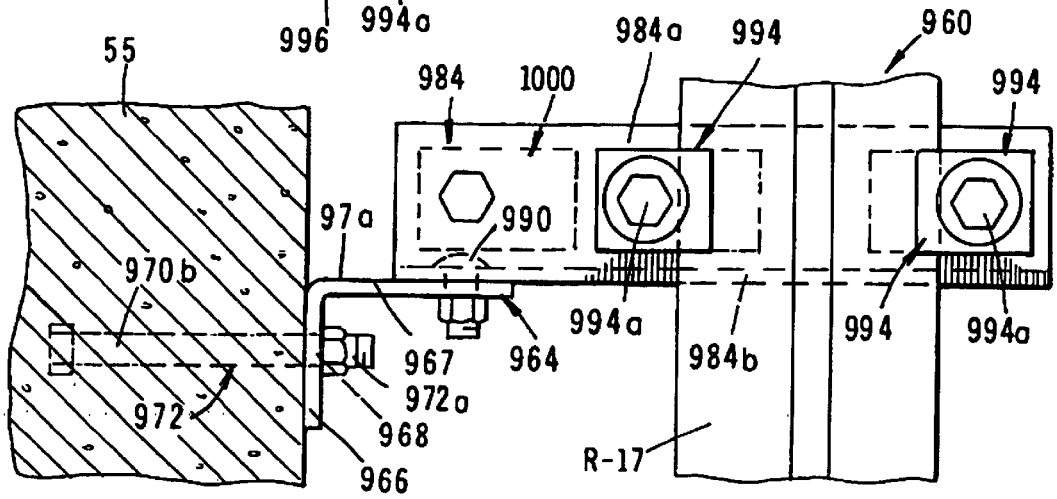

CONNECTOR BRACKETS

BACKGROUND OF THE INVENTION

1. Field of the Invention

The present invention relates to a method and apparatus for mounting within an elevator shaft counterweight rails or guide rails for elevator cars. More particularly, the invention concerns a mounting system in which the guide rails are adjustably attached to one or more intermediate beams that are disposed within the elevator shaft.

2. Discussion of the Prior Art

A typical prior art electric power elevator system has an elevator shaft or hoistway within which guide rails are mounted to guide the vertical travel of elevator cars and counterweights. In many instances in prior art construction, intermediate beams are used to divide an elevator shaft into two or more parts forming channels for separate cars moving along guide rails attached to intermediate beams. Guide rails for counterweights can also be mounted on the intermediate beams.

In the past, the guide rails for elevator cars or counterweights were secured to the intermediate beams using various bars and plates that were secured to the beams by welding. This prior art installation technique is both cumbersome and time consuming even in new construction. However, in retrofit constructions, the technique is particularly difficult. For example, when the elevator systems in hospitals, schools, and other public buildings are retrofitted, the welding step is quite hazardous and most undesirable. This is because, during the retrofit operations, welding of the rail brackets to the support brackets results in noxious welding gases and fumes unavoidably spreading throughout the building. Particularly in hospitals and schools, these noxious welding gases can be both unpleasant and hazardous and can, on occasion, result in serious complications to the persons exposed to the noxious fumes.

This major drawback of the prior art processes was largely overcome by the novel methods and apparatus described in U.S. Pat. No. 6,196,356 issued to the present inventor. The present invention seeks to improve upon the apparatus described in the earlier patent by providing uniquely configured, readily adjustable support and guide rail brackets that can be safely and securely interconnected with beams disposed within the elevator hoistways that house the elevator systems.

As will be better understood from the description, which follows, the apparatus of the present invention includes novel beam interconnection means for interconnecting the rail support brackets with both vertically and horizontally extending beams. Additionally, in certain instances, the connector legs of the support and guide rail brackets of the apparatus are provided with a plurality of strategically arranged, indexable connector holes that permit the necessary degree of adjustment of the brackets to properly position the guide rails within the hoistway. When selected pairs of connector holes provided in the brackets are appropriately aligned, the brackets can be securely bolted together using specially configured bolts that provide substantial structural integrity and positively preclude shifting of the brackets even as a result of projected seismic loading. In other instances, novel brackets of various configuration are used to adjustably attach the guide rails to one or more walls that cooperate to define the elevator hoistway.

SUMMARY OF THE INVENTION

It is an object of the present invention to provide a novel method and apparatus for quickly, easily, and adjustably connecting elevator car and counterweight guide rail support brackets to either vertically or horizontally extending structural beams that are disposed within an elevator hoistway of a building.

Another object of the invention is to provide a novel method and apparatus for quickly, easily, and adjustably connecting elevator car and counterweight guide rail support brackets to the sidewalls of an elevator hoistway of a building.

Another object of the invention is to provide a method of the aforementioned character, which requires no welding operations to be performed in order to connect the brackets to the beams.

Another object of the invention is to provide connector brackets of the character described which include cooperating support and connector brackets each having a plurality of strategically arranged, indexable connector holes that permit the necessary degree of adjustment of the brackets to properly position the guide rails within the hoistway.

Another object of the invention is to provide an apparatus as described in the preceding paragraphs that includes specially configured connector bolts that provide substantial structural integrity and positively preclude shifting of the brackets even as a result of projected seismic loading.

BRIEF DESCRIPTION OF THE DRAWINGS

FIG. 18 is a cross-sectional view taken along lines 18—18 of FIG. 17.

FIG. 19 is a view taken along lines 19—19 of FIG. 18.

FIG. 20 is a greatly enlarged front view of an alternate form of elevator car support system in which the car rails are adjustably interconnected with an I-beam rather than with a hollow rectangular beam of the character shown in FIG. 17.

FIG. 21 is a view taken along lines 21—21 of FIG. 20.

FIG. 30 is a front view of an alternate form of connector apparatus of the invention for connecting elevator guide rails to a horizontally extending beam.

FIG. 31 is a view taken along lines 31—31 of FIG. 30.

FIG. 43 is a cross-sectional view taken along lines 43—43 of FIG. 42.

FIG. 44 is a cross-sectional view taken along lines 44—44 of FIG. 42.

DESCRIPTION OF THE INVENTION

Figure 1A:
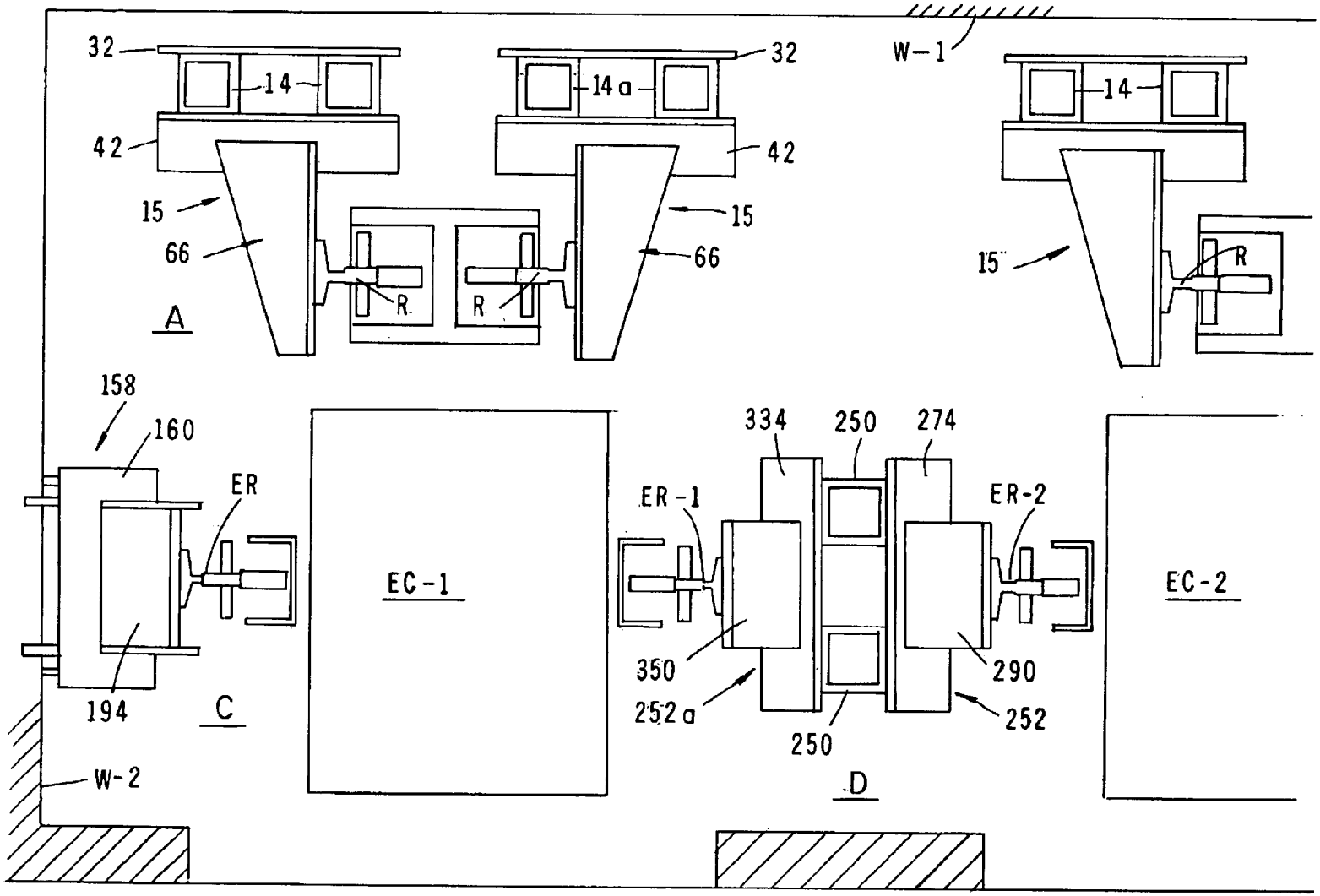
FIGS. 1A and 1B when considered together comprise a top plan view of a multiple elevator and multiple counterweight system that is disposed within a conventional elevator shaft and embodies various of the adjustable support brackets of the present invention.
Figure 1B:
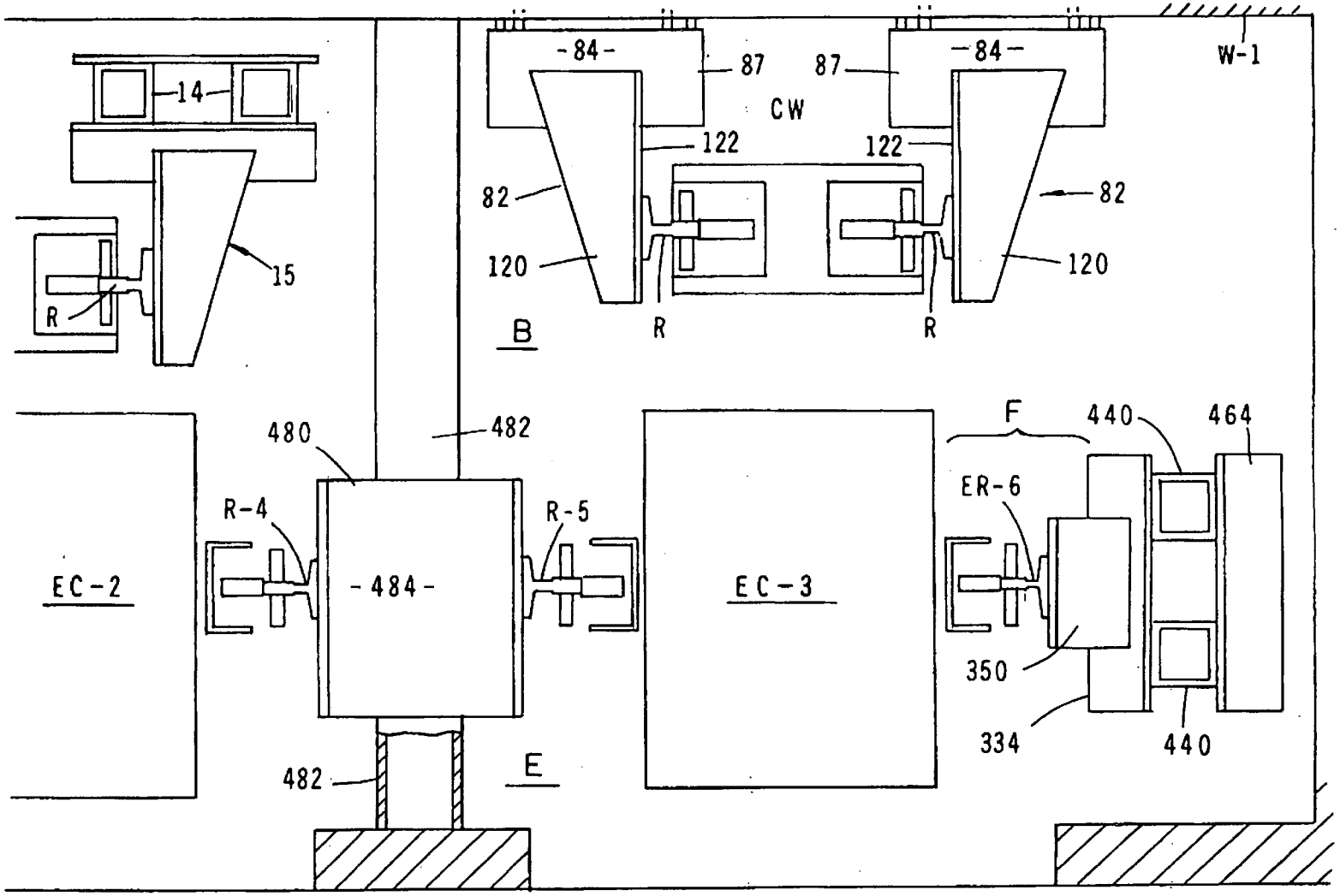

Referring to the drawings and particularly to FIGS. 1A and 1B, several forms of the connector apparatus of the present invention for interconnecting guide rails in elevator systems with various types of structural components is there illustrated. In the area of FIG. 1A designated by the letter A, a connector apparatus for interconnecting the guide rails of a counterweight system with two pair of vertically extending columns is there illustrated. Shown in the area designated by the letter B in FIG. 1B is a connector apparatus for interconnecting the guide rails of a counterweight system with one wall of the building structure that houses the elevator system. In the area of FIG. 1A designated by the letter C there is shown a connector apparatus for interconnecting a guide rail of an elevator system with one wall of the building structure that houses the elevator system. In the area designated by the letter D in FIG. 1A is a connector apparatus for interconnecting the guide rails of an elevator system with a pair of vertically extending columns. Shown in the area designated by the letter E in FIG. 1B is a connector apparatus for interconnecting the guide rails of an elevator system with a horizontally extending beam, In the area designated by the letter F in FIG. 1B is another form of connector apparatus for interconnecting the guide rail of an elevator system with a pair of vertically extending columns.

Figure 2:
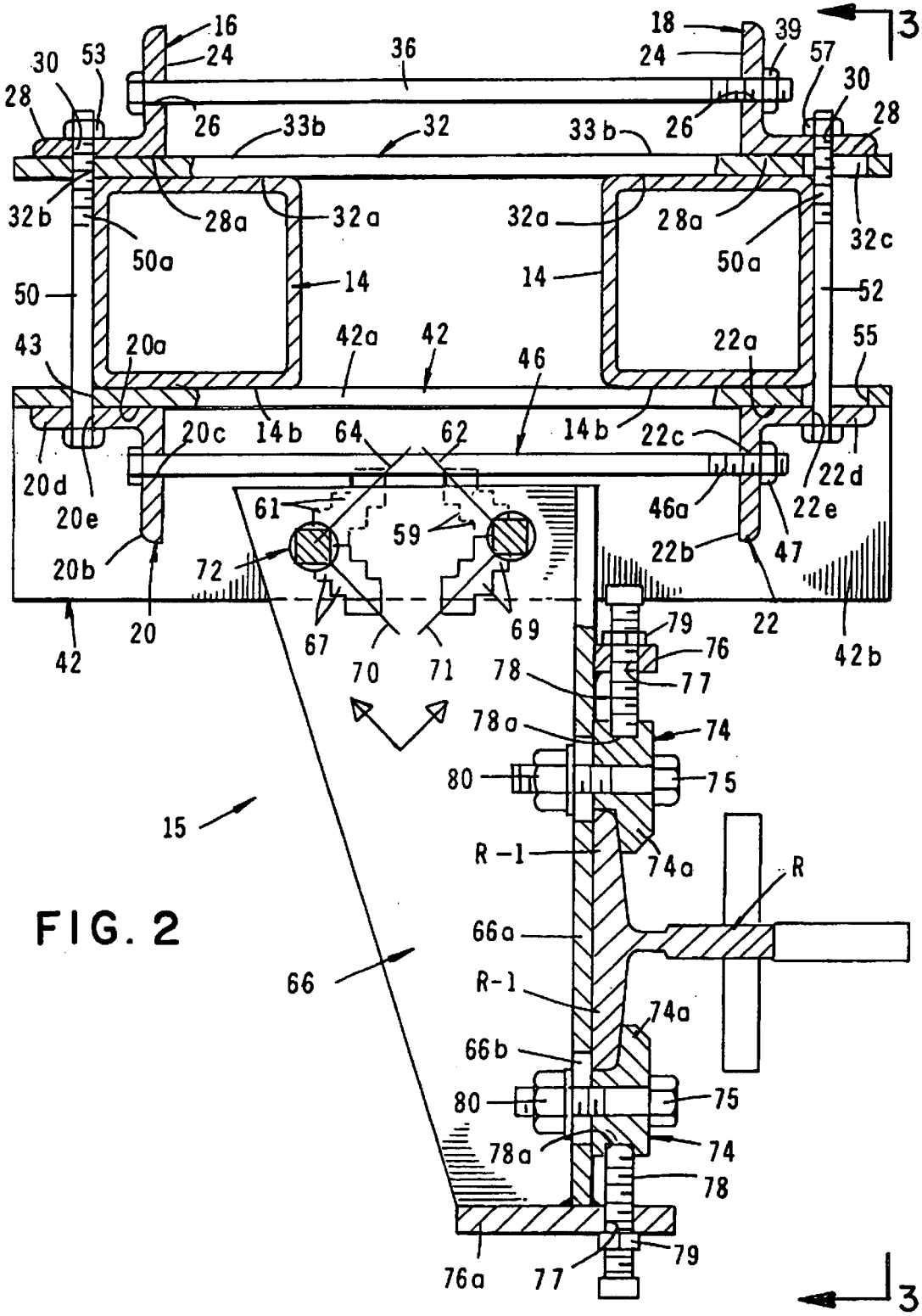
FIG. 2 is a greatly enlarged, cross-sectional view of the left-hand portion of the counterweight system shown in the upper left-hand portion of FIG. 1A.

Considering first the connector apparatus shown in the area of FIG. 1A that is designated by the letter A, this connector apparatus comprises two identical connector assemblies 15 that function to interconnect the guide rails R of a counterweight system with structural components, here comprising two pair of vertically extending beams or columns generally designated by the numerals 14 and 14*a*. Referring to FIG. 2, where the construction of one of the two identical connector assemblies 15 is illustrated, each connector assembly 15 of this form of the invention can be seen to comprise first, second, third, and fourth spaced-apart right angle brackets 16, 18, 20, and 22 respectively. Each of the first and second spaced-apart angle brackets 16 and 18 has a first generally planar, outwardly extending leg 24 that has an aperture 26 formed therein and a second perpendicularly extending second leg 28 that has an aperture 30 extending there through.

Also forming a part of the connector apparatus of the invention is a first elongated spanner plate 32 that spans the spaced-apart, vertically extending columns 14. Plate 32 has a first face 32*a* that engages the outer face of the columns 14 and a second face 33*b* that engages faces 28*a* of the angle brackets 16 and 18. Interconnecting the first legs 24 of first and second angle brackets 16 and 18 is a tie bolt 36. Tie bolt 36 extends through the apertures 26 formed in legs 16 and 18 and is secured in position by a locking nut 39. In the present form of the invention, angle brackets 16, 18, 20 and 22, along with spanner plate 32, comprise the interconnection means of the invention for adjustably interconnecting a first connector bracket, that is generally designated in the drawings by the numeral 42, with the structural components which here comprise columns 14 and 14*a*.

Disposed in engagement with faces 14*b* of the vertically extending beams 14 is the first leg 42*a* of first connector bracket 42. As illustrated in FIG. 2, leg 42*a* is disposed between faces 14*b* of columns 14 and faces 20*a* and 22*a* of angle brackets 20 and 22 respectively. A second tie bolt 46 interconnects the first legs 20*b* and 22*b* of third and fourth angle brackets 20 and 22. Tie bolt 46, that has a threaded end 46*a*, extends through apertures 20*c* and 22*c* formed in legs 20*b* and 22*b* of the angle brackets 20 and 22 and is secured in position by a locking nut 47.

In order to urge leg 42*a* of connector bracket 42 into secure engagement with columns 14, third and fourth eyebolts 50 and 52 are interconnected with the angle brackets in the manner shown in FIG. 2. More particularly, eyebolt 50 functions to interconnect leg 28 of first angle bracket 16 with leg 20*d* of second angle bracket 20, while eyebolt 52 functions to interconnect leg 28 of second angle bracket 18 with leg 22*d* of fourth angle bracket 22. Eyebolt 50, that has a threaded end 50*a*, extends through an aperture 20*e* formed in bracket 20, through an aperture 43 formed in leg 42*a* of bracket 42, through an aperture 32*b* formed in spanner plate 32 and finally through the aperture 30 formed in leg 28 of angle bracket 16. Eyebolt 50 is held in position by means of a locking nut 53. In similar fashion, eyebolt 52, that has a threaded end 52*a*, extends through an aperture 22*e* formed in leg 22*d* of bracket 22, through an elongated aperture 55 formed in leg 42*a* of connector plate 42, through an elongated aperture 32*c* formed in spanner plate 32 and finally through the aperture 30 formed in leg 28 of angle bracket 18. Eyebolt 52 is held in position by means of a locking nut 57. Elongated apertures 55 and 32*c* permit longitudinal adjustment of brackets 18 and 22 to accommodate for variations in the spacing of columns 14.

Figure 4:
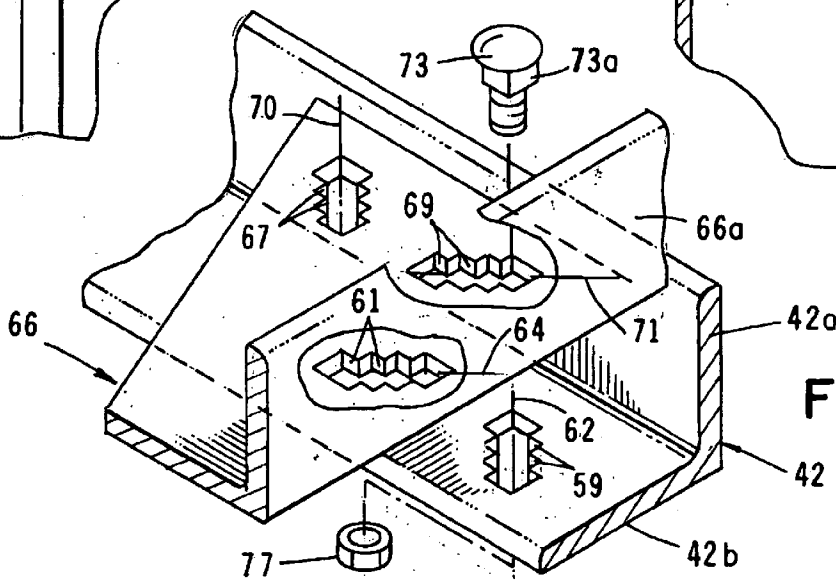
FIG. 4 is a generally perspective, fragmentary view of a portion of the angle bracket that is interconnected with the vertical supporting beams of the counterweight system and a portion of the counterweight rail support bracket that is adjustably interconnected thereto.

As best seen in FIG. 4, first connector bracket 42 has a second leg 42*b* that extends generally perpendicularly to leg 42*a*. Formed within second leg 42 of connector bracket 42*b* are first and second sets of through holes 59 and 61, the purpose of which will presently be described. Holes 59 are disposed along a first line 62 that extends at an acute angle with respect to first leg 42*a* of connector bracket 42. Similarly, through holes 61 are disposed along a second line 64 that extends at an acute angle with respect to first leg 42*a* of connector bracket 42. Each of the through holes 59 and 61 are generally rectangular in plan and are of a size and shape to closely receive the square shank portion of threaded connector bolts which, in a manner presently to be described, are used to interconnect a second connector bracket 66 with bracket 42.

Second connector bracket 66, which functions to adjustably support one of the counterweight rails "R", is adjustably interconnected with first connector bracket 42 in a manner now to be described. Like bracket 42, connector bracket 66 is provided with first and second sets of through holes 67 and 69. Holes 67 are disposed along a third line 70 that extends at an acute angle with respect to first leg 66*a* of connector bracket 66 and also angularly with respect to line 64. Similarly, through holes 69 are disposed along a fourth line 71 that extends angularly with respect to first leg 66*a* of connector bracket 66 and also angularly with respect to line 62. Each of the through holes 67 and 69 are also generally rectangular in plan and are of a size and shape to closely receive the square shank portion of the threaded connector bolts.

Through holes 67 formed in bracket 66 are so constructed and arranged that a selected one of the through holes 67 can be moved into index with a selected one of the through holes 61 formed in bracket 42 by a sliding movement of bracket 66 relative to bracket 42. Similarly, through holes 69 formed in bracket 66 are constructed and arranged so that a selected one of the through holes 69 can be moved into index with a selected one of the through holes 59 formed in bracket 42 when bracket 66 is moved from a first position to a second position relative to bracket 42. More particularly, bracket 66 can be slidably moved relative to bracket 42 in a first transverse direction generally parallel with leg 42*a* of bracket 42 or, alternatively, can be slidably moved in a second direction generally perpendicular to leg 42*a* of bracket 42.

When second connector bracket 66 is correctly aligned with first connector bracket 42 and a selected one of the though holes 67 is indexably aligned with a selected one of the through holes 61, a first connector bolt, such as a bolt 72, can be introduced into the aligned through holes. Similarly, when the connector bracket 66 is correctly aligned with bracket 42 and a selected one of the through holes 69 is indexably aligned with a selected one of the through holes 59, a second bolt, such as connector a bolt 73, can be introduced into the aligned through holes. With the bolts 72 and 73 in position with the square shank portions 73*a* thereof (FIG. 4) closely received within the aligned holes, nuts such as nut 77 can be used to securely interconnect connector bracket 66 with bracket 42 in the manner shown in FIGS. 2 and 3. When the brackets are thusly connected, the square shaped shank portions 73*a* of the bolts will be snugly received within the indexably aligned through holes in the two brackets and will efficiently prevent sliding movement between the brackets even under severe seismic loading.

Also forming a part of the connector apparatus of the form of the invention shown in FIGS. 1A and 2 are rail connector means for adjustably interconnecting the guide rail "R" of the counterweight system to leg 66*a* of second connector bracket 66. In the present form of the invention, this connector means comprises a pair of spaced apart connector clips 74 that are adjustably connected to second legs 66*a* of connector bracket 66 by threaded bolts 75. Each connector clip 74 has a rail engagement leg 74*a* that is adapted to clampingly engage the legs R-1 of the guide rail R.

It is to be noted that second leg 66*a* of connector bracket 66 is provided with spaced-apart, outwardly extending walls 76 and 76*a*, each of which is provided with a bore 77 that is adapted to receive the shank of a threaded jackbolt 78. Jackbolts 78 are threadably received within an adjustment nut 79 that is connected to each of the jackbolts. Adjustment nuts 79 bear upon the outer surface of walls 76 so that, when the jackbolts are threaded inwardly and outwardly with respect to nuts 79, clips 74 can be adjusted longitudinally of leg 66*a*. In this regard, each of the jackbolts 78 terminates in an end 78*a* that is in engagement with a selected one of the connector clips 74 so that by loosening bolts 75 and threading the jackbolts inwardly and outwardly relative to nuts 79, clips 74 can be moved into and out of clamping engagement with legs R-1 of rail R. To permit this adjustment, leg 66*a* of bracket 66 is provided with a pair of spaced-apart slots 66*b* that accept the shank portion of the connector bolts 75. It is apparent that by loosening locking nuts 80, clips 74 can be moved toward and away from guide rail R in the direction of the arrows of FIG. 2 and can be securely locked in position by tightening jack bolts 78 and then by retightening locking nuts 80. It is to be understood that when the apparatus of the invention is installed within the hoistway in the manner shown in FIG. 1A, the various degrees of adjustment available to the installer permits the installer to precisely locate the guide rails R in an optimum position to permit smooth and efficient operation of the counterweight system.

Figure 5:
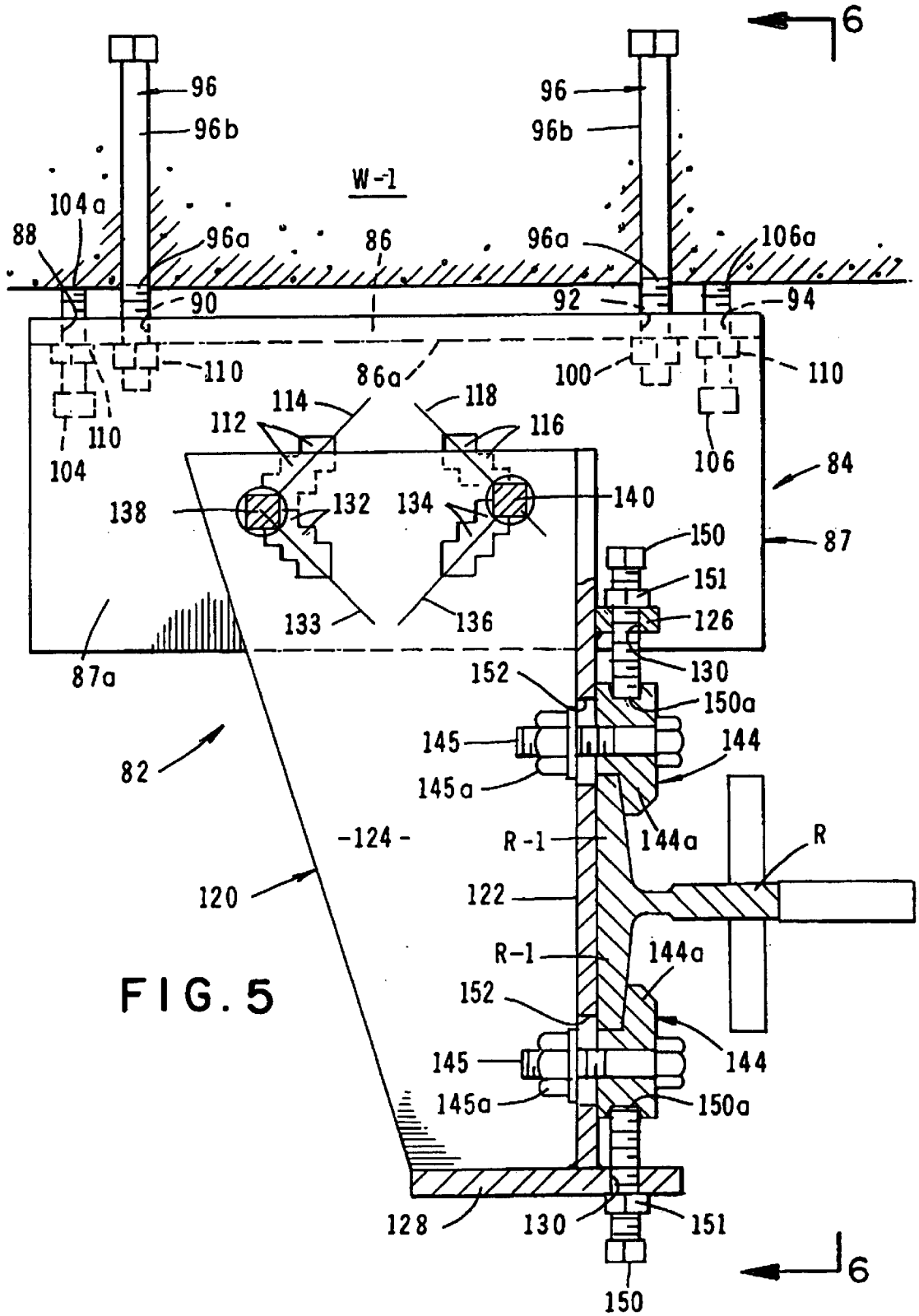
FIG. 5 is a greatly enlarged view of the left-hand portion of the counterweight rail support system shown in the upper right-hand portion of FIG. 1B.
Figure 6:
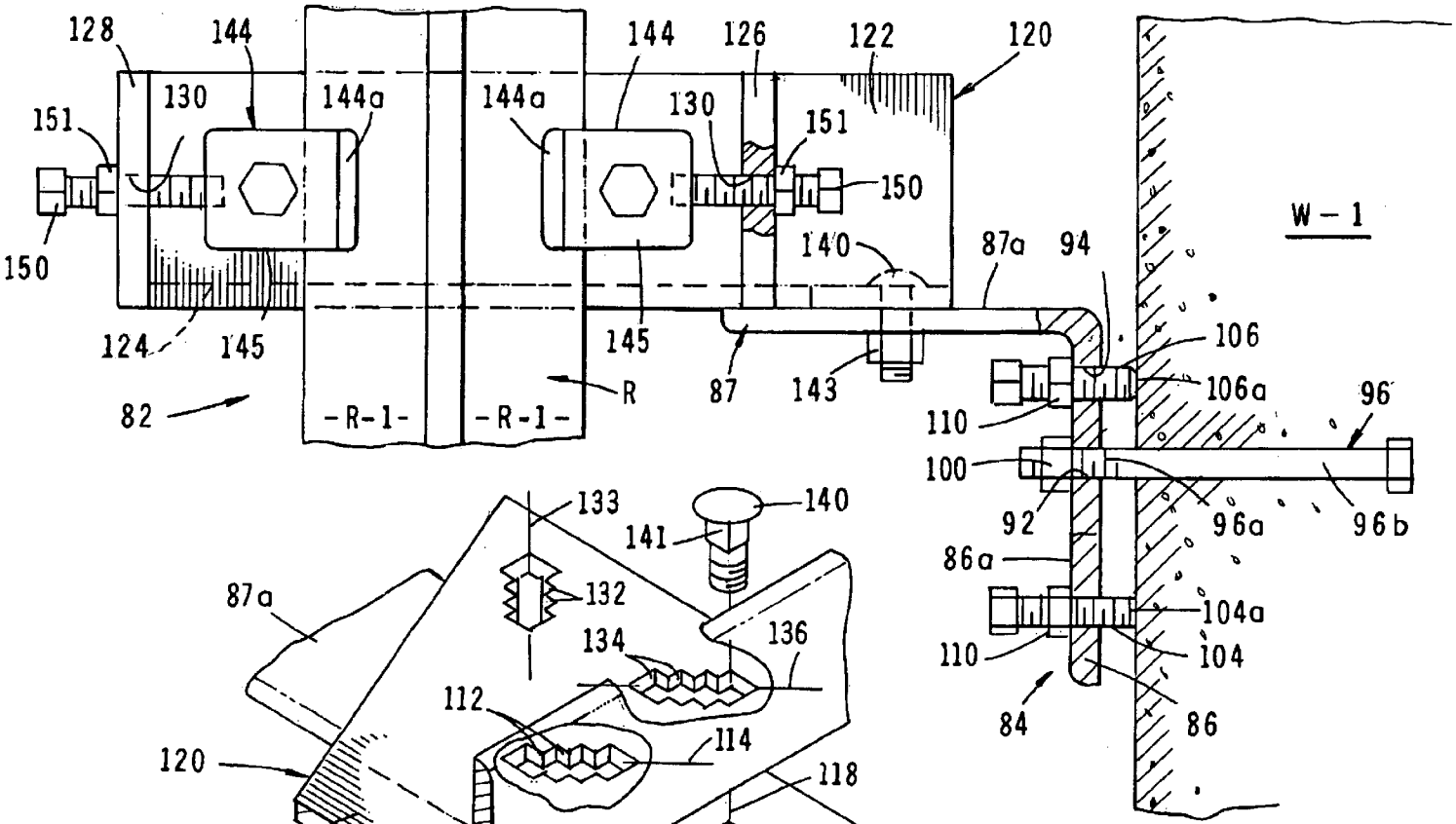
FIG. 6 is a view taken along lines 6—6 of FIG. 5.
Figure 7:
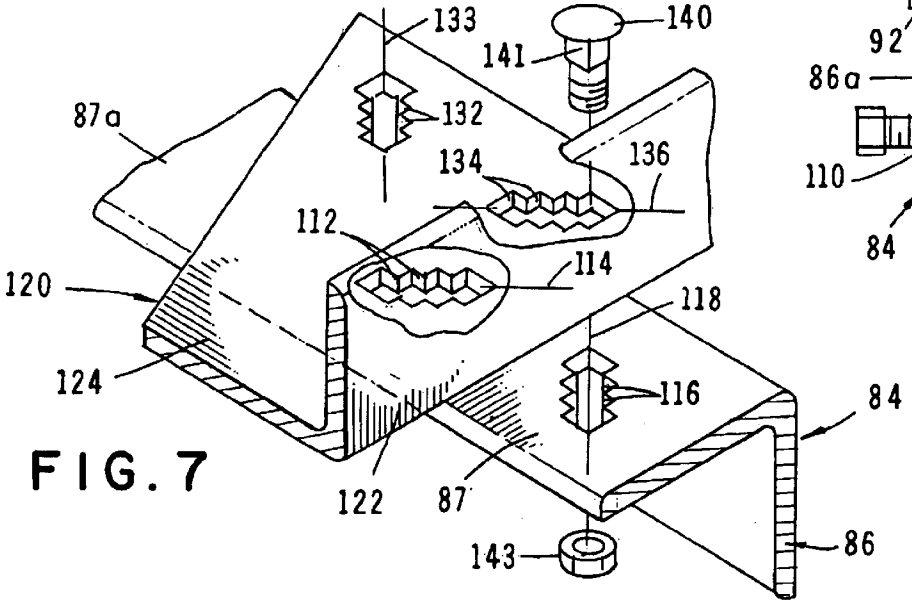
FIG. 7 is a generally perspective, fragmentary view of a portion of the angle brackets of the counterweight rail support shown in FIG. 6 and a portion of the rail support bracket shown in FIG. 6 that is interconnected therewith.

Referring next to FIGS. 5 through 7, one of the two connector assemblies 82 shown in area "B" of FIG. 1B is shown in enlarged form. As indicated in FIG. 1B, this alternate form of the connector apparatus of the invention is used for interconnecting a pair of guide rails of a counterweight system with a structural component, here comprising a supporting structure such as a wall W-1 of the structure that houses the elevator hoistways. As best seen in FIG. 5, each of the connector assemblies 82 of this latest form of the invention comprises a first connector bracket 84 having a first generally planar first leg 86 that is connected to the supporting structure W-1 by interconnection means, the character of which will presently be described. Leg 86 extends generally perpendicularly from a second leg 87 that has a generally planar surface 87*a*. Leg 86 is provided with four spaced-apart apertures 88, 90, 92 and 94. Received within apertures 90 and 92 are the threaded shank portions 96*a* of a pair of anchor bolts 96, the body portions 96*b* of which are embedded within the concrete of the supporting wall W-1. The threaded shank portions 96*a* of bolts 96 extend through apertures 90 and 92 and are interconnected with leg 86 of bracket 84 by locking nuts 100 respectively.

Receivable within apertures 88 and 94 are a pair of threaded jackbolts 104 and 106. The extremities of each of the jackbolts 104 and 106, which are generally designated by the numerals 104*a* and 106*a* respectively, are adapted to pressurally engage the external surface of the supporting wall W-1 in the manner shown in FIG. 5. Jackbolts 104 and 106 are each threadably received within an adjustment nut 110 that is connected to each of the jackbolts. Adjustment nuts 110 bear upon the outer surface 86*a* of leg 86 of bracket 84 so that, when the jackbolts 104 and 106 are threaded inwardly and outwardly with respect to nuts 110, first bracket 84 can be adjustably moved relative to the outer surface of support wall W-1 in a manner to adjust the spacing of first bracket 84 relative to the support wall W-1.

Anchor bolts 96 and jack bolts 104 and 106 comprise the interconnection means of this form of the invention for adjustably interconnecting bracket 84 with the structural component or wall W-1.

Second leg 87 of bracket 84 is provided with a plurality of first through holes 112 that are disposed along a first line 114 that extends at an acute angle with respect to first leg 86. Similarly, leg 87 is provided with a second set of first through holes 116 that are disposed along a second line 118 that extends at an acute angle with respect to first leg 86.

Adjustably interconnected with first connector bracket 84 is a second connector bracket 120. Second bracket 120 has a first leg 122 and a second leg 124 that extends generally perpendicular to first leg 122. As illustrated in FIG. 5, first leg 122 is provided with a pair of spaced-apart, outwardly extending side walls 126 and 128 each of which is provided with a bore 130, the purpose of which will presently be described.

As best seen in FIG. 7, second bracket 120 is also provided with a plurality of through holes 132 that are disposed along a third line 133 that extends at an acute angle with respect to first leg 122 and with respect to line 118. Similarly, leg 124 is provided with another set of through holes 134 that are disposed along a fourth line 136 that extends at an acute angle with respect to first leg 122 and with respect to line 133. Through holes 132 formed in bracket 120 are so constructed and arranged that a selected one of the through holes 132 can be moved into index with a selected one of the through holes 112 formed in bracket 84 by a sliding movement of bracket 120 relative to bracket 84. Similarly, through holes 134 formed in bracket 120 are constructed and arranged so that a selected one of the through holes 134 can be moved into index with a selected one of the through holes 116 formed in bracket 84 when bracket 120 is slidably moved from a first position to a second position relative to bracket 84. More particularly, bracket 120 can be slidably moved relative to bracket 84 in a first direction generally parallel with leg 86 of bracket 84 or, alternatively, can be slidably moved in a second direction generally perpendicular to leg 86 of bracket 84.

When second connector bracket 120 is correctly aligned with first connector bracket 84 and a selected one of the though holes 132 is indexably aligned with a selected one of the through holes 112, a first bolt, such as a bolt 138, can be introduced into the aligned through holes. Similarly, when the connector bracket 120 is correctly aligned with bracket 84 and a selected one of the through holes 134 is indexably aligned with a selected one of the through holes 116, a second bolt, such as a bolt 140, can be introduced into the aligned through holes. With the bolts 138 and 140 in position with the square shank portions 141 thereof (FIG. 7) closely received within the aligned holes, nuts such as nut 143 can be used to securely interconnect connector bracket 120 with bracket 84 in the manner shown in FIGS. 5 and 7. When the brackets are thusly connected, the square shaped shank portions 141 of the bolts will be snugly received within the indexably aligned through holes in the two brackets and will efficiently prevent sliding movement between the brackets.

The connector apparatus of this latest form of the invention further includes connector means for connecting the guide rails of the counterweight system shown in FIG. 1B to first leg 122 of second bracket 120 in the manner illustrated in FIGS. 5 and 6. In this latest form of the invention, the connector means comprises first and second spaced-apart connector clips 144 that are of a similar construction to the earlier identified connector clips 74. Connector clips 144 are adjustably connected to first leg of connector bracket 120 by threaded bolts 145. Each connector clip 144 has a rail engagement leg 144*a* that is adapted to clampingly engage the legs R-1 of the guide rail R. Bores 130 formed in outwardly extending walls 126 and 128 of leg 122 are adapted to receive a threaded jackbolt 150. Jackbolts 150 are each threadably received within an adjustment nut 151. Adjustment nuts 151 bear upon the outer surface of walls 126 and 128 so that, when the jackbolts are threaded inwardly and outwardly with respect to nuts 151, clips 144 can be adjusted relative to leg 122. Each of the jackbolts 150 terminates in an end 150*a* that is in engagement with a selected one of the connector clips 144 so that by loosening bolts 145 and threading the jackbolts inwardly and outwardly relative to nuts 151, clips 144 can be moved into and out of clamping engagement with legs R-1 of rail R. To permit this adjustment, leg 122 of bracket 120 is provided with a pair of spaced-apart slots 152 that accept the shank portion of the connector bolts 145. It is apparent that by loosening locking nuts 145*a*, clips 144 can be moved toward and away from guide rail R in the direction of the arrows of FIG. 5 and can be securely locked in position by tightening jack bolts 150 and then by retightening locking nuts 145*a*.

It is to be understood that when the apparatus of the invention is installed within the hoistway in the manner shown in FIG. 1B, the various degrees of adjustment available to the installer permits the installer to precisely locate the counterweight guide rails in an optimum position to permit smooth and efficient operation of the counterweight system.

Figure 9:
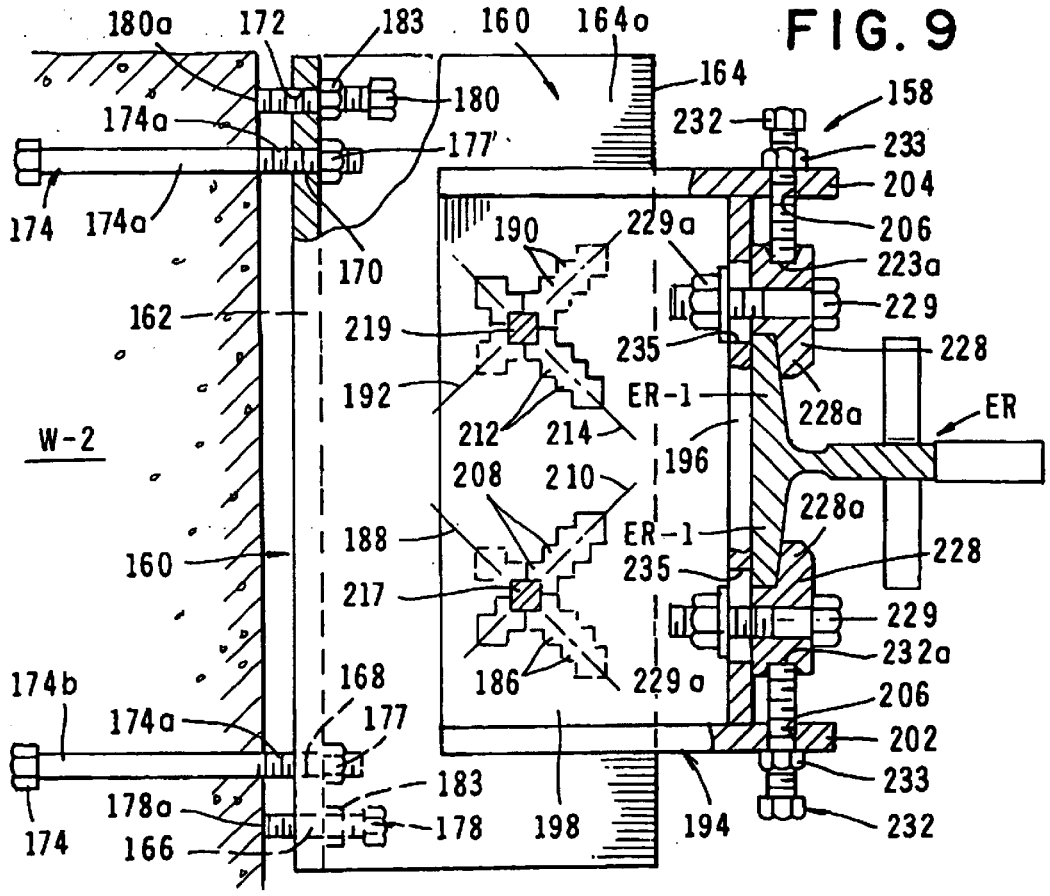
FIG. 9 is a cross-sectional view taken along lines 9—9 of FIG. 8.

Considering next the embodiment of the invention shown in area "C" of FIG. 1A, this embodiment comprises a connector apparatus for interconnecting a guide rail of an elevator system with a wall W-2 of the building structure that houses the elevator system. As best seen in FIG. 9, the connector assembly 158 of this latest form of the invention comprises a first connector bracket 160 having a first generally planar first leg 162 that is connected to a structural component, here shown as the supporting structure W-2. As before, connector bracket 160 is adjustably interconnected with structure W-2 by interconnection means the character of which will presently be described. Leg 162 extends generally perpendicularly from a second leg 164 that has a generally planar surface 164*a*. Leg 164 is provided with four spaced-apart apertures 166, 168, 170 and 172. Received within apertures 168 and 170 are the threaded shank portions 174*a* of a pair of anchor bolts 174, the body portions 174*b* of which are embedded within the concrete of the supporting wall W-2. The threaded shank portions 174*a* of bolts 174 extend through apertures 168 and 170 and are interconnected with leg 162 of bracket 160 by locking nuts 177 respectively.

Receivable within apertures 166 and 172 are threaded jackbolts 178 and 180 respectively. The extremities of each of the jackbolts 178 and 180, which are generally designated by the numerals 178*a* and 180*a* respectively, are adapted to pressurally engage the external surface of the supporting wall W-2 in the manner shown in FIG. 9. Jackbolts 178 and 180 are each threadably received within an adjustment nut 183 that is connected to each of the jackbolts. Adjustment nuts 183 bear upon the outer surface 162*a* of leg 162 of bracket 160 so that, when the jackbolts are threaded inwardly and outwardly with respect to nuts 183, first bracket 160 can be adjustably moved relative to the outer surface of support wall W-2 in a manner to adjust the spacing of first bracket 160 relative to the support wall W-2. Anchor bolts 170 along with jack bolts 178 and 180 comprise the interconnection means of this latest form of the invention.

Second leg 164 of bracket 160 is provided with a plurality of first through holes 186 that are disposed along a first line 188 that extends at an angle with respect to first leg 162. Similarly, leg 164 is provided with a second set of first through holes 190 that are disposed along a second line 192 that extends at an angle with respect to first leg 162. Adjustably interconnected with first connector bracket 160 is a second connector bracket 194. Second bracket 194 has a first leg 196 and a second leg 198 that extends generally perpendicular to first leg 196. As illustrated in FIG. 9, a pair of spaced-apart walls 202 and 204 extend outwardly from leg 196 and each is provided with a threaded bore 206, the purpose of which will presently be described.

As best seen in FIG. 9, leg 198 of second bracket 194 is also provided with a plurality of through holes 208 that are disposed along a third line 210 that extends at an angle with respect to first leg 196 and with respect to line 188. Similarly, leg 198 is provided with another set of through holes 212 that are disposed along a further line 214 that extends at an angle with respect to first leg 196 and with respect to line 192. Through holes 208 formed in bracket 194 are so constructed and arranged that a selected one of the through holes 208 can be moved into index with a selected one of the through holes 186 formed in bracket 160 by a sliding movement of bracket 194 relative to bracket 160. Similarly, through holes 212 formed in bracket 194 are constructed and arranged so that a selected one of the through holes 212 can be moved into index with a selected one of the through holes 190 formed in bracket 160 when bracket 194 is slidably moved from a first position to a second position relative to bracket 160. More particularly, bracket 194 can be slidably moved relative to bracket 160 in a first direction generally parallel with leg 162 of bracket 160 or, alternatively, can be slidably moved in a second direction generally perpendicular to leg 162 of bracket 160.

When second connector bracket 194 is correctly aligned with first connector bracket 160 and a selected one of the though holes 208 is indexably aligned with a selected one of the through holes 186, a first bolt, such as a bolt 217, can be introduced into the aligned through holes. Similarly, when the connector bracket 194 is correctly aligned with bracket 160 and a selected one of the through holes 212 is indexably aligned with a selected one of the through holes 190, a second bolt, such as a bolt 219, can be introduced into the aligned through holes. With the bolts 217 and 219 in position with the square shank portions 222 thereof (FIG. 8) closely received within the aligned holes, nuts, such as nut 224 can be used to securely interconnect connector bracket 194 with bracket 160 in the manner shown in FIGS. 8 and 9. When the brackets are thusly connected, the square shaped shank portions 222 of the bolts will be snugly received within the indexably aligned through holes in the two brackets and will efficiently prevent sliding movement between the brackets.

Figure 8:
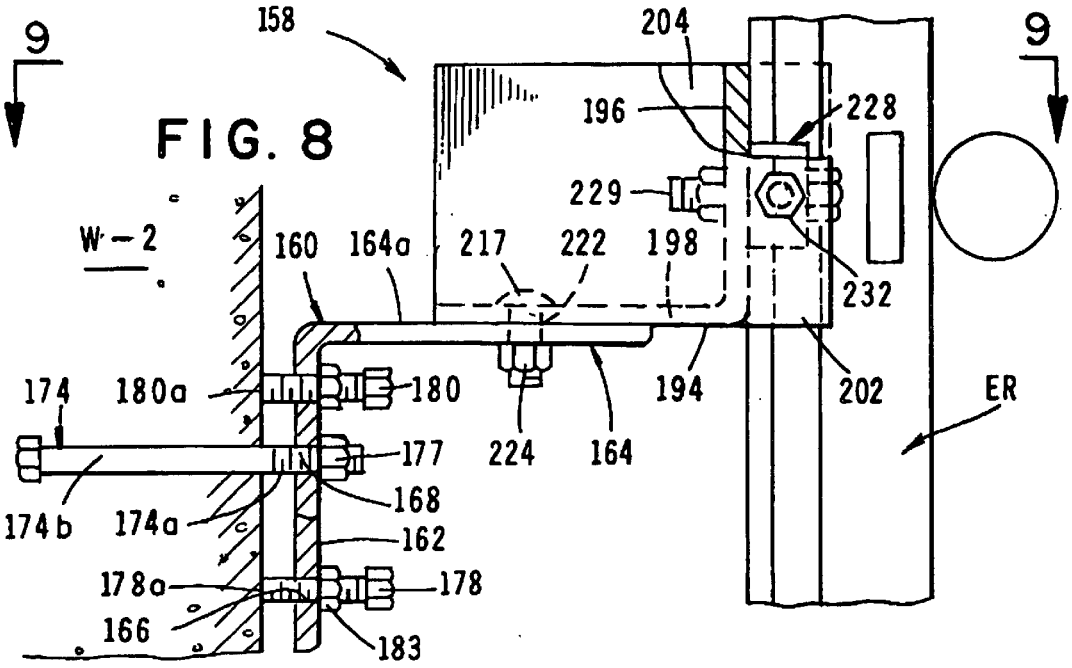
FIG. 8 is a greatly enlarged front view of the left-hand elevator rail support system shown in the lower left-hand portion of FIG. 1A.

As in the earlier described embodiment, the connector apparatus of this latest form of the invention includes connector means for connecting the guide rail ER of the elevator system shown in FIG. 1A to first leg 196 of second bracket 194 in the manner illustrated in FIGS. 8 and 9. In this latest form of the invention, the connector means comprises first and second spaced-apart connector clips 228 that are of a similar construction to the earlier identified connector clips 74. Connector clips 228 are adjustably connected to first leg of connector bracket 194 by threaded bolts 229. Each connector clip 228 has a rail engagement leg 228*a* that is adapted to clampingly engage the legs ER-1 of the guide rail ER.

Bores 206 formed in outwardly extending walls 202 and 204 are adapted to threadably receive a threaded jackbolt 232. Jackbolts 232 are threadably received within an adjustment nut 233 that is connected to each of the jackbolts. Adjustment nuts 233 bear upon the outer surfaces of walls 202 and 204 so that, when the jackbolts are threaded inwardly and outwardly with respect to nuts 233, the connector clips can be adjustably moved relative to leg 196. Each jack bolt 232 has an end 232*a* that is in engagement with a selected one of the connector clips 228 so that by loosening bolts 229 and threading the jackbolts inwardly and outwardly relative to walls 202 and 204, clips 228 can be moved into and out of clamping engagement with legs ER-1 of rail ER. To permit this adjustment, leg 196 of bracket 194 is provided with a pair of spaced-apart slots 235 that accept the shank portion of the connector bolts 229. It is apparent that by loosening locking nuts 229*a*, clips 228 can be moved toward and away from guide rail ER and can be securely locked in position by tightening jack bolts 232 and then by retightening locking nuts 229*a*.

It is to be understood that when the apparatus of the invention is installed within the hoistway in the manner shown in FIG. 1A, the various degrees of adjustment available to the installer permits the installer to precisely locate the guide rail ER in an optimum position relative to the elevator car EC-1.

Figure 12:
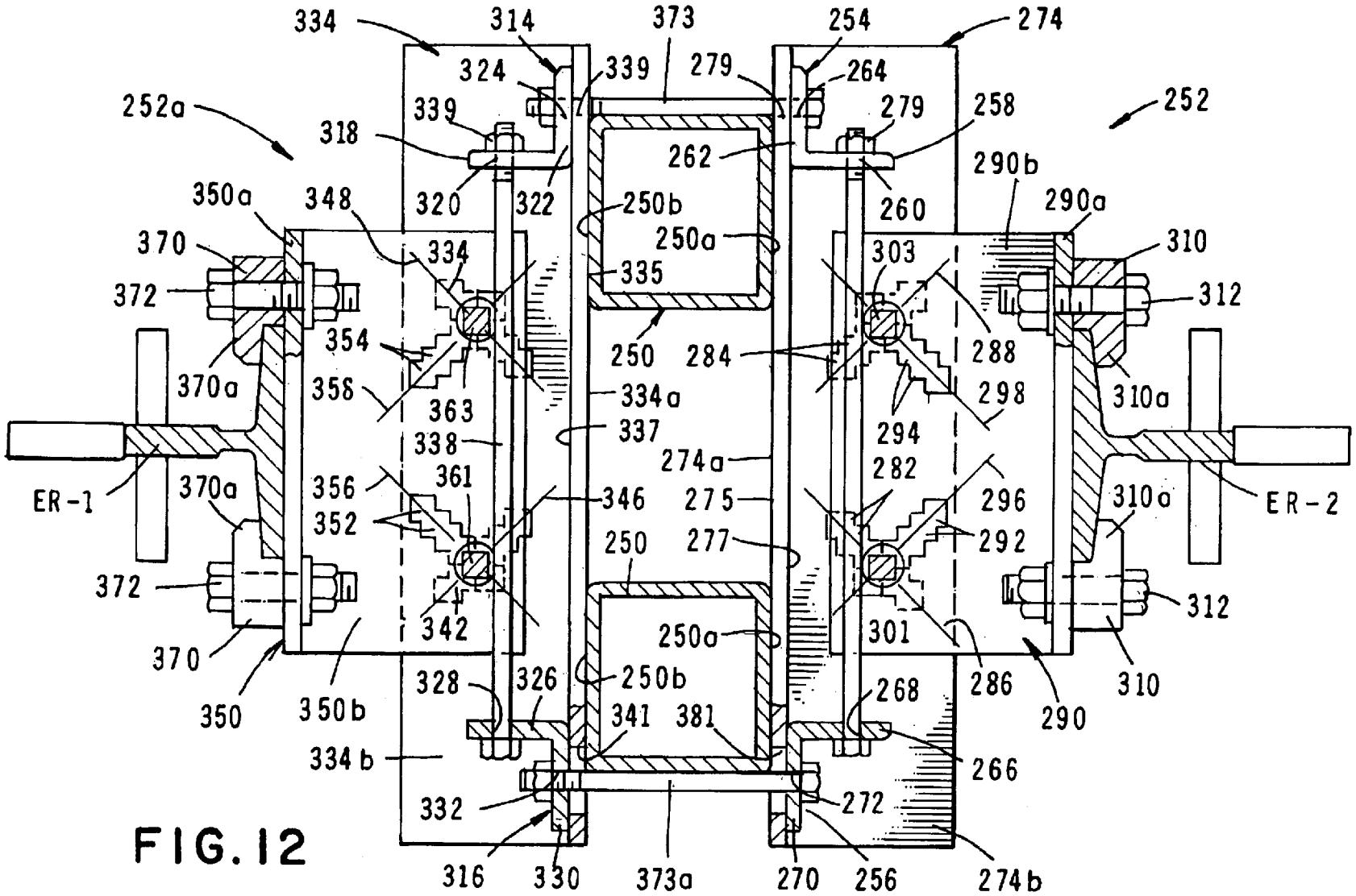
FIG. 12 is a cross-sectional view taken along lines 12—12 of FIG. 11.

Referring next the embodiment of the invention shown in area "D" of FIG. 1A, this embodiment comprises a connector apparatus for interconnecting the guide rails ER-1 and ER-2 of an elevator system with structural components shown here as a pair of spaced apart vertically extending beams or columns 250. As best seen in FIG. 12, this connector apparatus comprises two connector assemblies 252 and 252*a* that function to interconnect the guide rails ER-1 and ER-2 of the elevator system with the pair of vertically extending beams 250.

As shown in FIG. 12, connector assembly 252 of this latest form of the invention comprises first and second spaced-apart right angle brackets 254 and 256. Bracket 254 has a first generally planar, outwardly extending leg 258 that has an aperture 260 formed therein and a second perpendicularly extending second leg 262 that has an aperture 264 extending there through. Bracket 256 also has a first generally planar, outwardly extending leg 266 that has an aperture 268 formed therein and a second perpendicularly extending second leg 270 that has an aperture 272 extending there through.

Maintained in engagement with faces 250*a* of the vertically extending beams 250 by the interconnection means of the invention is the first leg 274*a* of an elongated, first connector bracket that is generally designated in the drawings by the numeral 274. More particularly, leg 274*a* of bracket 274 has a first face 275 that engages the outer faces of the columns 250 and a second face 277 that engages the inner faces of legs 262 and 270. Leg 274*a* of bracket 274 is also provided with an aperture 279 and a slot 281, the purpose of which will presently be described. Interconnecting legs 258 and 266 of first and second angle brackets 256 and 254 is a tie bolt 278. Tie bolt 278 extends through apertures 260 and 268 formed in legs 266 and 258 and is secured in position by a locking nut 279. In this latest form of the invention, angle brackets 256 and 258 comprise part of the interconnection means of the invention for interconnecting first connector bracket 274 with beams 250.

As best seen in FIG. 12, first connector bracket 274 has a second leg 274*b* that extends generally perpendicularly to leg 274*a*. Formed within second leg 274*b* of connector bracket 274 are first and second sets of through holes 282 and 284, the purpose of which will presently be described. Holes 282 are disposed along a first line 286 that extends angularly with respect to first leg 274*a* of connector bracket 274. Similarly, through holes 284 are disposed along a second line 288 that extends angularly with respect to first leg 274*a* of connector bracket 274. Each of the through holes 282 and 284 are generally rectangular in plan and are of a size and shape to closely receive the square shank portion of threaded connector bolts which, in a manner presently to be described, are used to interconnect a second connector bracket 290 with bracket 274.

Second connector bracket 290, which functions to adjustably support rail ER-2, is adjustably interconnected with first connector bracket 274 in a manner now to be described. Like bracket 274, leg 290*b* of connector bracket 290 is provided with first and second sets of through holes 292 and 294. Holes 292 are disposed along a third line 296 that extends angularly with respect to first leg 290*a* of connector bracket 290 and also angularly with respect to line 286. Similarly, through holes 294 are disposed along a fourth line 298 that extends angularly with respect to first leg 290*a* of connector bracket 290 and also angularly with respect to line 288. Each of the through holes 292 and 294 are also generally rectangular in plan and are of a size and shape to closely receive the square shank portion of the threaded connector bolts.

Through holes 292 formed in bracket 290 are so constructed and arranged that a selected one of the through holes 292 can be moved into index with a selected one of the through holes 282 formed in bracket 274 by a sliding movement of bracket 290 relative to bracket 274. Similarly, through holes 294 formed in bracket 290 are constructed and arranged so that a selected one of the through holes 294 can be moved into index with a selected one of the through holes 284 formed in bracket 274 when bracket 290 is moved from a first position to a second position relative to bracket 274. More particularly, bracket 290 can be slidably moved relative to bracket 274 in a first direction generally parallel with leg 274*a* of bracket 274 or, alternatively, can be slidably moved in a second direction generally perpendicular to leg 274*a* of bracket 274.

Figure 10:
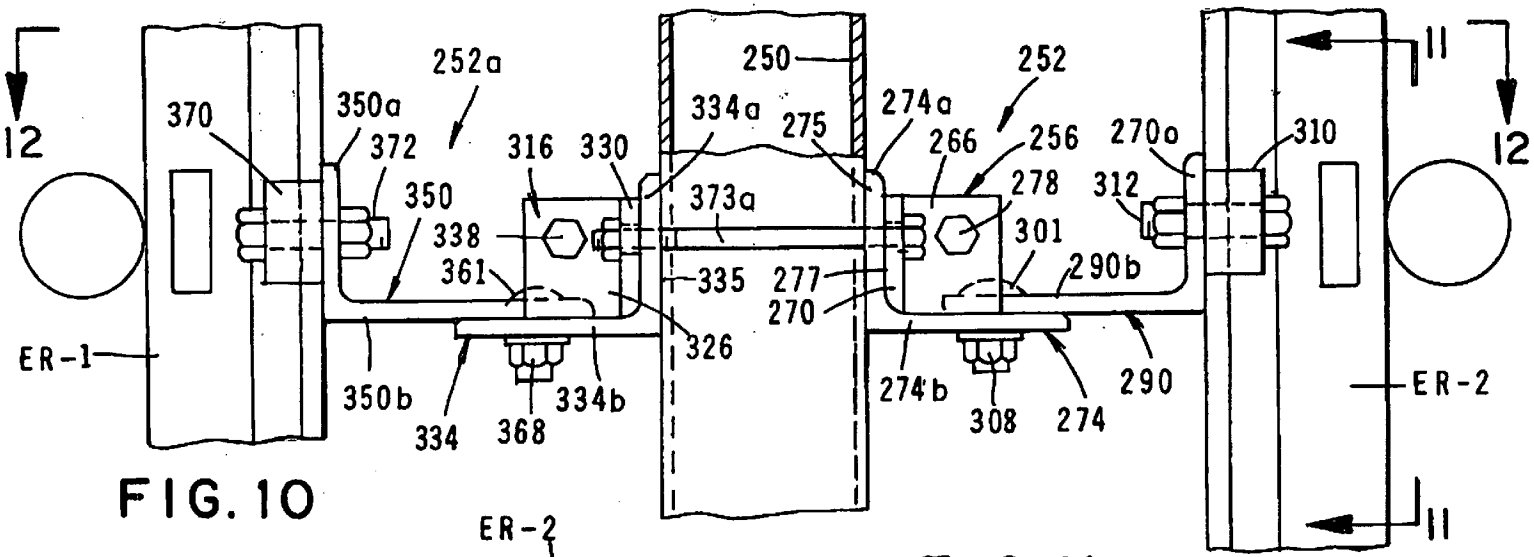
FIG. 10 is a front view of the elevator rail support system shown in the lower central portion of FIG. 1A.
Figure 11:
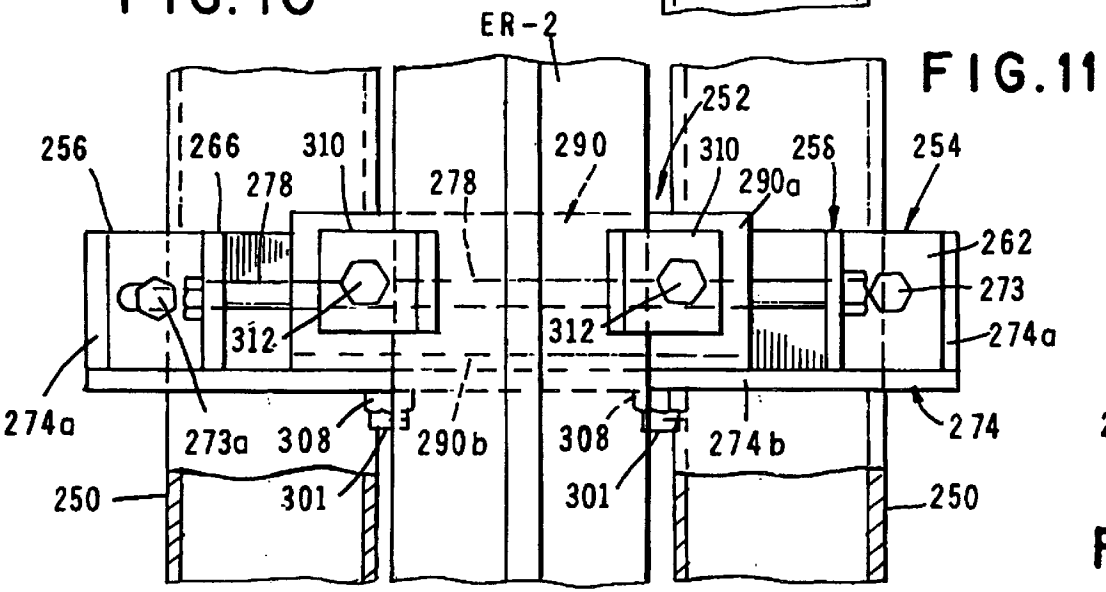
FIG. 11 is a view taken along lines 11—11 of FIG. 10.
Figure 13:
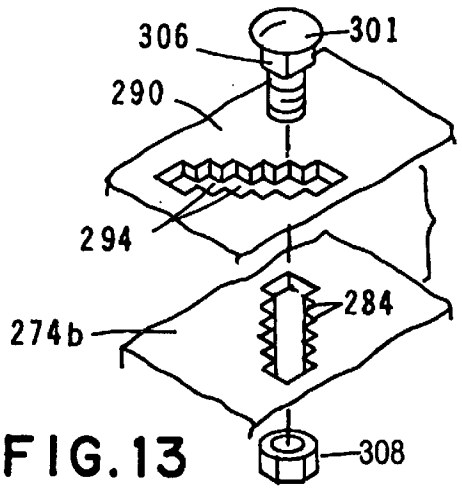
FIG. 13 is a generally perspective, fragmentary view of a portion of the angle bracket that supports one of the elevator rails and a portion of the angle bracket that is adjustably connected to the pair of vertically extending support beams and illustrating the manner of adjustable interconnection of the angle brackets.

When second connector bracket 290 is correctly aligned with first connector bracket 274 and a selected one of the though holes 292 is indexably aligned with a selected one of the through holes 282, a first bolt, such as a bolt 301, can be introduced into the aligned through holes. Similarly, when the connector bracket 290 is correctly aligned with bracket 274 and a selected one of the through holes 294 is indexably aligned with a selected one of the through holes 284, a second bolt, such as a bolt 303, can be introduced into the aligned through holes. With the bolts 301 and 303 in position with the square shank portions 306 thereof (FIG. 13) closely received within the aligned holes, nuts such as nut 308 can be used to securely interconnect connector bracket 290 with bracket 274 in the manner shown in FIGS. 10, 11 and 12. When the brackets are thusly connected, the square shaped shank portions 306 of the bolts will be snugly received within the indexably aligned through holes in the two brackets and will efficiently prevent sliding movement between the brackets.

Also forming a part of the connector apparatus of the form of the invention shown in FIGS. 1A and 12 are connector means for interconnecting the guide rail ER-2 of the elevator system to leg 290*a* of second connector bracket 290. In the present form of the invention, this connector means comprises a pair of spaced apart connector clips 310 that are connected to second leg 290*a* of connector bracket 290 by threaded bolts 312. Each connector clip 310 has a rail engagement leg 310*a* that is adapted to clampingly engage the legs of the guide rail ER-3 in the manner shown in FIG. 12.

As shown in FIG. 12, connector assembly 252*a* of this latest form of the invention is of a similar construction to connector assembly 252 and comprises first and second spaced-apart right angle brackets 314 and 316. Bracket 314 has a first generally planar, outwardly extending leg 318 that has an aperture 320 formed therein and a second perpendicularly extending second leg 322 that has an aperture 324 extending there through. Bracket 316 also has a first generally planar, outwardly extending leg 326 that has an aperture 328 formed therein and a second perpendicularly extending second leg 330 that has an aperture 332 extending there through.

Maintained in engagement with faces 250*b* of the vertically extending beams 250 by the interconnection means is the first leg 334*a* of an elongated, first connector bracket that is generally designated in the drawings by the numeral 334. More particularly, leg 334*a* of bracket 334 has a first face 335 that engages the outer faces of the columns 250 and a second face 337 that engages the inner faces of legs 322 and 330. Leg 334*a* of bracket 334 is also provided with an aperture 339 and a slot 341, the purpose of which will presently be described. Interconnecting legs 318 and 326 of first and second angle brackets 316 and 314 is a tie bolt 338. Tie bolt 338 extends through apertures 320 and 328 formed in legs 326 and 318 and is secured in position by a locking nut 339.

As best seen in FIG. 12, first connector bracket 334 has a second leg 334*b* that extends generally perpendicularly to leg 334*a*. Formed within second leg 334*b* of connector bracket 334 are first and second sets of through holes 342 and 344, the purpose of which will presently be described. Holes 342 are disposed along a first line 346 that extends angularly with respect to first leg 334*a* of connector bracket 334. Similarly, through holes 344 are disposed along a second line 348 that extends angularly with respect to first leg 334*a* of connector bracket 334. Each of the through holes 342 and 344 are generally rectangular in plan and are of a size and shape to closely receive the square shank portion of threaded connector bolts which, in a manner presently to be described, are used to interconnect a second connector bracket 350 with bracket 334.

Second connector bracket 350, which functions to adjustably support rail ER-2, is adjustably interconnected with first connector bracket 334 in a manner now to be described. Like bracket 334, leg 350*b* of connector bracket 350 is provided with first and second sets of through holes 352 and 354. Holes 352 are disposed along a third line 356 that extends angularly with respect to first leg 350*a* of connector bracket 350 and also angularly with respect to line 346. Similarly, through holes 354 are disposed along a fourth line 358 that extends angularly with respect to first leg 350*a* of connector bracket 350 and also angularly with respect to line 348. Each of the through holes 352 and 354 are also generally rectangular in plan and are of a size and shape to closely receive the square shank portion of the threaded connector bolts.

Through holes 352 formed in bracket 350 are so constructed and arranged that a selected one of the through holes 352 can be moved into index with a selected one of the through holes 342 formed in bracket 334 by a sliding movement of bracket 350 relative to bracket 334. Similarly, through holes 354 formed in bracket 350 are constructed and arranged so that a selected one of the through holes 344 formed in bracket 334 when bracket 350 is moved from a first position to a second position relative to bracket 334. More particularly, bracket 350 can be slidably moved relative to bracket 334 in a first direction generally parallel with leg 334*a* of bracket 334 or, alternatively, can be slidably moved in a second direction generally perpendicular to leg 334*a* of bracket 334.

When second connector bracket 350 is correctly aligned with first connector bracket 334 and a selected one of the through holes 352 is indexably aligned with a selected one of the through holes 342, a first bolt, such as a bolt 361, can be introduced into the aligned through holes. Similarly, when the connector bracket 350 is correctly aligned with bracket 334 and a selected one of the through holes 354 is indexably aligned with a selected one of the through holes 344, a second bolt, such as a bolt 363, can be introduced into the aligned through holes. With the bolts 361 and 363 in position with the square shank portions thereof closely received within the aligned holes, nuts such as nut 368 can be used to securely interconnect connector bracket 350 with bracket 334 in the manner shown in FIGS. 10, 11 and 12. When the brackets are thusly connected, the square shaped shank portions of the bolts will be snugly received within the indexably aligned through holes in the two brackets and will efficiently prevent sliding movement between the brackets. Brackets 254, 256, 314 and 316, along with tie bolts 373, 373*a*, 278, and 338 comprise the interconnection means of this latest embodiment for maintaining brackets 274 and 334 in engagement with the structural components or beams 250.

Also forming a part of the connector apparatus of the form of the invention shown in FIGS. 1A and 12 are connector means for interconnecting the guide rail ER-1 of the elevator system to leg 350*a* of second connector bracket 350. In the present form of the invention, this connector means comprises a pair of spaced apart connector clips 370 that are connected to second leg 350*a* of connector bracket 350 by threaded bolts 372. Each connector clip 370 has a rail engagement leg 370*a* that is adapted to clampingly engage the legs of the guide rail ER-2 in the manner shown in FIG. 12.

As shown in FIG. 12, assemblies 252 and 252*a* are connected together by a pair of tie bolts 373 and 373*a*. Tie bolt 373 extends through apertures 264 and 324 formed in brackets 254 and 314 respectively. Tie bolt 373*a* extends through apertures 272 and 332 of angle brackets 256 and 316. Tie bolt 373 also extends through apertures 279 and 339 formed in legs 274*a* and 334*a* of brackets 274 and 334. Tie bolt 373*a* also extends through slots 281 and 341 formed in legs 274*a* and 334*a* of brackets 274 and 334. Because of the configuration of slots 281 and 341, angle brackets 256 and 316 are free to move longitudinally of brackets 274 and 334 to accommodate for any misalignment of rails ER-2 and ER-3. In this latest form of the invention, angle brackets 314 and 316, along with tie bolts 373 and 373*a* comprise the beam interconnection means of the invention for interconnecting connector bracket 334 with beams 373 and 373*a*.

Figure 14:
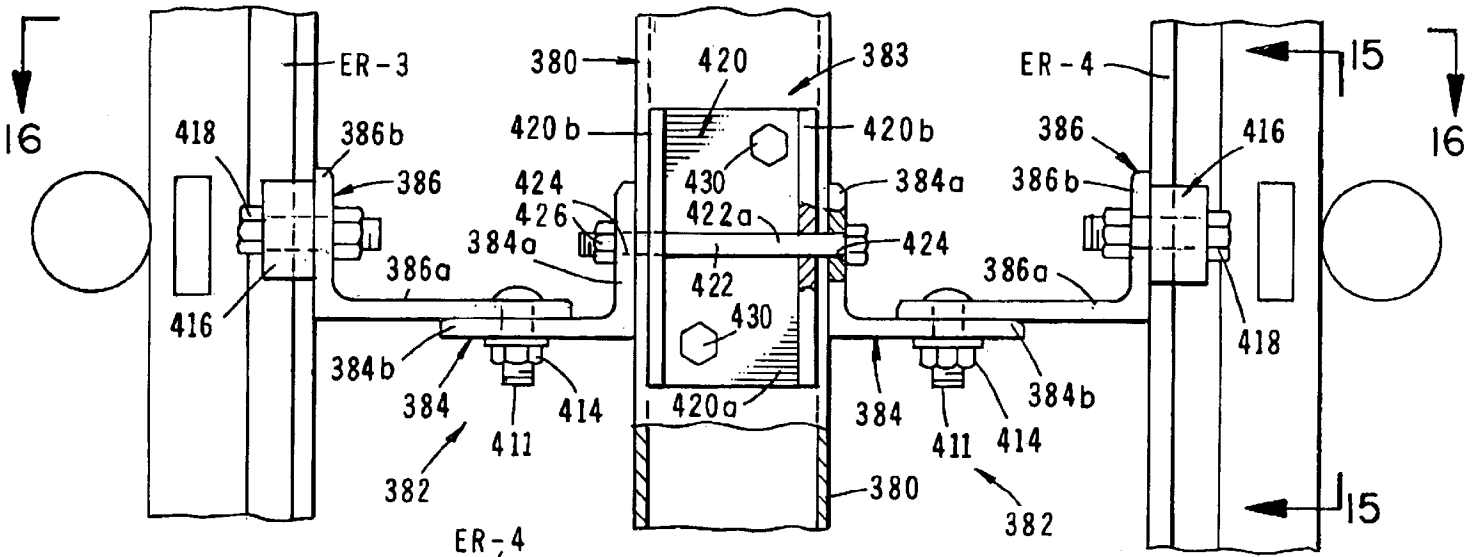
FIG. 14 is a front view of an alternate form of the elevator rail support system shown in the lower central portion of FIG. 1A.
Figure 15:
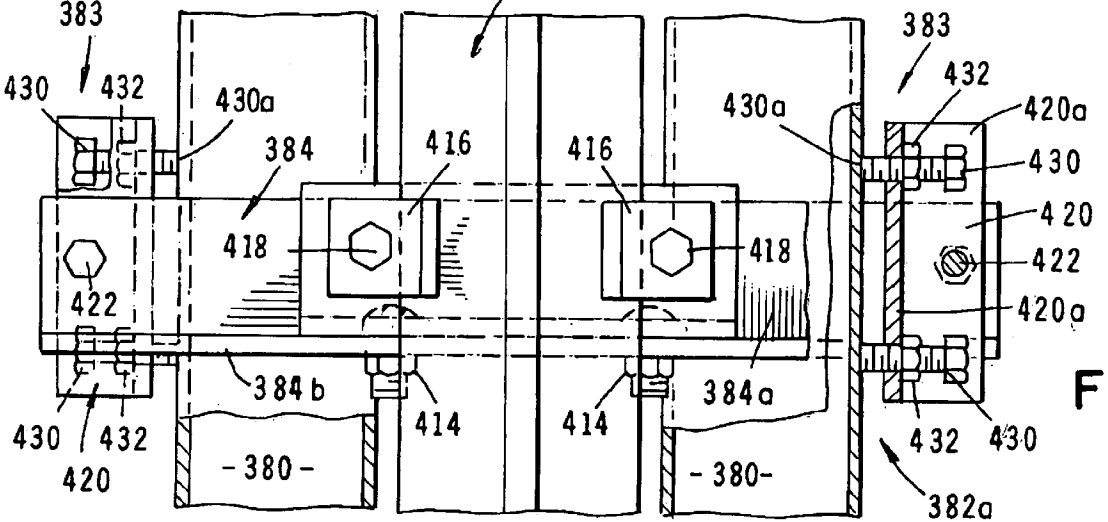
FIG. 15 is a cross-sectional view taken along lines 15—15 of FIG. 14.
Figure 16:
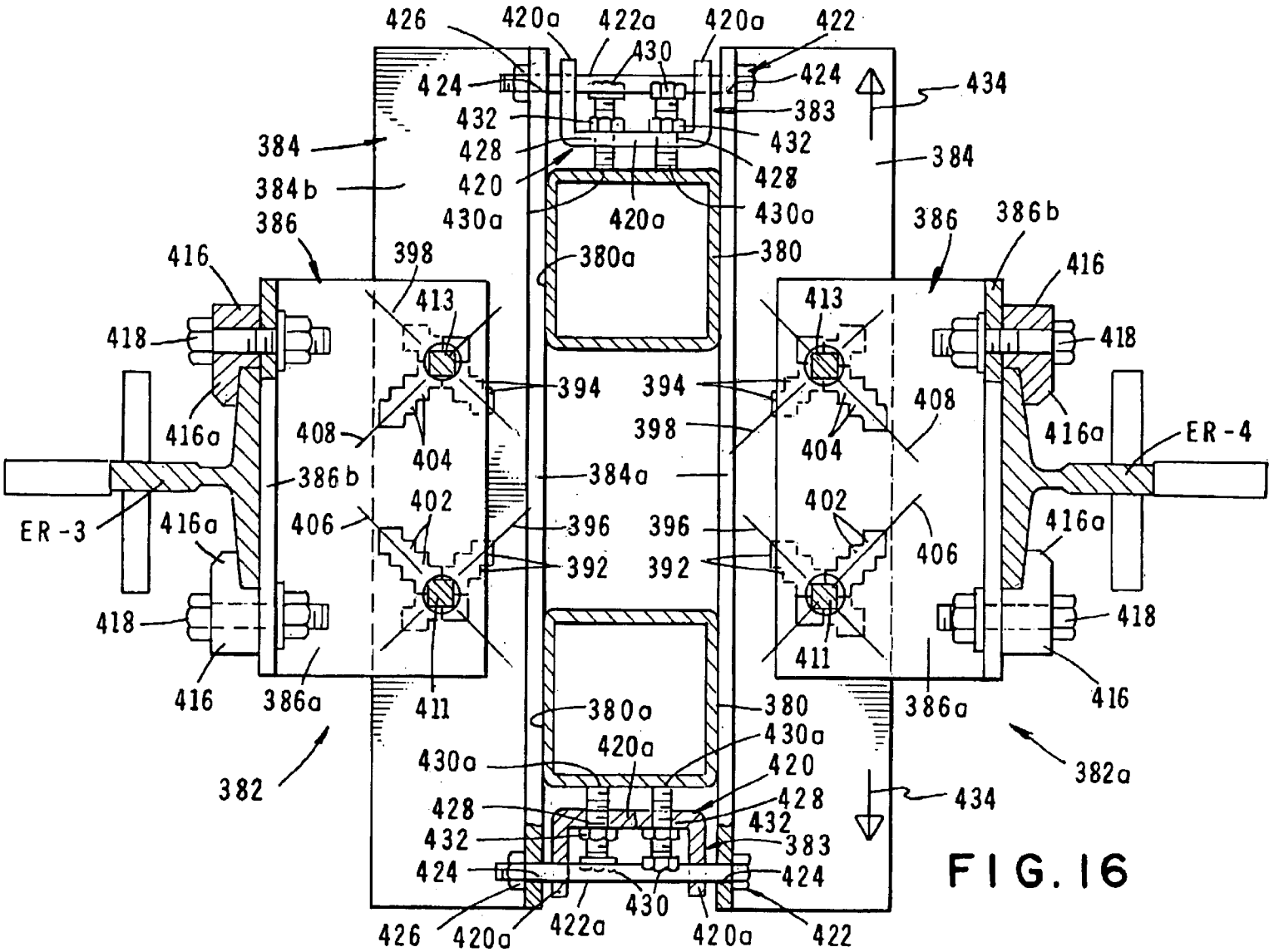
FIG. 16 is a cross-sectional view taken along lines 16—16 of FIG. 14.

Considering now the embodiment of the invention shown in FIGS. 14, 15, and 16. This embodiment is similar to the last described embodiment and comprises a connector apparatus for interconnecting the guide rails ER-3 and ER-4 of an elevator system with structural components shown here as a pair of spaced apart vertically extending beams 380 (not shown in FIGS. 1A and 1B). As best seen in FIG. 16, this connector apparatus comprises two substantially identical connector assemblies 382 and 382*a* that are interconnected by two substantially identical adjustment subassemblies 383. In a manner presently to be described, the several cooperating assemblages just described function to interconnect the guide rails ER-3 and ER-4 of the elevator system with the pair of vertically extending beams 380.

As shown in FIG. 16, each of the connector assemblies 382 and 382*a* of this latest form of the invention comprises a first connector bracket 384 and a second connector bracket 386 that is adjustably connected to first bracket 384. In a manner presently to be described, adjustment assemblies 383, which here comprise the interconnection means of this latest form of the invention, maintain the first leg 384*a* of each of the brackets 384 in pressural engagement with faces 380*a* of the horizontally extending beams 380.

The second leg 384*b* of bracket 384, which leg extends generally perpendicularly to leg 384*a* is provided with first and second sets of through holes 392 and 394, the purpose of which will presently be described. Holes 392 are disposed along a first line 396 that extends angularly with respect to first leg 384*a* of connector bracket 384. Similarly, through holes 394 are disposed along a second line 398 that extends angularly with respect to first leg 384*a* of connector bracket 384. Each of the through holes 392 and 394 are generally rectangular in plan and are of a size and shape to closely receive the square shank portion of threaded connector bolts which, in a manner presently to be described, are used to interconnect a second connector bracket 386 with bracket 384.

Second connector bracket 386, which functions to adjustably support rail ER-3, is adjustably interconnected with first connector bracket 384 in a manner now to be described. Like bracket 384, leg 386*a* of connector bracket 386 is provided with first and second sets of through holes 402 and 404. Holes 402 are disposed along a third line 406 that extends angularly with respect to second leg 386*b* of connector bracket 386 and also angularly with respect to line 396. Similarly, through holes 404 are disposed along a fourth line 408 that extends angularly with respect to leg 386*b* of connector bracket 386 and also angularly with respect to line 398. Each of the through holes 402 and 404 of brackets 386 are also generally rectangular in plan and are of a size and shape to closely receive the square shank portion of the threaded connector bolts.

Through holes 402 formed in brackets 386 are so constructed and arranged that a selected one of the through holes 402 can be moved into index with a selected one of the through holes 392 formed in brackets 386 by a sliding movement of the brackets 386 relative to the brackets 384. Similarly, through holes 404 formed in brackets 386 are constructed and arranged so that a selected one of the through holes 404 can be moved into index with a selected one of the through holes 394 formed in bracket 384 when brackets 386 are moved from a first position to a second position relative to bracket 384. More particularly, brackets 386 can be slidably moved relative to brackets 384 in a first direction generally parallel with legs 384*a* of bracket 384 or, alternatively, can be slideably moved in a second direction generally perpendicular to legs 384*a* of bracket 384.

As best seen by referring to FIG. 16, the interconnection means or adjustment assemblies 383 of this latest form of the invention comprise a generally U-shaped bracket 420 having a bight portion 420*a* and first and second spaced-apart legs 420*b*. The connector assembly also includes a tie bolt 422, the shank portion 422*a* of which is received within apertures 424 provided in legs 384*a* of brackets 384. The shank portion of the tie bolt also extends through apertures provided in legs 420*b* of U-shaped member 420 in the manner shown in FIG. 16. A locking nut 426 secures bolt 422 in position and, when tightened, urges brackets 384 into pressural engagement with the faces of the spaced-apart beams or columns 380.

Each of the U-shaped members 420 of the two identical adjustment assemblies 383 is provided with a pair of spaced-apart apertures 428 that receive jackbolts 430. Jackbolts are threadably received within nuts 432 that bear on the outer surfaces of bight portion 420*a* of the U-shaped member 420. Each of the jackbolts 430 terminates in an end 430*a* which is adapted to engage the outwardly facing walls of beams 380 in the manner shown in FIG. 16. It is apparent that, with the construction shown, by first loosening nuts 426 and then by threadably adjusting jackbolts 430, brackets 384 can be adjustably moved relative to columns 380 in the direction of the arrows 434 of FIG. 16. Once in the desired position, nuts can be retightened and jackbolts 430 will function to securely position the assemblages 382 and 382*a* in engagement with beams 380.

It is to be understood that when this latest embodiment of the apparatus of the invention is installed within the elevator hoistway, the various degrees of adjustment available to the installer permits the installer to precisely locate the guide rails ER-3 and ER-4 in an optimum position relative to the elevator cars with which they are associated.

Figure 16A:
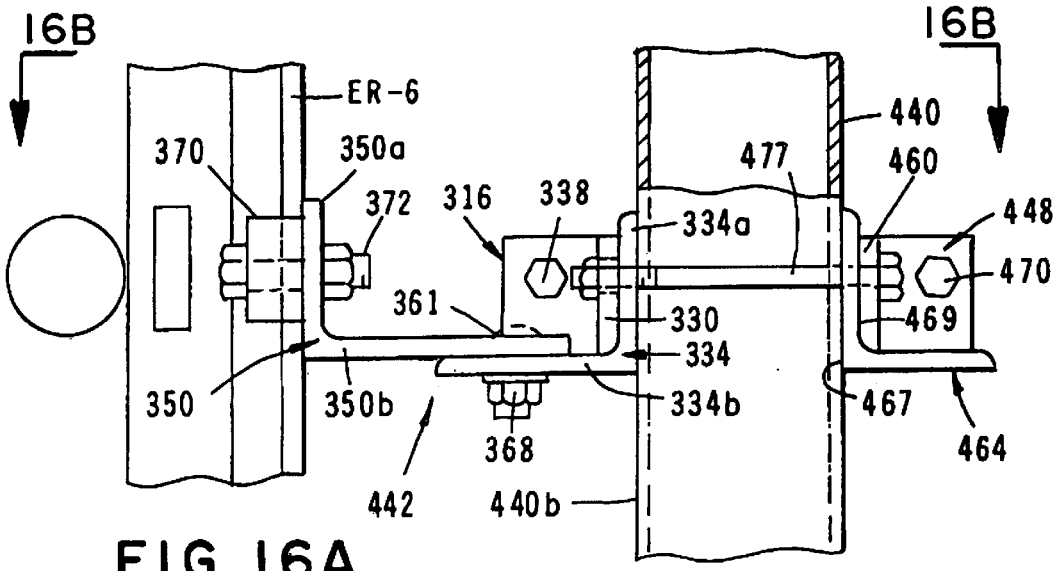
FIG. 16A is a greatly enlarged front view of the elevator car rail support system shown in the lower right hand portion of FIG. 1B.
Figure 16B:
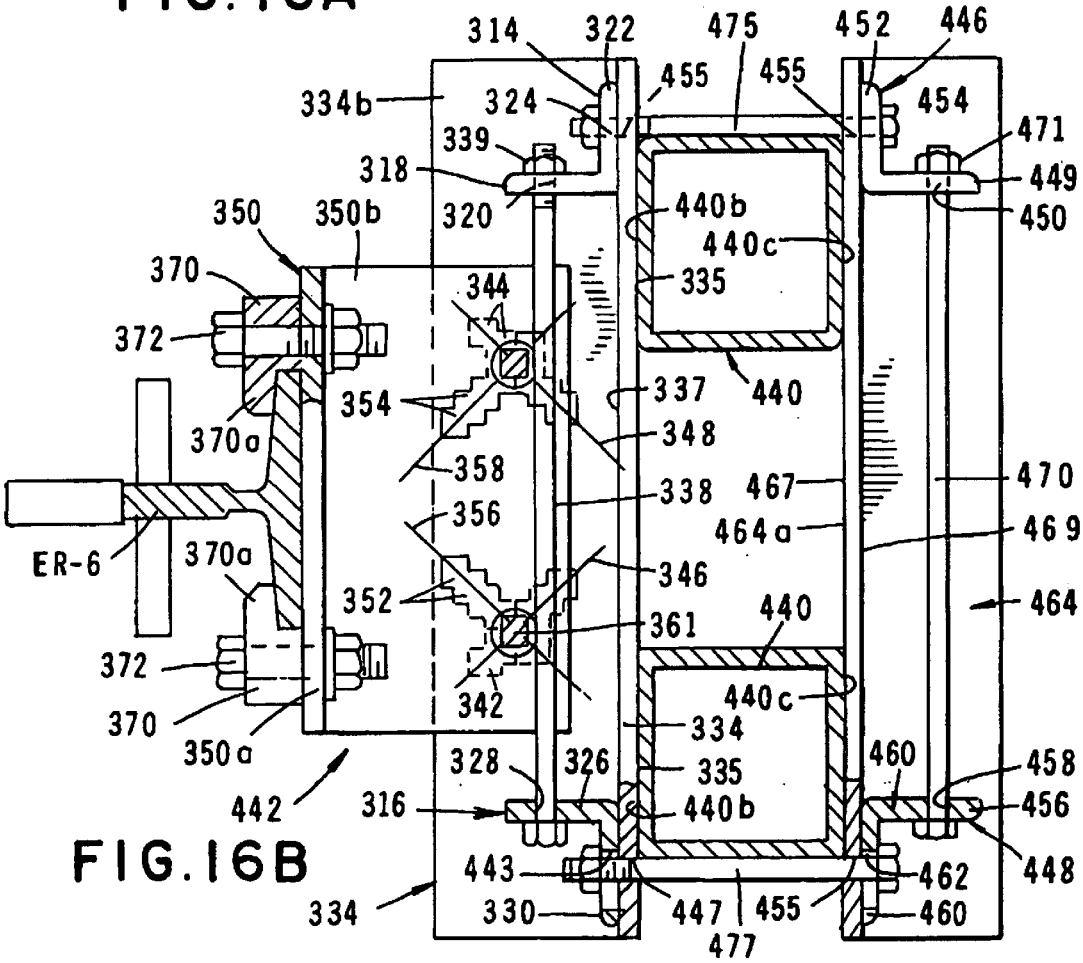
FIG. 16B is a view taken along lines 16B—16B of FIG. 16A.

Referring next the embodiment of the invention shown in area "F" of FIG. 1B, this embodiment, which is somewhat similar to the last two described embodiments, comprises a connector apparatus for interconnecting the guide rail R-6 of an elevator system with a pair of spaced apart vertically extending columns 440. As seen in FIGS. 16A and 16B, this embodiment includes a connector assembly 442 that is substantially identical to the connector assembly 252*a* as shown in FIG. 12. This being the case, like numerals are used in FIGS. 16A and 16B to identify like components.

As best seen in FIG. 16B, connector assembly 442 of this latest form of the invention comprises first and second spaced-apart right angle brackets 314 and 316. Bracket 314 has a first generally planar, outwardly extending leg 318 that has an aperture 320 formed therein and a second perpendicularly extending second leg 322 that has an aperture 324 extending there through. Bracket 316 also has a first generally planar, outwardly extending leg 326 that has an aperture 328 formed therein and a second perpendicularly extending second leg 330 that has a slot 443 extending there through. Disposed in engagement with faces 440*b* of the vertically extending beams 440 is the first leg 334*a* of an elongated, first connector bracket that is generally designated in the drawings by the numeral 334. More particularly, leg 334*a* of bracket 334 has a first face 335 that engages the outer faces of the columns 440 and a second face 337 that engages the inner faces of legs 322 and 330. Leg 334*a* of bracket 334 is also provided with an apertures 445 and 447, the purpose of which will presently be described. Interconnecting legs 318 and 326 of first and second angle brackets 316 and 318 is a tie bolt 338. Tie bolt 338 extends through apertures 320 and 328 formed in legs 316 and 318 and is secured in position by a locking nut 339.

As shown in FIG. 16A, first connector bracket 334 has a second leg 334*b* that extends generally perpendicularly to leg 334*a*. Formed within second leg 334*b* of connector bracket 334 are first and second sets of through holes 342 and 344, the purpose of which will presently be described. Holes 342 are disposed along a first line 346 that extends angularly with respect to first leg 334*a* of connector bracket 334. Similarly, through holes 344 are disposed along a second line 348 that extends angularly with respect to first leg 334*a* of connector bracket 334. Each of the through holes 342 and 344 are generally rectangular in plan and are of a size and shape to closely receive the square shank portion of threaded connector bolts which, in a manner presently to be described, are used to interconnect a second connector bracket 350 with bracket 334.

Second connector bracket 350, which functions to adjustably support rail R-6, is adjustably interconnected with first connector bracket 334 in a manner now to be described. Like bracket 334, leg 350*b* of connector bracket 350 is provided with first and second sets of through holes 352 and 354. Holes 352 are disposed along a third line 356 that extends angularly with respect to first leg 350*a* of connector bracket 350 and also angularly with respect to line 346. Similarly, through holes 354 are disposed along a fourth line 358 that extends angularly with respect to first leg 350*a* of connector bracket 350 and also angularly with respect to line 348. Each of the through holes 352 and 354 are also generally rectangular in plan and are of a size and shape to closely receive the square shank portion of the threaded connector bolts.

Through holes 352 formed in bracket 354 are so constructed and arranged that a selected one of the through holes 352 can be moved into index with a selected one of the through holes 342 formed in bracket 334 by a sliding movement of bracket 350 relative to bracket 334. Similarly, through holes 354 formed in bracket 350 are constructed and arranged so that a selected one of the through holes 354 can be moved into index with a selected one of the through holes 344 formed in bracket 334 when bracket 350 is moved from a first position to a second position relative to bracket 334. More particularly, bracket 350 can be slidably moved relative to bracket 334 in a first direction generally parallel with leg 334*a* of bracket 334 or, alternatively, can be slidably moved in a second direction generally perpendicular to leg 334*a* of bracket 334.

When second connector bracket 350 is correctly aligned with first connector bracket 334 and a selected one of the though holes 352 is indexably aligned with a selected one of the through holes 342, a first bolt, such as a bolt 361, can be introduced into the aligned through holes. Similarly, when the connector bracket 350 is correctly aligned with bracket 334 and a selected one of the through holes 354 is indexably aligned with a selected one of the through holes 344, a second bolt, such as a bolt 363, can be introduced into the aligned through holes. With the bolts 361 and 363 in position with the square shank portions thereof closely received within the aligned holes, nuts such as nut 368 can be used to securely interconnect connector bracket 350 with bracket 334 in the manner shown in the drawings. When the brackets are thusly connected, the square shaped shank portions of the bolts will be snugly received within the indexably aligned through holes in the two brackets and will efficiently prevent sliding movement between the brackets.

Also forming a part of the connector apparatus of this latest form of the invention shown in FIGS. 16A and 16B are connector means for interconnecting the guide rail ER-6 of the elevator system to leg 350*a* of second connector bracket 350. As before, this connector means comprises a pair of spaced apart connector clips 370 that are connected to second leg 350*a* of connector bracket 350 by threaded bolts 372. Each connector clip 370 has a rail engagement leg 370*a* that is adapted to clampingly engage the legs of the guide rail ER-6 in the manner shown in FIG. 16B.

The connector apparatus of this latest form of the invention also includes third and fourth spaced-apart right angle brackets 446 and 448. Bracket 446 has a first generally planar, outwardly extending leg 449 that has an aperture 450 formed therein and a second perpendicularly extending second leg 452 that has an aperture 454 extending there through. Bracket 448 also has a first generally planar, outwardly extending leg 456 that has an aperture 458 formed therein and a second perpendicularly extending second leg 460 that has a slot 462 extending there through.

Disposed in engagement with faces 440*c* of the vertically extending beams 440 is the first leg 464*a* of an elongated, connector bracket that is generally designated in the drawings by the numeral 464. More particularly, leg 464*a* of bracket 464 has a first face 467 that engages the outer faces of the columns 440 and a second face 469 that engages the inner faces of legs 452 and 460 of brackets 446 and 448. Interconnecting legs 449 and 456 of second and third angle brackets 446 and 448 is a tie bolt 470. Tie bolt 470 extends through apertures 450 and 458 formed in legs 449 and 456 and is secured in position by a locking nut 471.

As shown in FIG. 16B, the assemblage made up of angle brackets 446, 448 and 464 and tie bolt 470 are interconnected with assembly 442 by a pair of tie bolts 475 and 477. Tie bolt 475 extends through apertures 454 and 324 formed in brackets 464 and 314 respectively. Tie bolt 477 extends through slots 462 and 443 of angle brackets 448 and 316 respectively. Tie bolt 475 also extends through apertures 455 and 445 formed in legs 464*a* and 334*a* of brackets 464 and 334. Tie bolt 477 also extends through slots 462 and 443 formed in legs 460 and 330 of brackets 448 and 316 respectively. Because of the configuration of slots 462 and 443, assembly 442 is free to move longitudinally of columns 440 to accommodate for any misalignment of rail ER-6. In this latest form of the invention, angle brackets 316, 318, 448 and 446, along with tie bolts 475 and 477 comprise the beam interconnection means of the invention for interconnecting connector bracket 334 with beams 440.

Figure 17:
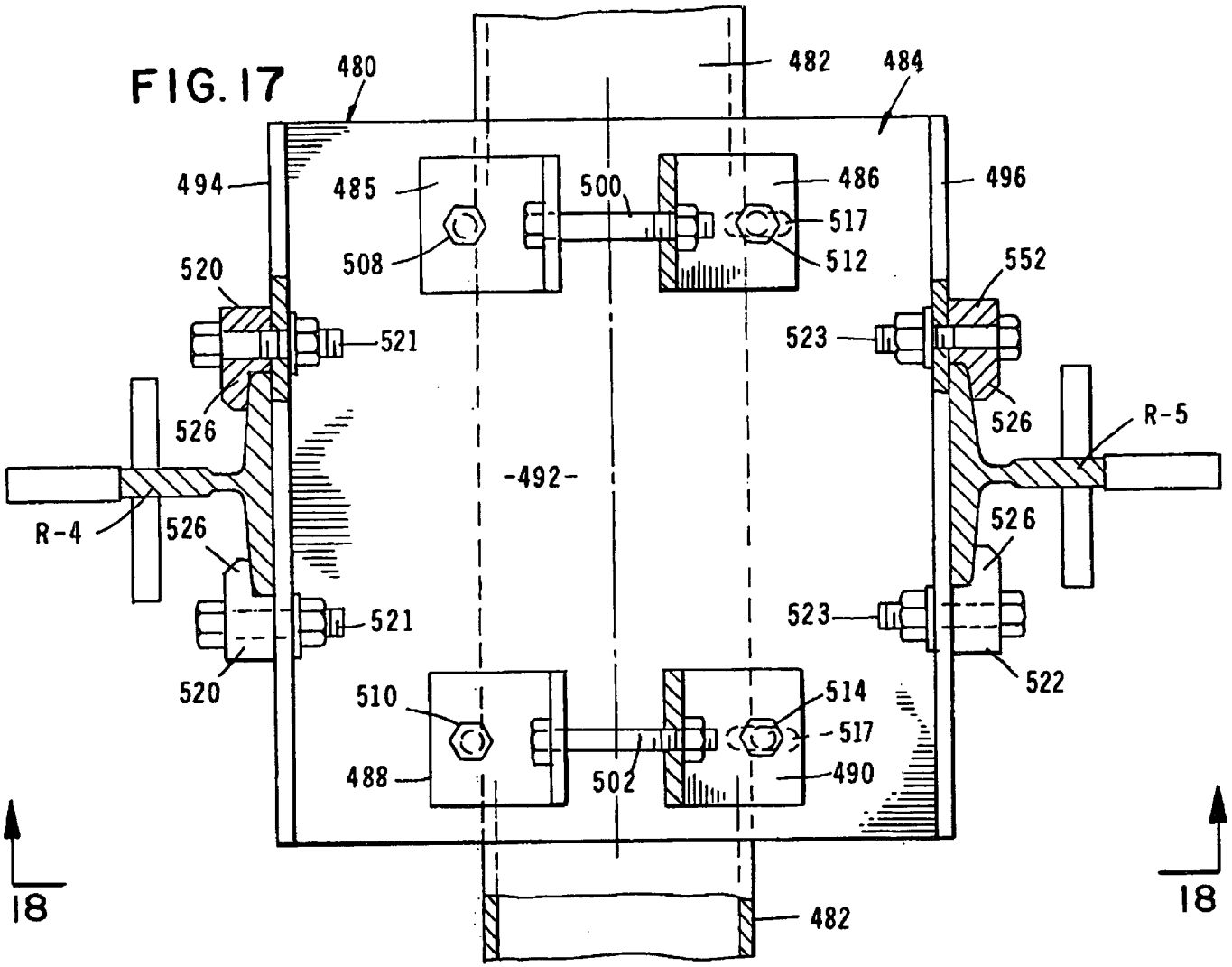
FIG. 17 is a plan view of an alternate form of connector apparatus of the invention for connecting elevator guide rails to a horizontally extending beam.

Turning next to FIGS. 17, 18 and 19, these drawings more fully illustrate the form of the connector apparatus of the invention shown in portion E of FIG. 1B. This apparatus, which is generally designated by the numeral 480, functions to interconnect rails R-4 and R-5 with a horizontally extending beam 482. The apparatus here comprises a bracket in the form of a generally "U"-shaped member 484 (FIG. 18) and first, second, third and fourth angle brackets 485, 486, 488 and 490 that are connected to the bight portion 492 thereof (FIG. 19). In addition to the generally planar bight portion 492, member 484 has first and second upstanding legs or side portions 494 and 496 that extend generally perpendicular to bight portion 492.

As best seen in FIG. 17, spaced-apart brackets 485 and 486 are connected by a tie bolt 500, while spaced-apart brackets 488 and 490 are connected by a tie bolt 502. Disposed closely adjacent to one side of beam 482 and interconnecting first and third brackets 485 and 488 with a pair of capture plates 506 (FIG. 19) are spaced-apart tie bolts 508 and 510 respectively. In similar fashion, tie bolts 512 and 514, that are also disposed closely adjacent the opposite side of beam 482, function to interconnect second and fourth angle brackets 486 and 490 with spaced-apart capture plates 506.

As shown in FIG. 17, the underside of U shaped member 484 and the upper sides capture plates 506 are held in secure engagement with beam 482 by the four tie bolts 508, 510, 512, and 514. As is also shown in FIG. 17, slots 517 formed in angle brackets 484 permit transverse movement of the U-shaped member 484 relative to beam 482. In this latest form of the invention, angle brackets 485, 486, 488 and 490, along with capture plates 506 and tie bolts 500, 502, 508, 510, 512 and 514 comprise the beam interconnection means of the invention for interconnecting connector bracket 484 with beam 482.

Also forming a part of the connector apparatus of this latest form of the invention are connector means for interconnecting guide rails R-4 and R-5 of the elevator system to legs 494 and 496 of U shaped member 484. This connector means here comprises a pair of spaced apart connector clips 520 that are connected to first leg 494 of U shaped member 484 by bolts 521 and a pair of spaced apart connector clips 522 that are connected to the second leg 496 of U shaped member 484 by bolts 523. As best seen in FIG. 17, each of the connector clips has a rail engagement leg 526 that is adapted to clampingly engage the legs of the guide rails in the manner shown in FIG. 17.

Figure 22:
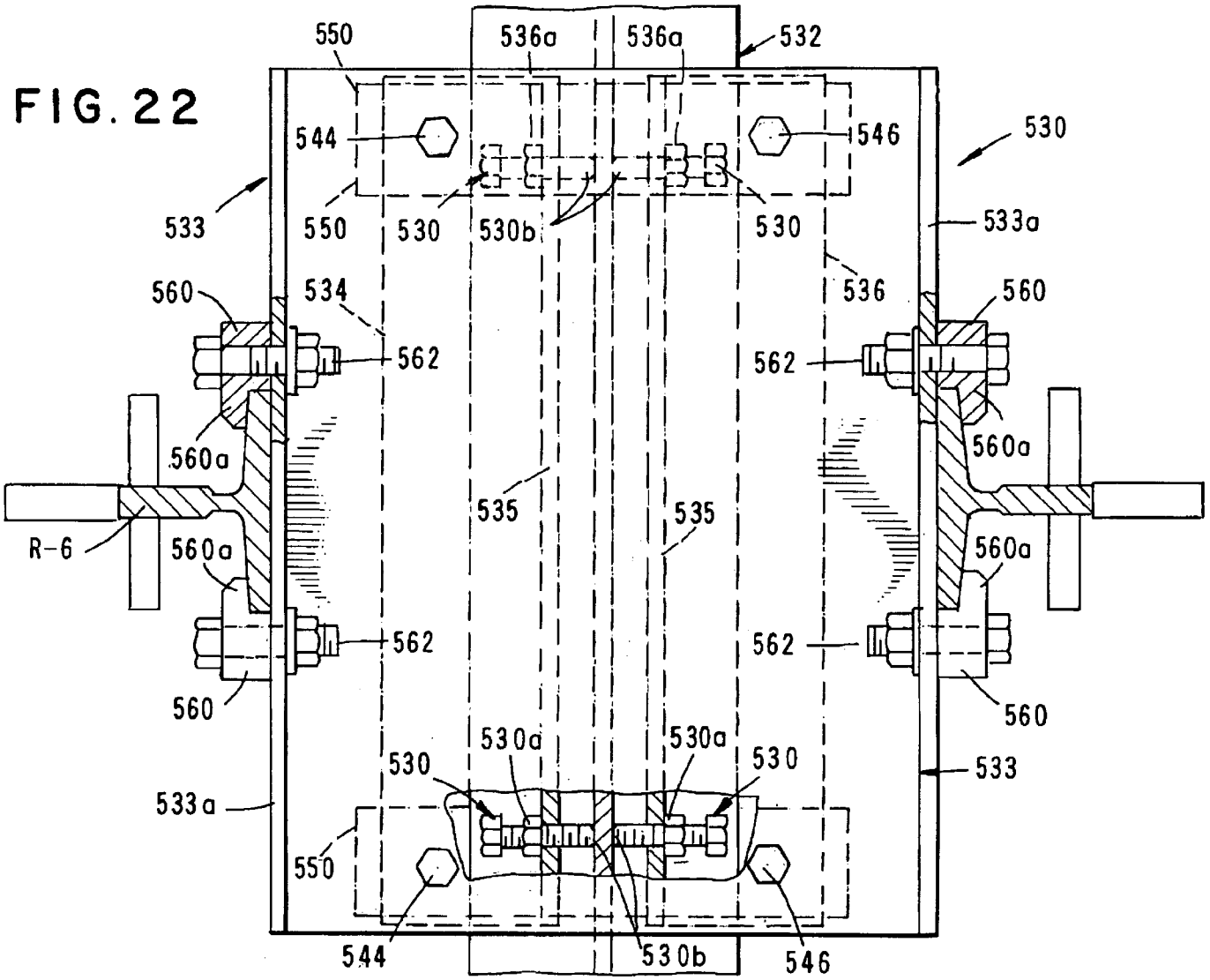
FIG. 22 is a cross-sectional view taken along lines 22—22 of FIG. 20.

Referring next to FIGS. 20, 21 and 22 another form of the connector apparatus of the invention is there shown and generally designated by the numeral 530. This apparatus, which functions to interconnect rails R-6 and R-7 with a horizontally extending "I" beam 532, comprises an upper U-shaped member 533, a pair of generally U-shaped members 534 and 536 that are connected to U-shaped member 533 and four pair of jackbolts 530 that are interconnected with the bight portions 535 of the U-shaped members 534 and 536. As best seen in FIG. 20, U-shaped member 534 is disposed on one side of the I beam while U-shaped members 536 is disposed on the opposite side of the I beam.

As shown in FIGS. 20 and 22, each of the legs of the U-shaped bracket 534 is provided with a pair of longitudinally spaced apertures 541 that receive a pair of tie bolts 544. Similarly, each of the legs of U-shaped brackets 536 is provided with a pair of longitudinally spaced apertures 543 that receive a pair of tie bolts 546. Tie bolts 544 extend through a pair of spaced apart apertures 547 provided in U-shaped member 533, through apertures 541 provided in the legs of U-shaped member 534 and through apertures 549. provided in a pair of capture plates 550 (FIG. 22). Similarly, tie bolts 546 extend through a pair of spaced apart apertures 553 provided in this U-shaped member 533, through apertures 543 provided in the legs of U-shaped member 536 and through apertures 555 provided in capture plates 550 (FIGS. 21 and 22). With the construction thus described and as illustrated in the drawings, tie bolts 544 and 546, which comprise the connector means of the invention, function to maintain U-shaped member 533 in engagement with the top surface of the "I" beam, function to maintain capture plates 550 in engagement with the bottom surface of the I beam and function to maintain U-shaped members 534 and 536 at locations intermediate U-shaped member 533 and capture plates 550.

Jackbolts 530 are threadably received within adjustment nuts 530*a* that are connected to each of the jackbolts. Adjustment nuts 530*a* bear upon the outer surfaces of the bight portions of U-shaped members 534 and 536 so that, when the jackbolts are threaded inwardly and outwardly with respect to nuts 530*a*, the extremities by 530*b* of the jackbolts can be moved into and out of pressural engagement with the central web of the "I" beam, thereby permitting adjustment of the assemblage relative to rails R-6 and R-7 as indicated by the arrows 557 in FIG. 20. In this latest form of the invention, U shaped members 534 and 536, along with jackbolts 530 and tie bolts 544 and 546 comprise the beam interconnection means of the invention for interconnecting connector bracket 533 with I beam 532.

Also forming a part of the connector apparatus of this latest form of the invention are connector means for interconnecting guide rails R-6 and R7 of the elevator system to legs 533*a* of U shaped member 533. This connector means here comprises a pair of spaced apart connector clips 560 that are connected to each of the legs 533*a* of U shaped member 533 by bolts 562. As best seen in FIG. 22, each of the connector clips has a rail engagement leg 560*a* that is adapted to clampingly engage the legs of the guide rails in the manner shown in FIG. 22.

Figure 23:
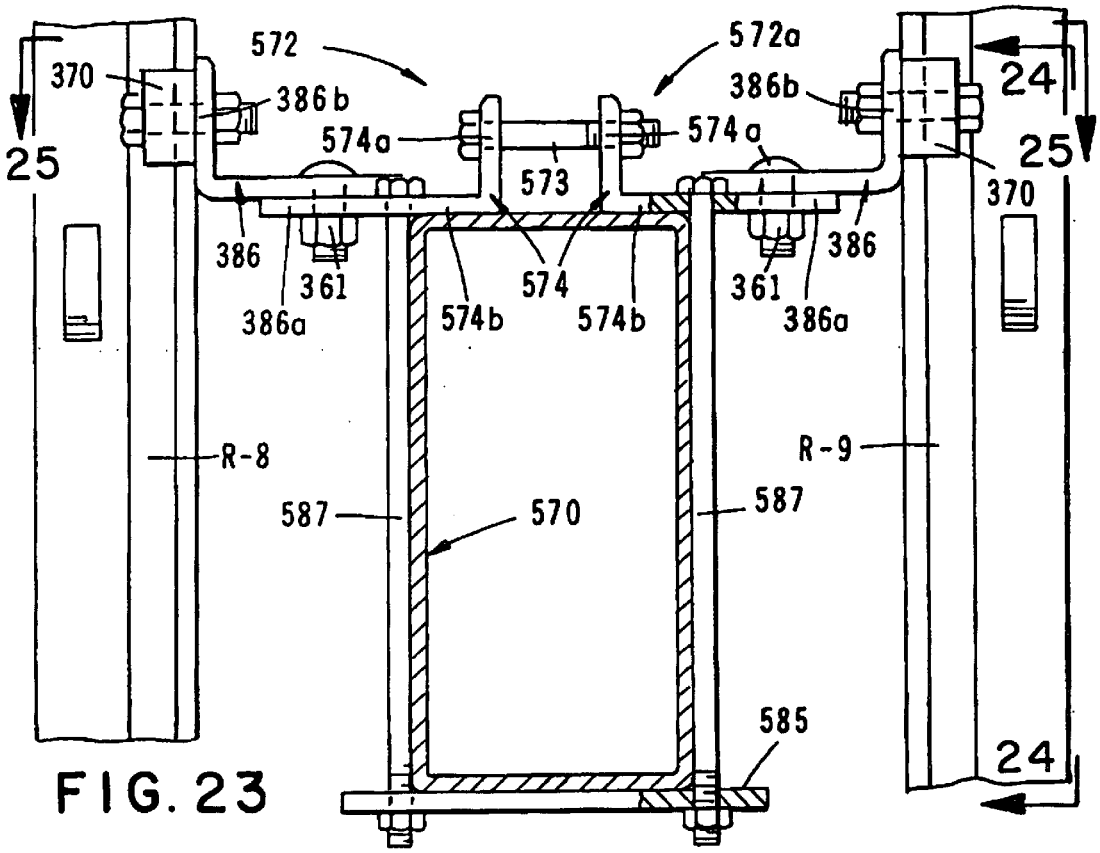
FIG. 23 is a greatly enlarged front view of yet another form of elevator rail support system of the character shown in the lower central portion shown in FIG. 1B in which the elevator support rails are adjustably connected to a hollow vertical support beam by means of a differently configured bracket arrangement.
Figure 24:
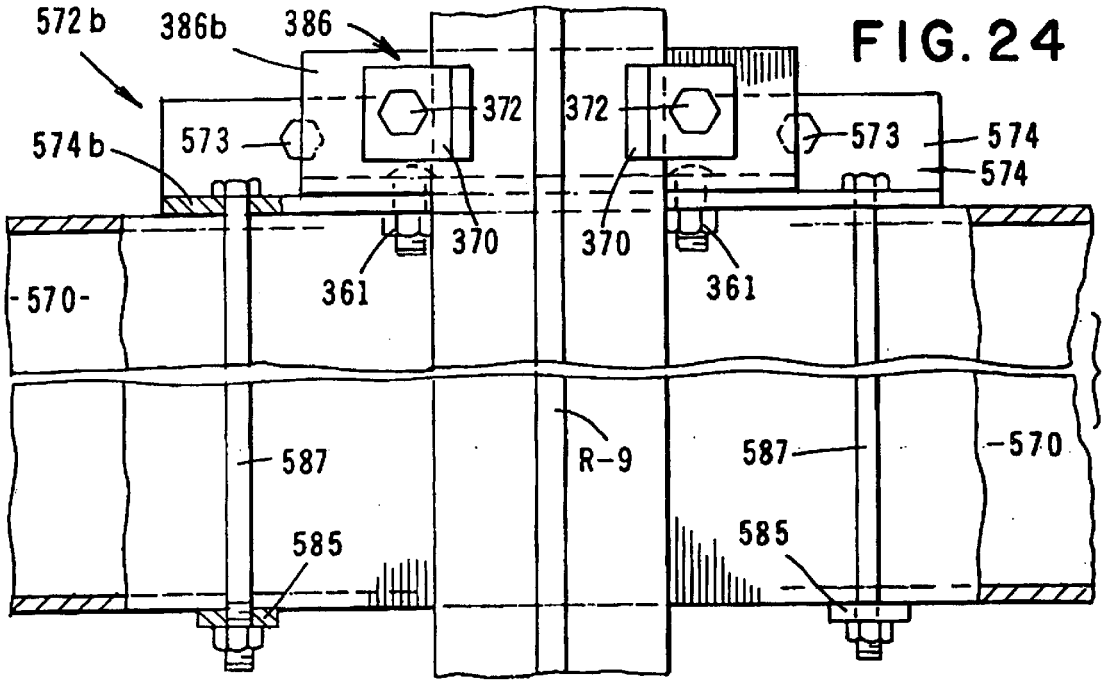
FIG. 24 is a cross-sectional view taken along lines 24—24 of FIG. 23.
Figure 25:
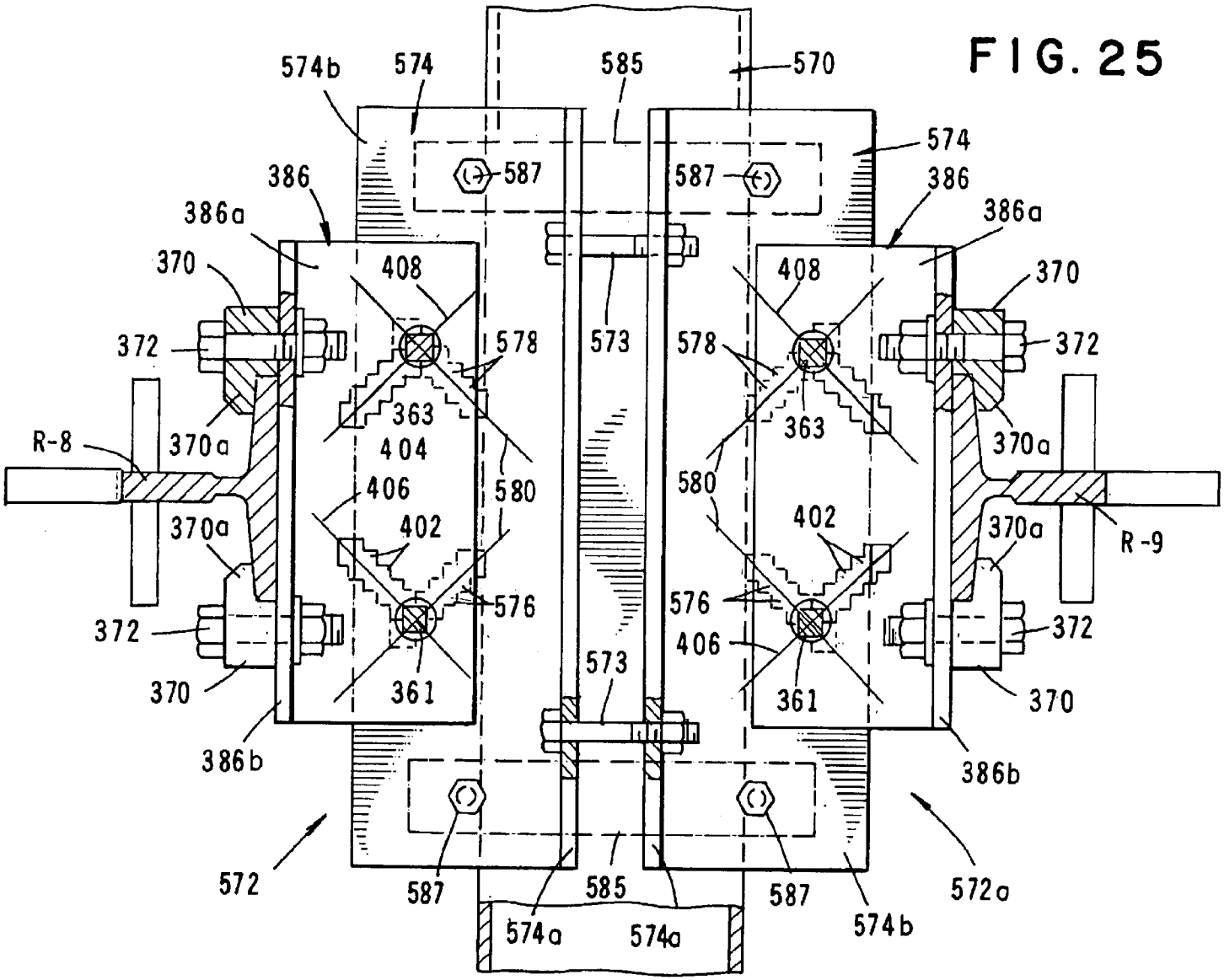
FIG. 25 is a cross-sectional view taken along lines 25—25 of FIG. 23.

Considering now the embodiment of the invention shown in FIGS. 23, 24 and 25, this embodiment is similar in many respects to that shown in FIGS. 14, 15 and 16 and like numbers are used to identify like components. This latest embodiment comprises a connector apparatus for interconnecting the guide rails R-8 and R-9 of an elevator system with a horizontally extending beam 570 that is generally rectangular in cross section. As best seen in FIG. 25, this connector apparatus comprises two identical connector assemblies 572 and 572*a* that are interconnected by a pair of tie bolts 573 (FIG. 25).

As shown in FIG. 25, each of the connector assemblies 572 and 572*a* of this latest form of the invention comprises a first connector bracket 574 and a second connector bracket 386 that is adjustably connected to first bracket 574 and is substantially identical to connector bracket 386 of FIG. 16. Second leg 574*b* of each bracket 574, which leg extends generally perpendicularly to leg 574*a* and accepts tie bolts 573, is provided with first and second sets of through holes 576 and 578, the purpose of which will presently be described. Holes 576 are disposed along the line 580 that extends angularly with respect to first leg 574*a* of connector bracket 574. Similarly, through holes 578 are disposed along a line 580 that extends angularly with respect to first leg 574*a* of connector bracket 574. Each of the through holes 576 and 578 are generally rectangular in plan and are of a size and shape to closely receive the square shank portion of threaded connector bolts which, in a manner presently to be described, are used to interconnect a second connector bracket 386 with bracket 574.

Second connector brackets 386, which function to adjustably support rails R-8 and R-9, are adjustably interconnected with first connector brackets 574 in a manner now to be described. As before, leg 386*a* of each connector bracket 386 is provided with first and second sets of through holes 402 and 404. Holes 402 are disposed along the line 406 that extends angularly with respect to second leg 386*b* of connector bracket 386 and also angularly with respect to line 580. Similarly, through holes 404 are disposed along a line 408 that extends angularly with respect to leg 386*b* of connector bracket 386 and also angularly with respect to line 580. Each of the through holes 402 and 404 of brackets 382 and 382*a* are also generally rectangular in plan and are of a size and shape to closely receive the square shank portion of the threaded connector bolts.

Through holes 402 formed in brackets 386 are so constructed and arranged that a selected one of the through holes 402 can be moved into index with a selected one of the through holes 576 formed in brackets 574 by a sliding movement of the brackets 386 relative to the brackets 574. Similarly, through holes 404 formed in brackets 386 are constructed and arranged so that a selected one of the through holes 404 can be moved into index with a selected one of the through holes 578 formed in brackets 574 when brackets 386 are moved from a first position to a second position relative to brackets 574. More particularly, brackets 386 can be slidably moved relative to brackets 574 in a first direction generally parallel with legs 574*a* of brackets 574 or, alternatively, can be slidably moved in a second direction generally perpendicular to legs 574*a* of brackets 574. In this latest form of the invention, capture plates 585, along with tie bolts 587 and 573 comprise the beam interconnection means of the invention for interconnecting connector brackets 574 with beam 570.

Also forming a part of the connector apparatus of this latest form of the invention are connector means for interconnecting guide rails R-8 and R-9 of the elevator system to legs 386*b* of brackets 386. This connector means here comprises a pair of spaced apart connector clips 370 that are connected to each of the legs 386*b* by bolts 372. As best seen in FIG. 25, each of the connector clips has rail engagement legs 370*a* that are adapted to clampingly engage the legs of the guide rails in the manner shown in FIG. 25. As best seen in FIG. 24, brackets 574 are connected to a pair of capture plates 585 that extend beneath beam 570 by four spaced apart tie bolts 587 that are disposed closely adjacent to the sides of beam 570. As indicated in FIG. 24, the undersides of brackets 574 and the upper sides of capture plates 585 are held in secure engagement with beam 482 by the four tie bolts. As previously mentioned, assemblages 572 and 572*a* are connected together in the manner best seen in FIGS. 23 and 25 by tie bolts 573.

It is to be understood that when the apparatus of this latest form of the invention is appropriately installed within the elevator hoistway, the various degrees of adjustment available to the installer permit the installer to precisely locate the guide rails R-8 and R-9 in an optimum position relative to the involved elevator cars.

Figure 26:
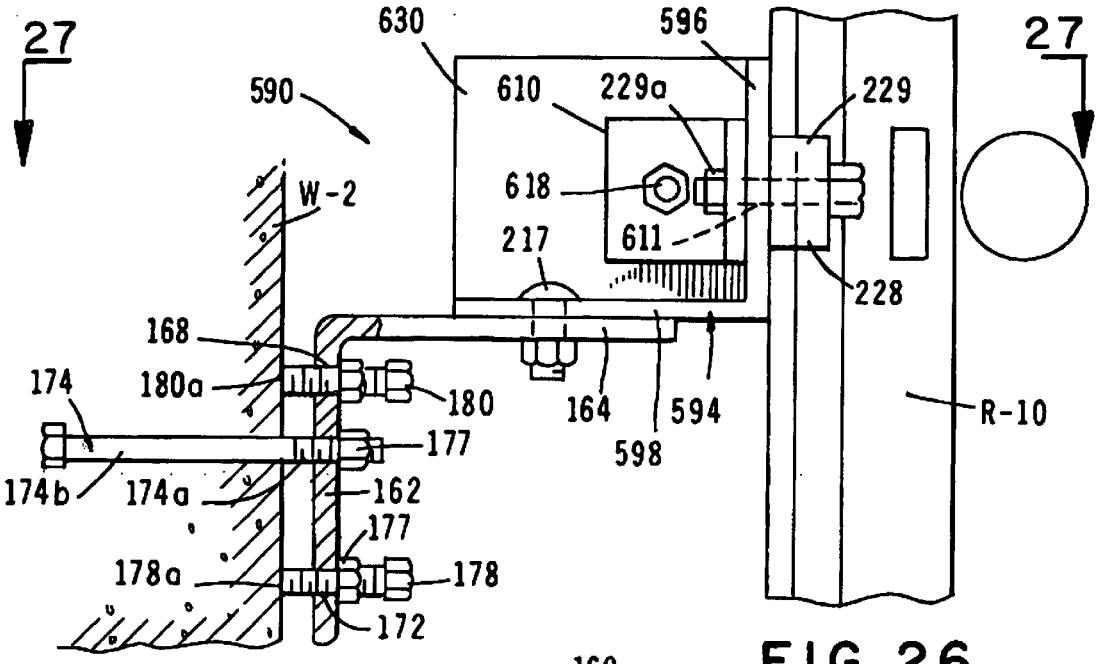
FIG. 26 is a front view of still another form of an elevator car rail support system of the invention.
Figure 27:
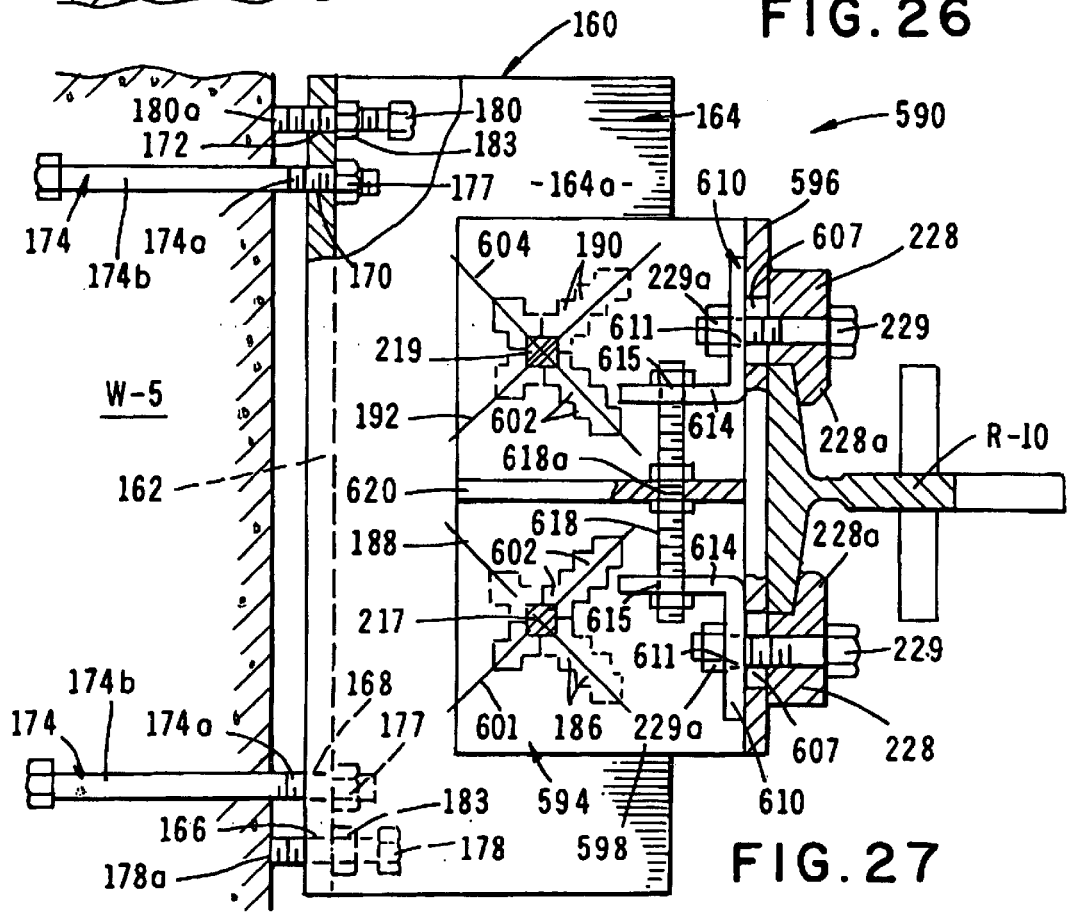
FIG. 27 is a cross-sectional view taken along lines 27—27 of FIG. 26.

Considering now the embodiment of the invention shown in FIGS. 26 and 27, this embodiment is similar in many respects to that shown in FIGS. 8 and 9 and like numbers are used to identify like components. This latest embodiment comprises a connector apparatus for interconnecting the guide rail R-10 of an elevator system with a wall W-5 of the building structure that houses the elevator system. As best seen in FIG. 27, the connector assembly 590 of this latest form of the invention comprises a first connector bracket 160 that is substantially identical to bracket 160 of FIG. 9 and includes a first generally planar first leg 162 that is adjustably connected to the supporting structure W-5 in the manner described in connection with the embodiment of FIG. 9.

Second leg 164 of bracket 160 is provided with a first set of through holes 186 and a spaced apart second set of first through holes 190. Adjustably interconnected with first connector bracket 160 is a second connector bracket 594. Second bracket 594 has a first leg 596 and a second leg 598 that extends generally perpendicular to first leg 596. Second bracket 594 is also provided with a first set of through holes 600 that are disposed along a first line 601 that extends at an angle with respect to first leg 596. Similarly, leg 598 is provided with another set of through holes 602 that are disposed along a line 604 that extends at an angle with respect to first leg 596. As in the embodiment of FIG. 9, through holes 600 formed in bracket 594 are so constructed and arranged that a selected one of the through holes 600 can be moved into index with a selected one of the through holes 186 formed in bracket 160 by a sliding movement of bracket 594 relative to bracket 160. Similarly, through holes 602 formed in bracket 594 are constructed and arranged so that a selected one of the through holes 602 can be moved into index with a selected one of the through holes 190 formed in bracket 160 when bracket 594 is slidably moved from a first position to a second position relative to bracket 160. More particularly, bracket 594 can be slidably moved relative to bracket 160 in a first direction generally parallel with leg 162 of bracket 160 or, alternatively, can be slidably moved in a second direction generally perpendicular to leg 162 of bracket 160.

When second connector bracket 594 is correctly aligned with first connector bracket 160 and when the selected though holes in the brackets are indexably aligned, the brackets can be interconnected using bolts 217 and 219 in the manner described in connection with the embodiment of FIG. 9.

As in the earlier described embodiment, the connector apparatus of this latest form of the invention includes connector means for connecting the guide rail R-10 of the elevator system to first leg 596 of second bracket 594 in the manner illustrated in FIGS. 26 and 27. In this latest form of the invention, the connector means is somewhat different from that shown in FIGS. 8 and 9, but again comprises first and second spaced-apart connector clips 228 that are adjustably connected to first leg of connector bracket 594 by threaded bolts 229. As before, each connector clip 228 has a rail engagement leg 228*a* that is adapted to clampingly engage the legs of the guide rail R-10.

Bolts 229 extend through slots 607 provided in leg 596 of bracket 594 and also extend through apertures 611 provided in a pair of angle brackets 610 that are connected to bracket 594 by the bolts 229 and nuts 229*a* in the manner best seen in FIG. 27. Brackets 610 include an outwardly extending leg 614 that is provided with an aperture 615 that accept threaded jackbolts 618. Bracket 594 has a central upstanding wall 620 that is engaged by the ends 618*a* of each of the jackbolts 618. With this construction, it is apparent that by threading the jackbolts inwardly and outwardly relative to wall 620, the position of angle brackets 610 along with clips 228 can be moved to further accommodate any misalignment of rail R-10.

Figure 3:
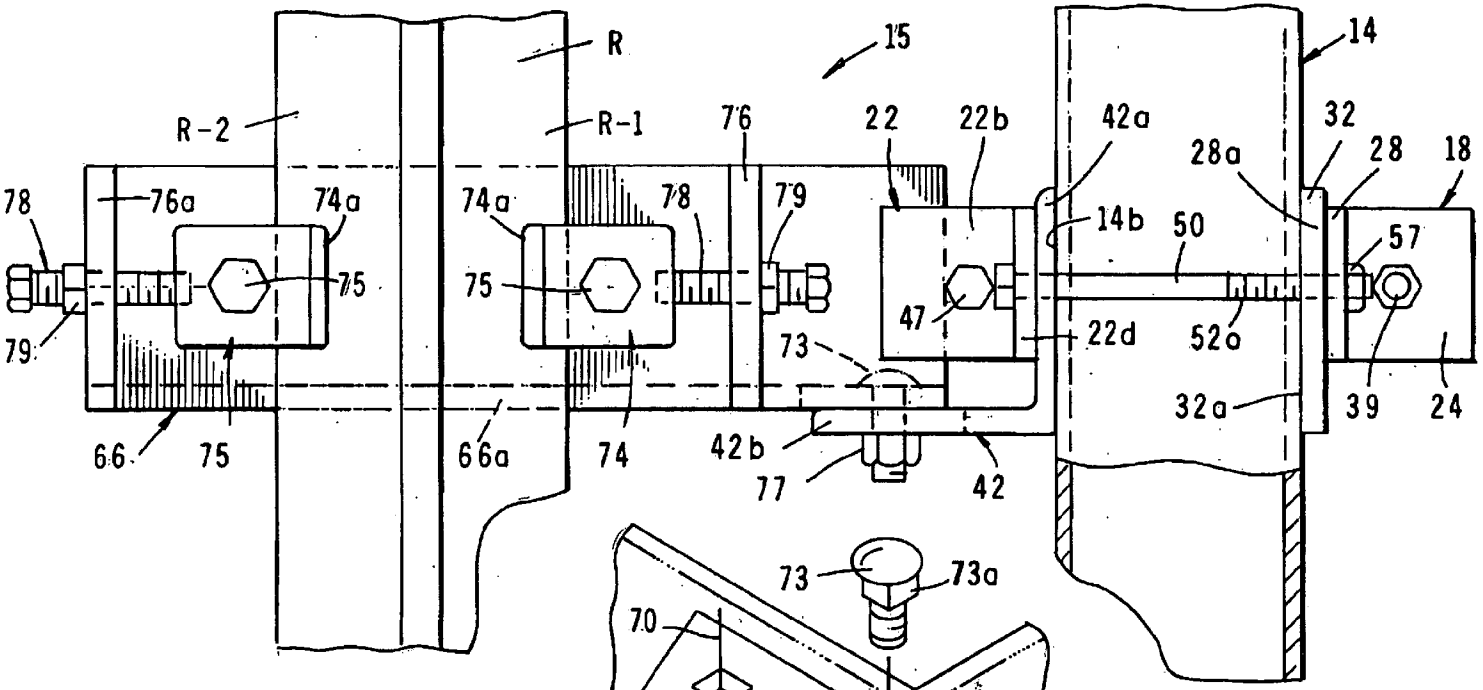
FIG. 3 is a view taken along lines 3—3 of FIG. 2.
Figure 28:
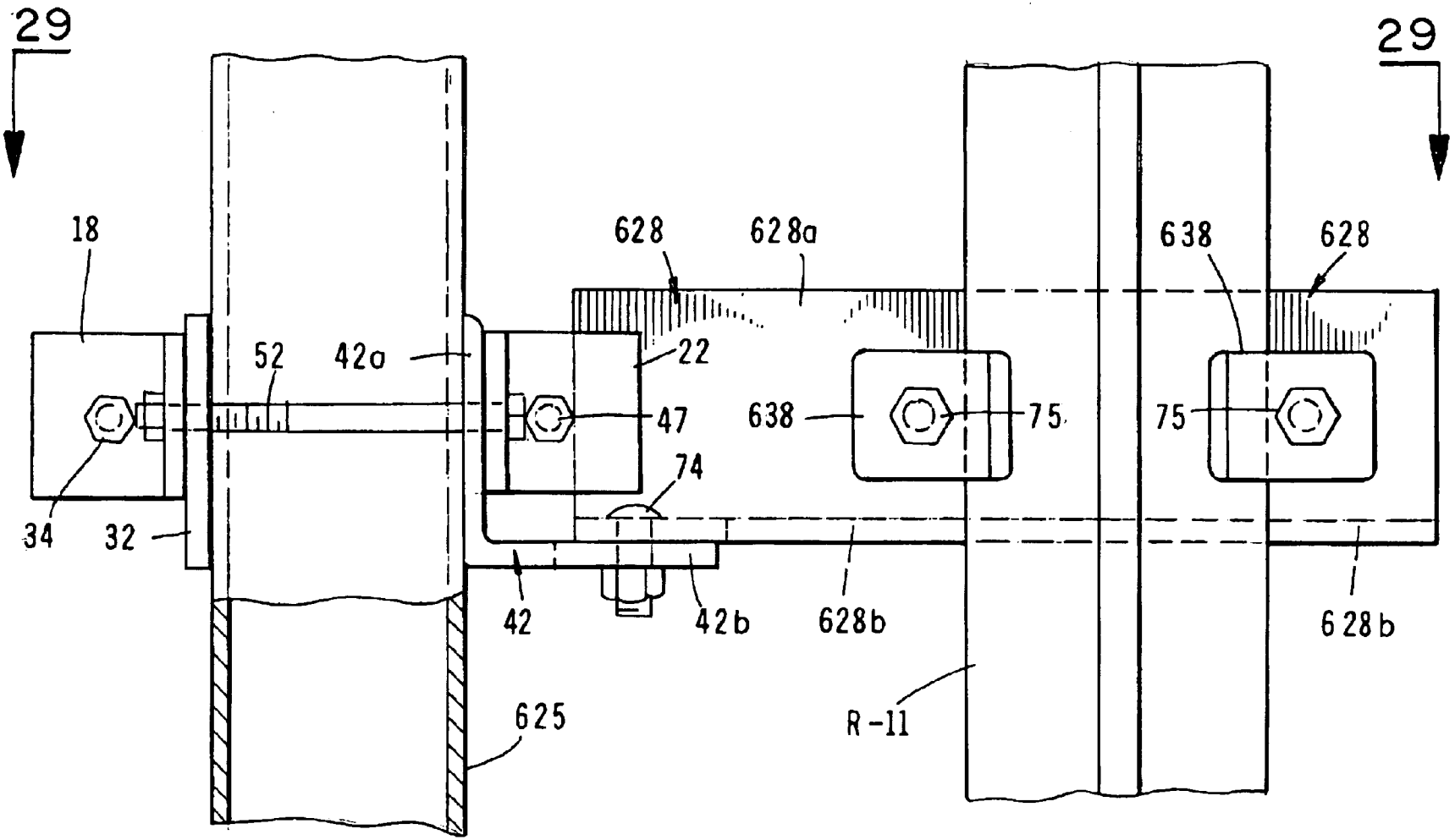
FIG. 28 is a top plan view of yet another form of an elevator support system of the invention.
Figure 29:
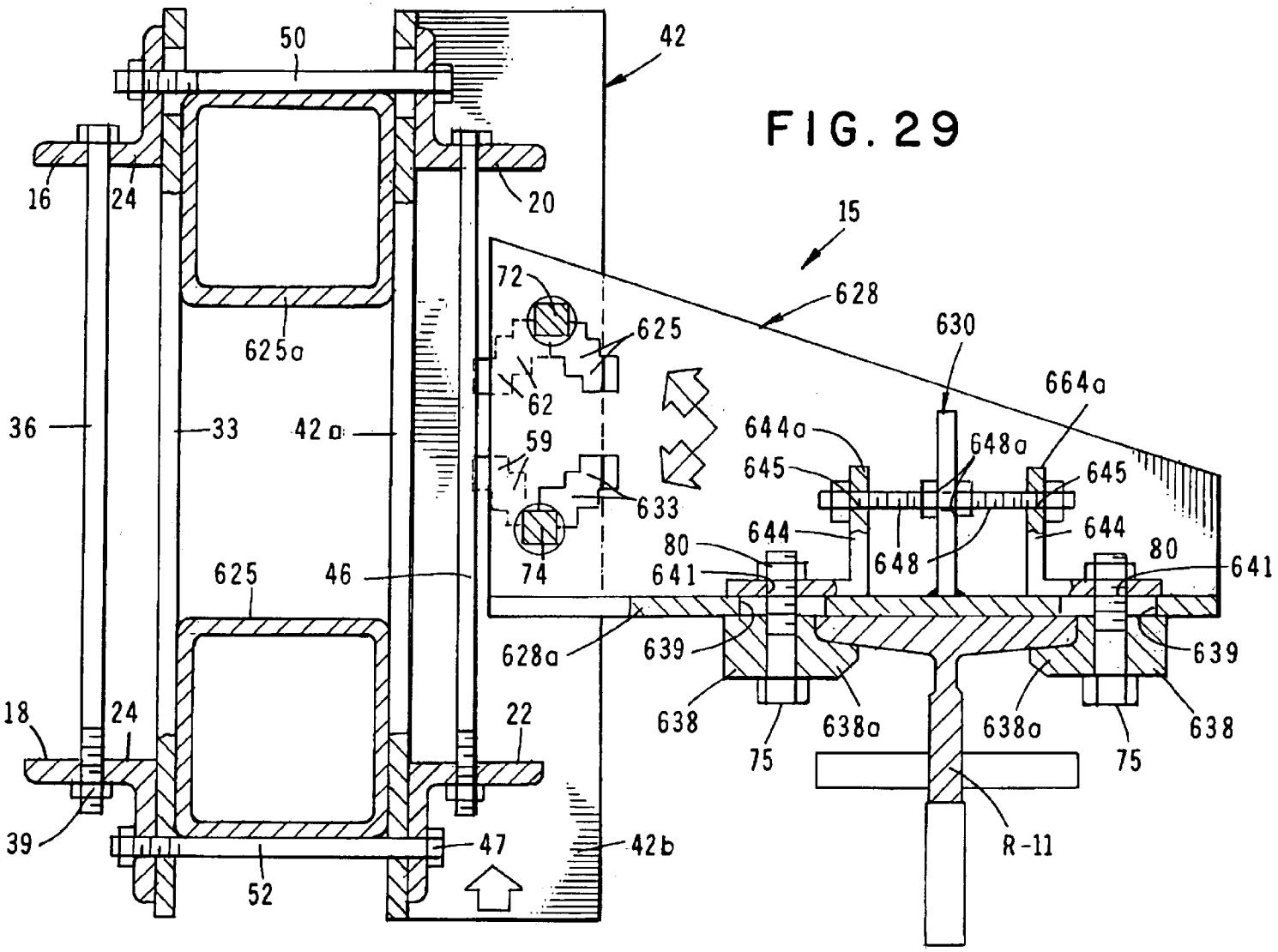
FIG. 29 is a cross-sectional view taken along lines 29—29 of FIG. 28.

Turning finally to FIGS. 28 and 29, the embodiment there shown is similar in many respects to that shown in FIGS. 2, 3 and 4 and like numbers are used to identify like components. The basic difference between this latest embodiment and that shown in FIGS. 2, 3 and 4 resides in the provision of a slightly different rail connector means for supporting rail R-11. This latest embodiment comprises a connector assembly 15 that function to interconnect guide rail R-11 with two pair of vertically extending beams generally designated in the drawings by the numerals 625 and 625*a*.

As shown in FIG. 29, connector assembly 15 of this form of the invention, like that shown in FIG. 2, comprises first, second, third, and fourth spaced-apart right angle brackets 16, 18, 20, and 22 respectively that function to interconnect a bracket 628 with columns 625 and 625*a* in the manner described in connection with the connection of bracket 66 to the columns in the embodiment of FIG. 2. Bracket 628 is identical to bracket 66 save that bracket 628 does not have end walls 76, but does have a central, outwardly extending wall 630 that is connected to leg 628*a* of bracket 628. The purpose of this central wall will presently be described.

As best seen in FIG. 29, connector bracket 42 of this latest embodiment has a second leg 42*b* that extends generally perpendicularly to leg 42*a*. Formed within second leg 42*b* of connector bracket 42 are first and second sets of through holes 59 and 61 that are adapted to index with first and second sets of through holes 633 and 635 formed in leg 628*b* of bracket 628. More particularly, as in the embodiment of FIG. 2, through holes 633 formed in bracket 628 are so constructed and arranged that a selected one of the through holes 633 can be moved into index with a selected one of the through holes 59 formed in bracket 42 by a sliding movement of bracket 42 relative to bracket 628. Similarly, through holes 635 formed in bracket 628 are constructed and arranged so that a selected one of the through holes 635 can be moved into index with a selected one of the through holes 61 formed in bracket 42 when bracket 628 is slidably moved from a first position to a second position relative to bracket 42. More particularly, bracket 628 can be slidably moved relative to bracket 42 in a first direction generally parallel with leg 42*a* of bracket 42 or, alternatively, can be slidably moved in a second direction generally perpendicular to leg 42*a* of bracket 42. When second connector bracket 628 is correctly aligned with first connector bracket 42 and when the selected though holes in the brackets are indexably aligned, the brackets can be interconnected using bolts 72 and 74 in the manner described in connection with the embodiment of FIG. 2. In this latest form of the invention, angle brackets 16, 18, 20 and 22, along with spanner plate 32, comprise the interconnection means of the invention for interconnecting first connector bracket 42 with beams 625 and 625*a*.

Also forming a part of the connector apparatus of the form of the invention shown in FIGS. 28 and 29 are connector means for interconnecting guide rail R-11 to leg 628*a* of second connector bracket 628. In this latest form of the invention, this connector means comprises a pair of spaced apart connector clips 638 that are adjustably connected to leg 628*a* of connector bracket 628 by threaded bolts 75. Each connector clip 638 has a rail engagement leg 638*a* that is adapted to clampingly engage the legs of the guide rail R-11.

Bolts 75 extend through slots 639 provided in leg 628*a* of bracket 628 and also extend through apertures 641 provided in a pair of angle brackets 644 that are connected to bracket 628 by the bolts 75 and nuts 80 in the manner best seen in FIG. 29. Brackets 644 include an outwardly extending leg 644*a*, each if which is provided with an aperture 645 that accepts a threaded jackbolt 648. The ends 648*a* of each of the jackbolts engage earlier identified central wall 630 so that by threading the jackbolts inwardly and outwardly relative to wall 630, the position of angle brackets 644 along with clips 638 can be adjusted to further accommodate any misalignment of rail R-11.

As in the earlier described embodiments, when the apparatus of this latest form of the invention is appropriately installed within the elevator hoist the various degrees of adjustment available to the installer permit the installer to precisely locate guide rail R-11 in an optimum position relative to the involved elevator cars.

Figure 32:
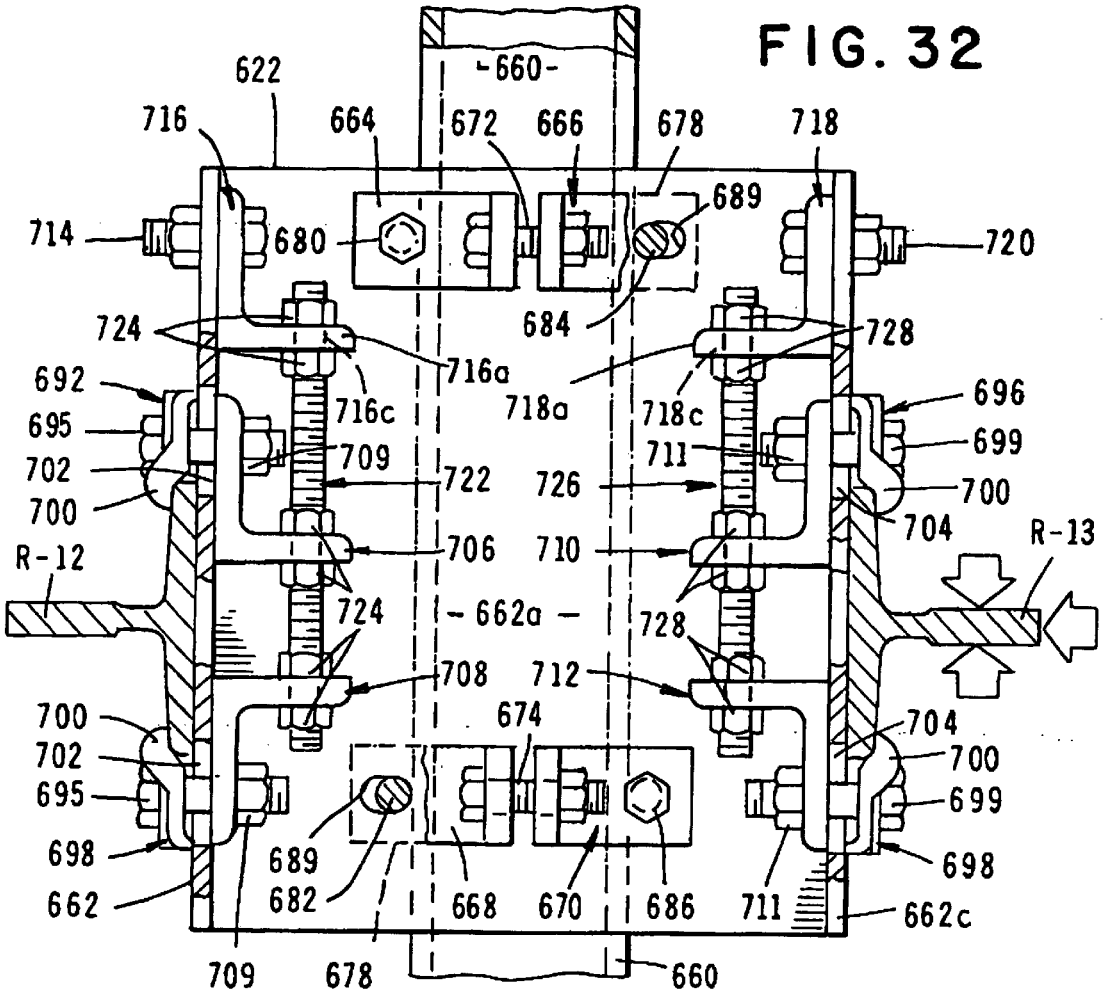
FIG. 32 is a cross-sectional view taken along lines 32—32 of FIG. 30.

Considering now the embodiment of the invention shown in FIGS. 30, 31, 32 and 33, this embodiment is similar in some respects to that shown in FIGS. 17, 18 and 19. This latest embodiment comprises a connector apparatus for interconnecting the guide rails R-12 and R-13 of an elevator system with a horizontally extending beam 660 that is generally rectangular in cross section. As best seen in FIG. 32, this connector apparatus comprises a generally "U" shaped member 662 (FIG. 33) and four angle brackets 664, 666, 668 and 670 that are connected to the bight portion 662*a* thereof (FIG. 32). In addition to bight portion 662*a*, member 662 has two upstanding side portions 662*b* and 662*c*.

As best seen in FIG. 32, brackets 664 and 666 are connected by a tie bolt 672, while brackets 668 and 670 are connected by a tie bolt 674. Disposed closely adjacent to one side of beam 660 and interconnecting first and third brackets 664 and 668 with a pair of capture plates 678 (FIG. 32) are spaced-apart tie bolts 680 and 682 respectively. In similar fashion, tie bolts 684 and 686, that are also disposed closely adjacent the opposite side of beam 660, function to interconnect second and fourth angle brackets 666 and 670 with capture plates 678.

As shown in FIG. 30, the underside of U-shaped member 662 and the upper sides capture plates 678 are held in secure engagement with beam 660 by the four tie bolts 680, 682, 684 and 686. As is also shown in FIG. 32, slots 689 formed in angle brackets 662 permit transverse movement of the U-shaped member 662 relative to beam 660. In this latest form of the invention, angle brackets 664, 666, 668 and 670, along with capture plates 678 and tie bolts 680, 682, 684, and 686, comprise the beam interconnection means of the invention for interconnecting connector bracket 662 with beam 660.

Also forming a part of the connector apparatus of this latest form of the invention are connector means for interconnecting guide rails R-12 and R-13 of the elevator system to legs 662*b* and 662*c* of U-shaped member 662. This connector means here comprises a pair of spaced apart connector slips 692 and 694 that are connected to first leg 662*b* of U-shaped member 662 by bolts 695 and a pair of spaced-apart connector clips 696 and 698 that are connected to the second leg 662*c* of U-shaped member 662 by bolts 699. As best seen in FIG. 32, each of the connector clips has a rail engagement leg 700 that is adapted to clampingly engage the legs of the guide rails in the manner shown in FIG. 32.

Figure 33:
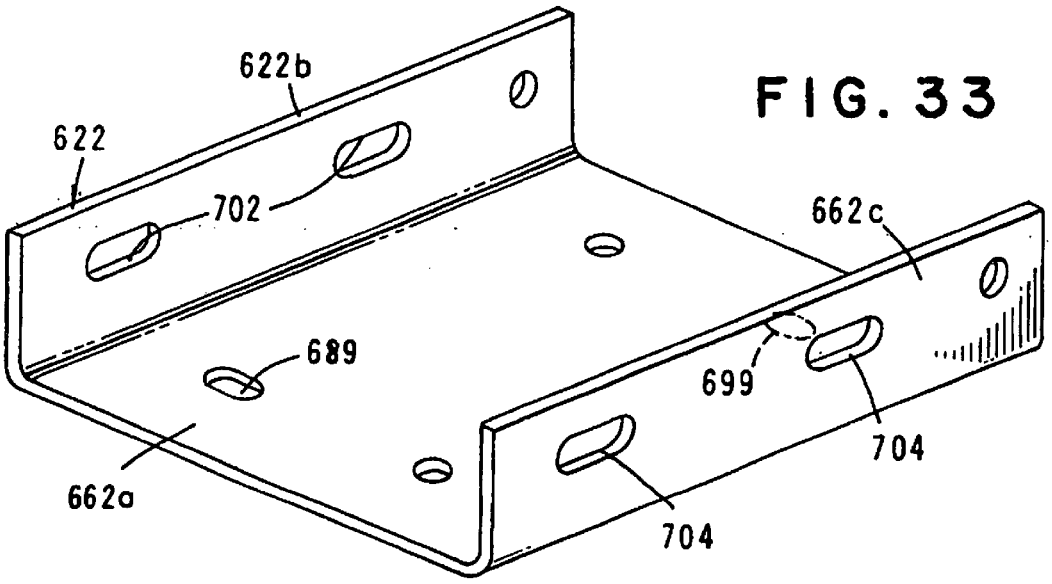
FIG. 33 is a greatly enlarged generally perspective view of the central support member of the connector apparatus shown in FIG. 30.

As best seen in FIG. 33, sidewall 662*b* of U-shaped member 662 is provided with spaced-apart, elongated-bolt-receiving apertures 702 that are adapted to receive connector bolt 695. Similarly, sidewall 662*c* of the U-shaped member is provided with elongated-bolt-receiving apertures 704 for receiving connector bolts 669. Connector bolts 695 also extend through bores provided in one leg of a pair of angle brackets 706 and 708 and along with nuts 709 function to interconnect brackets 706 and 708 with sidewall 662*b*. In like manner connector bolts 699 also extend through bores provided in one leg of a pair of angle brackets 710 and 712 and along with nuts 711 function to interconnect brackets 710 and 712 with sidewall 662*c* of U-shaped member 662.

A novel feature of this latest form of the invention comprises adjustment means for adjusting the position of the connector chips relative to member 662. This adjustment means here comprises a jackbolt supporting bracket 716 that is connected to sidewall 662*b* of U-shaped member 662 by a bolt 714 is a jackbolt supporting bracket 716. Similarly, a jackbolt supporting bracket 718 is connected to sidewall 662*c* by a bolt 720. Leg 716*a* of bracket 716 is provided with a threaded bore 716*c* that is adapted to receive the shank of a threaded jackbolt 722. Angle brackets 706 and 708 are also aperture to receive the shank of jackbolt 722 in the manner shown in FIG. 32. As shown in FIG. 32, jackbolt 722 is threadably received within a series of adjustment nuts 724 that bear upon the surfaces of the outwardly extending legs of brackets 716, 706 and 708 so that, when the jackbolt is threaded inwardly and outwardly with respect to nuts 724, clips 692 and 694 can be adjusted longitudinally of side 662*b* to adjustably position rail R-12. It is apparent that by loosening adjustment nuts 724, bolts 695 along with clips 692 and 694 can be moved toward and away from guide rail R-12 and can be securely locked in position by retightening the locking nuts.

As is shown in FIG. 32, leg 718*a* of bracket 718 is provided with a threaded bore 718*c* that is adapted to receive the shank of a threaded jackbolt 726. Angle brackets 710 and 712 are also aperture to receive the shank of jackbolt 726 in the manner there illustrated. Jackbolt 726 is threadably received within a series of adjustment nuts 728 that bear upon the surfaces of the outwardly extending legs of brackets 718, 710 and 712 so that, when the jackbolt is threaded inwardly and outwardly with respect to nuts 728, clips 696 and 698 can be adjusted longitudinally of side 662*c* to adjustably position rail R-13. It is apparent that by loosening adjustment nuts 728, bolts 699 along with clips 696 and 698 can be moved toward and away from guide rail R-13 and can be securely locked in position by retightening the locking nuts.

It is to be understood that when the apparatus of the invention is installed within the hoistway in the manner shown in FIG. 1A, the various degrees of adjustment available to the installer permits the installer to precisely locate the guide rails R-12 and R-13 in an optimum position to permit smooth and efficient operation of the elevator system.

Figure 34:
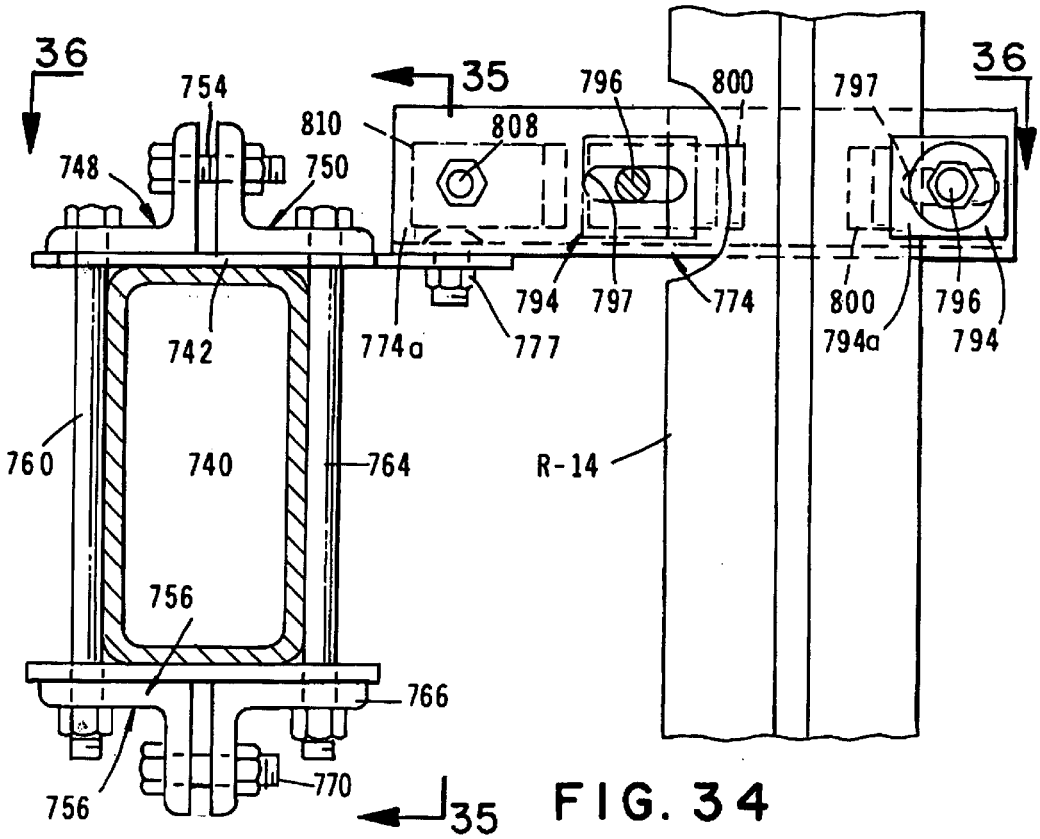
FIG. 34 is a front view of still another form of connector apparatus of the invention for connecting an elevator guide rail to a horizontally extending beam.
Figure 35:
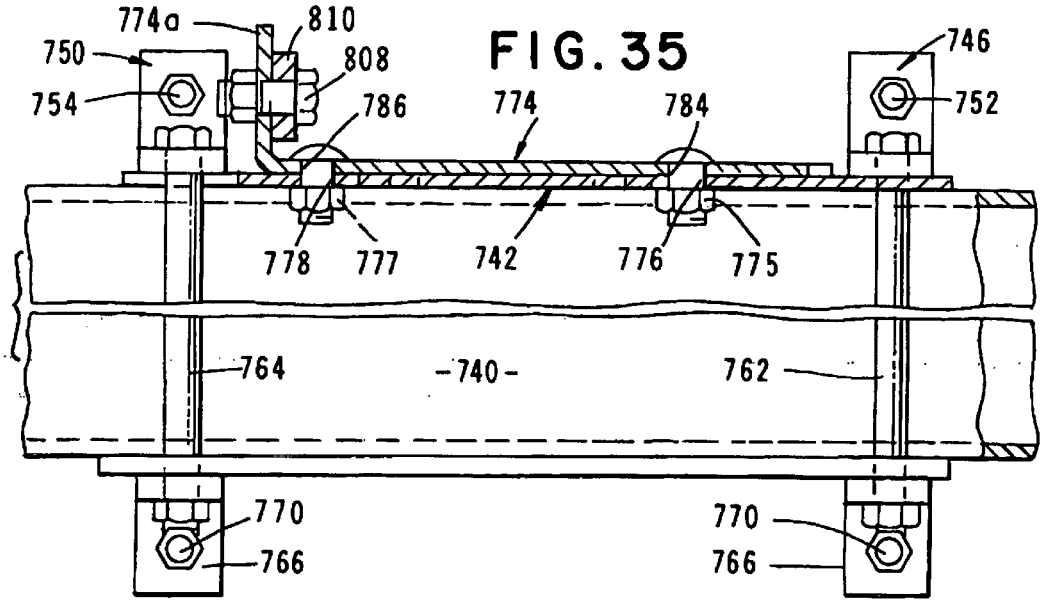
FIG. 35 is a cross-sectional view taken along lines 35—35 of FIG. 34.
Figure 36:
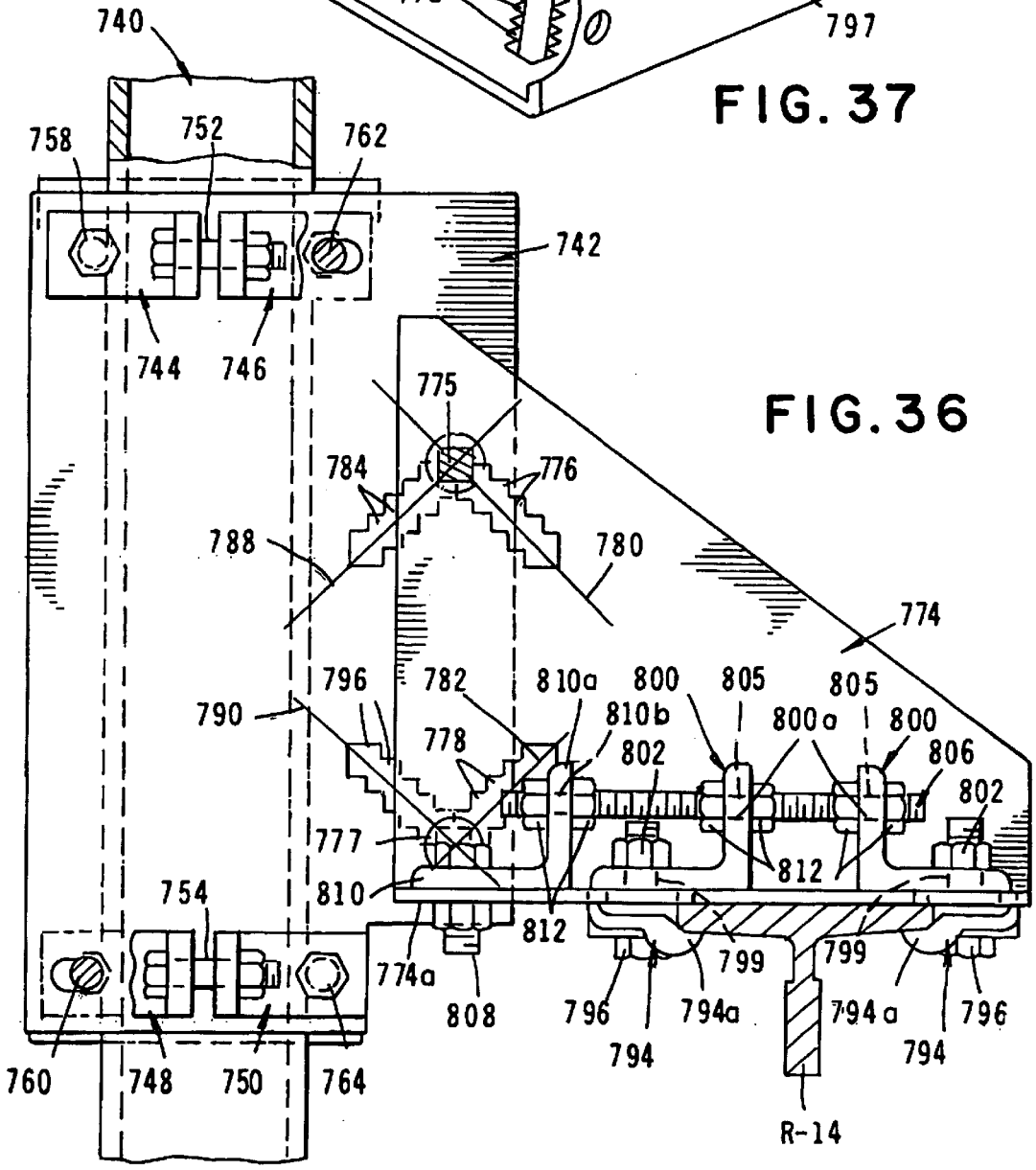
FIG. 36 is a view taken along lines 36—36 of FIG. 34.

Turning next to FIGS. 34, 35, 36 and 37, still another embodiment of the invention is there shown. This embodiment, which is similar in some respects to that shown in FIGS. 28 and 29, comprises a connector apparatus for interconnecting a guide rail R-14 of an elevator system with a horizontally extending beam 740 that is generally rectangular in cross section. As best seen in FIGS. 35 and 36, this connector apparatus comprises a generally rectangularly shaped member 742 (FIG. 36) and four angle brackets 744, 746, 748 and 750 that are connected thereto.

As shown in FIG. 34, brackets 744 and 746 are connected by a tie bolt 752, while brackets 748 and 750 are connected by a tie bolt 754. Disposed closely adjacent to one side of beam 740 and interconnecting first and third brackets 744 and 748 with a pair of angle brackets 756 (FIG. 36) are spaced-apart tie bolts 758 and 760 respectively. In similar fashion, tie bolts 762 and 764, that are also disposed closely adjacent the opposite side of beam 740, function to interconnect second and fourth angle brackets 746 and 750 with angle brackets 766. Brackets 756 and 766 are connected by a tie bolt 770, while brackets 748 and 750 are connected by a tie bolt 754.

As illustrated in FIG. 34, the underside of member 742 and the upper sides of angle brackets 756 and 766 are held in secure engagement with beam 740 by the four tie bolts 758, 760, 762 and 764. Slots formed in the lower angle brackets permit transverse movement of member 742 relative to beam 740. In this latest form of the invention, the upper and lower angle brackets, along with tie bolts 758, 760, 762 and 764, comprise the beam interconnection means of the invention for interconnecting connector member 742 with beam 740.

Figure 37:
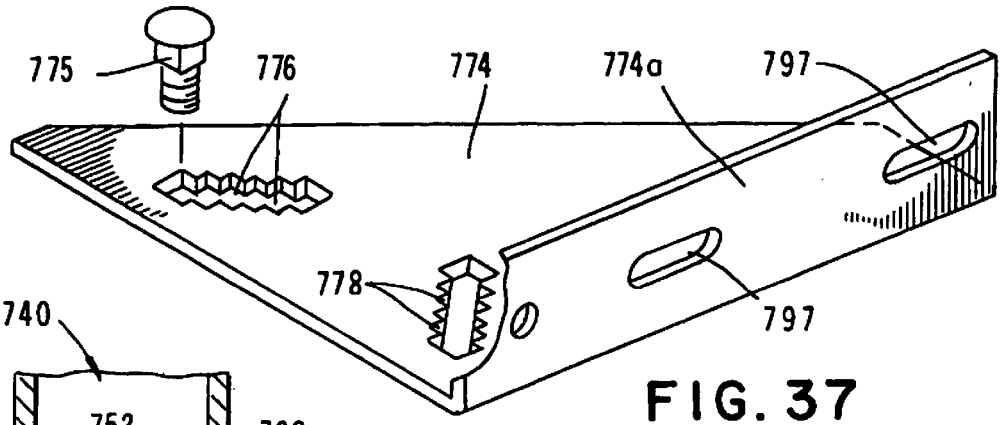
FIG. 37 is an enlarged generally perspective view of the support member of the connector apparatus shown in FIG. 34.

A connector bracket 774 of the configuration shown in FIG. 37 is adjustably connected to connector member 742 by a pair of connector bolts 775 and 777. As best seen in FIG. 36, connector bracket 774 is provided with first and second sets of through holes 776 and 778, the purpose of which will presently be described. Holes 776 are disposed along a line 780 that extends angularly with respect to a connector leg 774*a* formed on connector bracket 774. Similarly, through holes 778 are disposed along a line 782 that extends angularly with respect to connector leg 774*a* of connector bracket 774. Each of the through holes 776 and 778 are generally rectangular in plan and are of a size and shape to closely receive the square shank portion of the threaded connector bolts 775 and 777 which, are used to interconnect connector bracket 774 with member 742.

Connector bracket 774, which function to adjustably support rail R-14 is adjustably interconnected with member 742 in a manner now to be described. As shown in FIG. 36 member 742 is provided with first and second sets of through holes 784 and 786. Holes 784 are disposed along a line 788 that extends angularly with respect to the plane of leg 774*a* of connector bracket 774 and also angularly with respect to line 780. Similarly, through holes 786 are disposed along a line 790 that extends angularly with respect to the plane of leg 774*a* of connector bracket 774 and also angularly with respect to line 782. Each of the through holes 784 and 786 of member 742 are also generally rectangular in plan and are of a size and shape to closely receive the square shank portion of the threaded connector bolts 775 and 777.

In the manner shown in FIG. 36, through holes 776 are adapted to index with through holes 784 and, through holes 778 are adapted to index with through holes 786. More particularly, as in the earlier described embodiments 2, through holes 776 formed in bracket 774 are so constructed and arranged that a selected one of the through holes 776 can be moved into index with a selected one of the through holes 784 formed in member 742 by a sliding movement of bracket 774 relative to member 742. Similarly, through holes 778 formed in bracket 774 are constructed and arranged so that a selected one of the through holes 778 can be moved into index with a selected one of the through holes 786 formed in member 742 when bracket 774 is slidably moved from a first position to a second position relative to member 742. More particularly, bracket 774 can be slidably moved relative to member 742 in a first direction generally parallel with leg 774*a* of bracket 774 or, alternatively, can be slidably moved in a second direction generally perpendicular to leg 774*a* of bracket 774. When connector bracket 774 is correctly aligned with member 742 and when the selected though holes in the components are indexably aligned, the components can be interconnected using bolts 775 and 777 in the manner previously described herein.

Also forming a part of the connector apparatus of the form of the invention shown in FIGS. 34, 35, 36 and 37 are connector means for interconnecting guide rail R-14 to leg 774*a* of connector bracket 774. In this latest form of the invention, this connector means comprises a pair of spaced apart connector clips 794 that are adjustably connected to leg 774*a* of connector bracket 774 by threaded bolts 796. Each connector clip 794 has a rail engagement leg 794*a* that is adapted to clampingly engage the legs of the guide rail R-14.

Bolts 796 extend through slots 797 provided in leg 774*a* of bracket 774 and also extend through apertures 799 provided in a pair of angle brackets 800 that are connected to bracket 774 by the bolts 796 and nuts 802 in the manner best seen in FIG. 36. Brackets 800 include an outwardly extending leg 800*a*, each if which is provided with an aperture 805 that accepts a threaded jackbolt 806.

Also connected to leg 774*a* of bracket 774 by a bolt 808 is a jackbolt supporting bracket 810. Leg 810*a* of bracket 810 is provided with a bore 810*b* that is adapted to receive the shank of a threaded jackbolt 806. As shown in FIG. 36, jackbolt 806 is threadably received within a series of adjustment nuts 812 that bear upon the surfaces of the outwardly extending legs of brackets 805 and 810, so that, when the jackbolt is threaded inwardly and outwardly with respect to nuts 812, clips 794 can be adjusted longitudinally of leg 774*a* to adjustably position rail R-14. It is apparent that by loosening adjustment nuts 812, bolts 796 along with clips 794 can be moved toward and away from guide rail R-14 and can be securely locked in position by retightening the locking nuts.

As in the earlier described embodiments, when the apparatus of this latest form of the invention is appropriately installed within the elevator hoist the various degrees of adjustment available to the installer permit the installer to precisely locate guide rail R-14 in an optimum position relative to the involved elevator cars.

Figure 38:
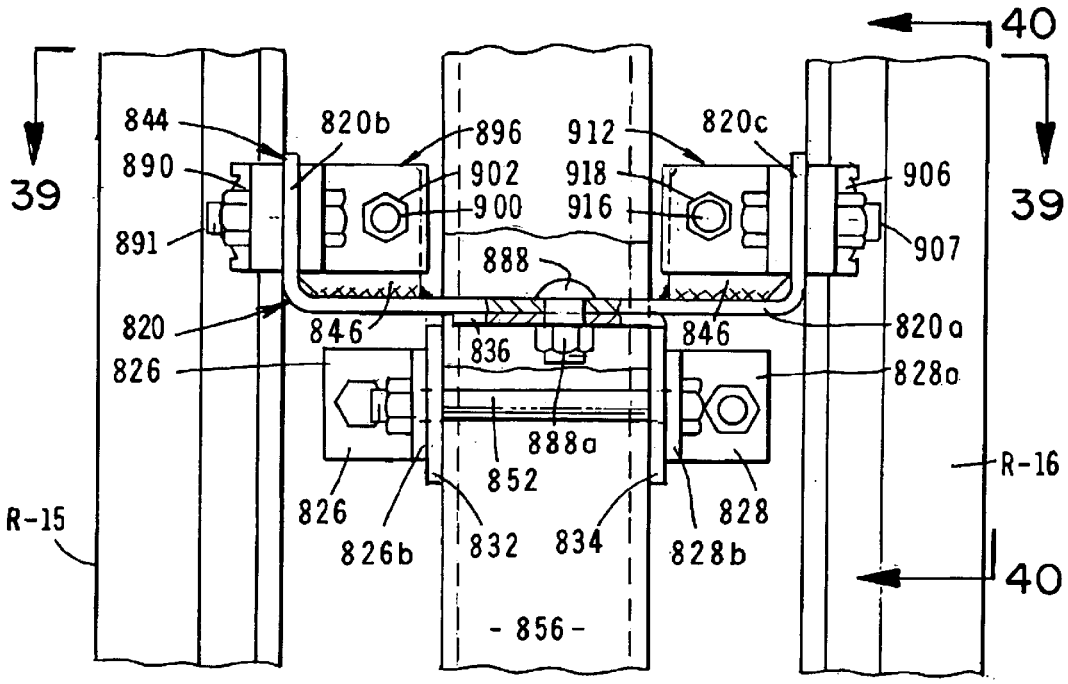
FIG. 38 is a front view of yet another form of elevator rail support system in which the elevator support rails are adjustably connected to a specially configured bracket that spans a pair of spaced apart vertical beams.
Figure 41:
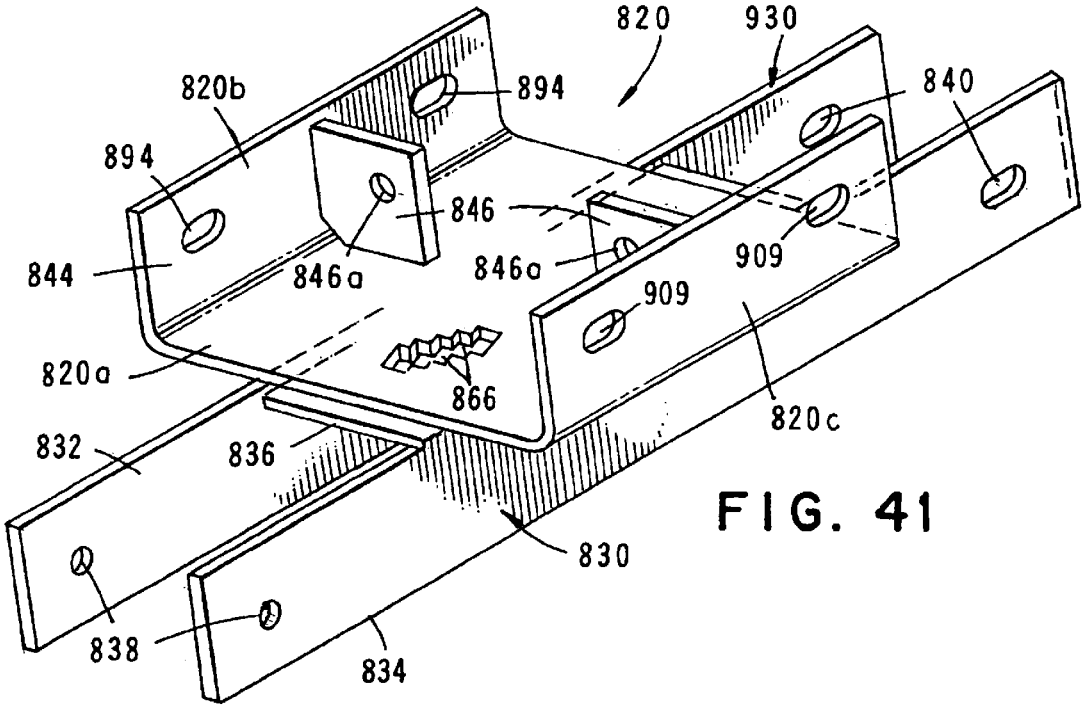
FIG. 41 is a generally perspective view of the specially configured bracket of the connector apparatus shown in FIG. 38.
Figure 39:
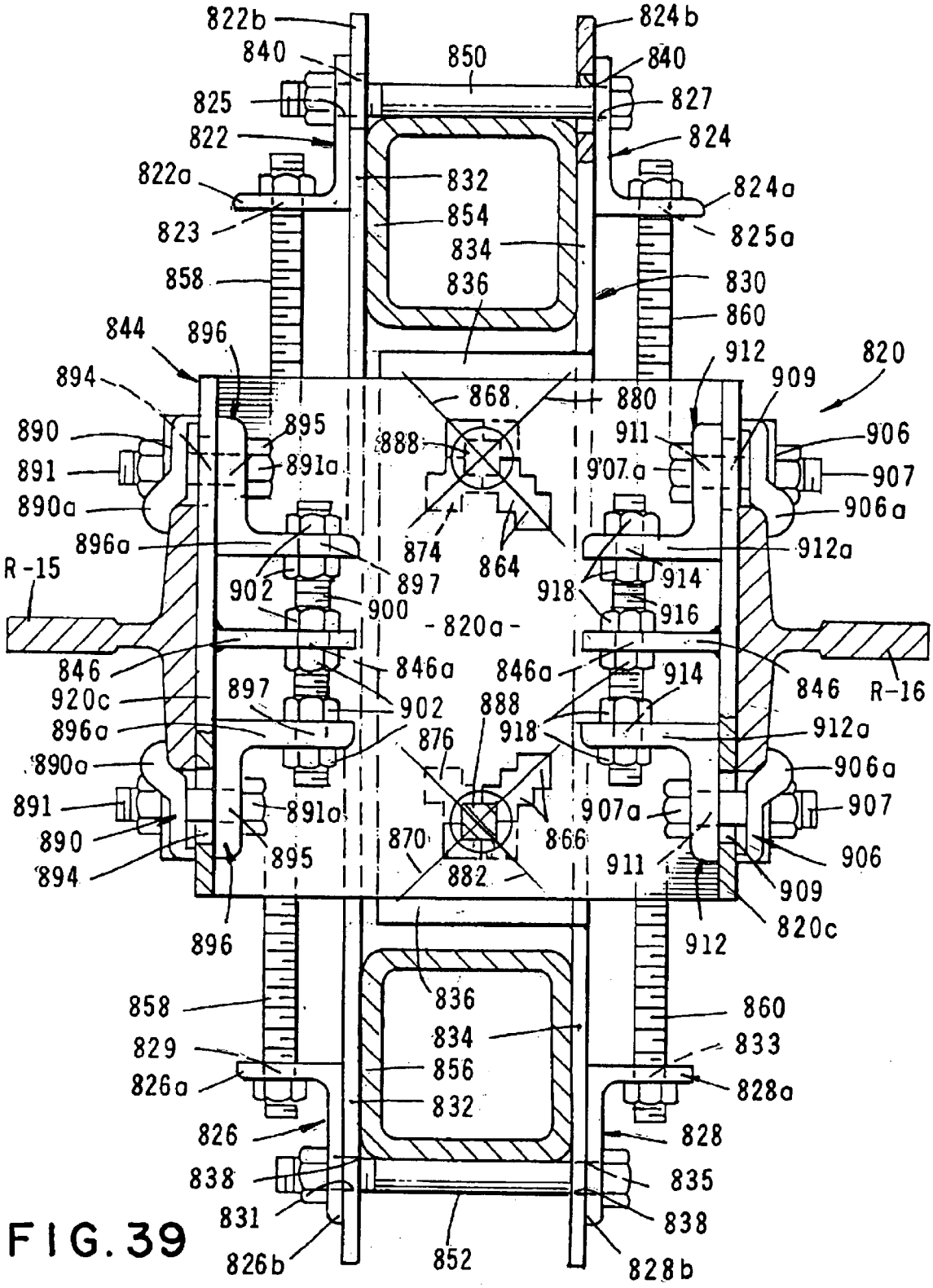
FIG. 39 is a cross-sectional view taken along lines 39—39 of FIG. 38.
Figure 40:
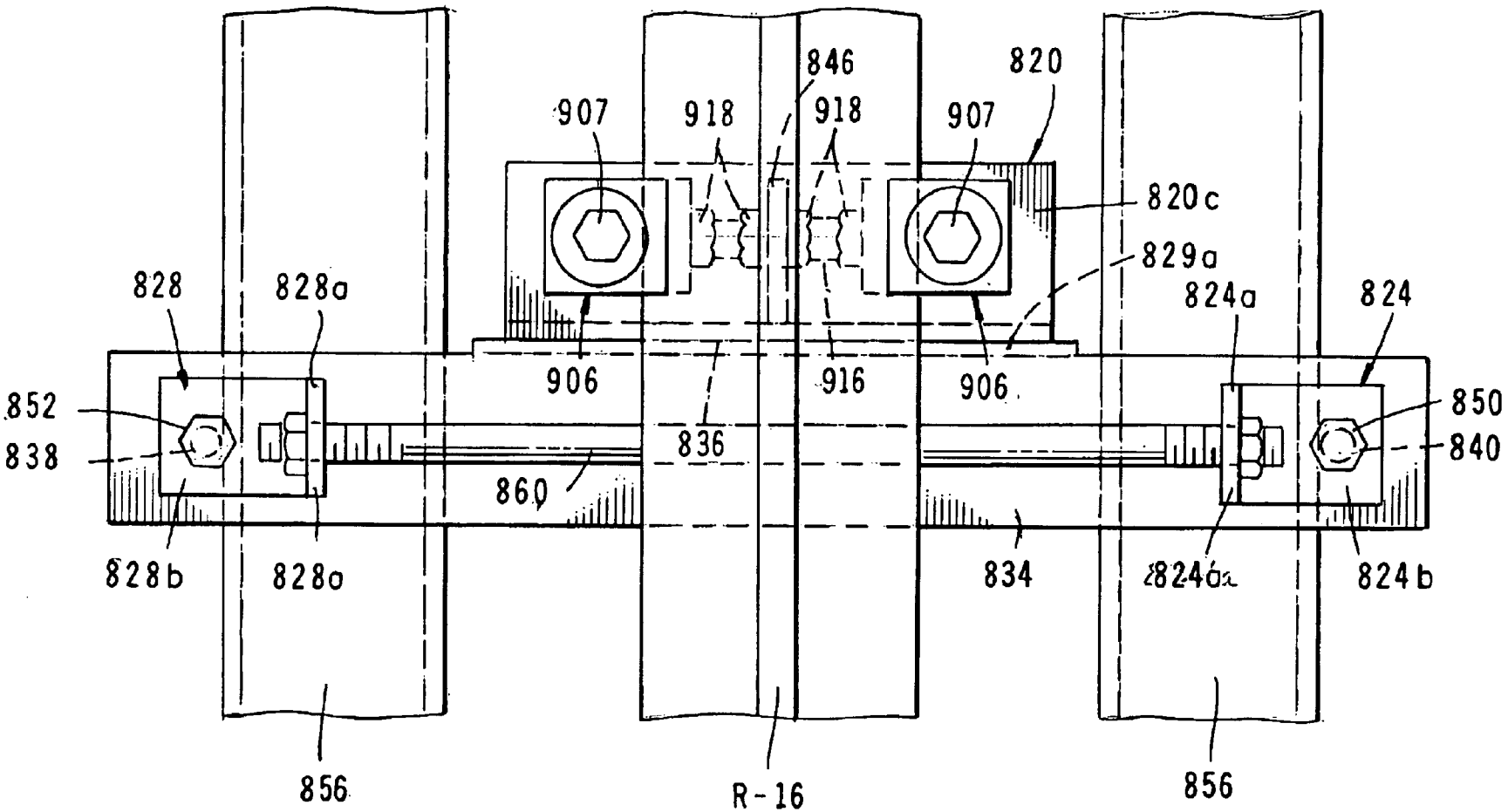
FIG. 40 is a view taken along lines 40—40 of FIG. 38.
Figure 42:
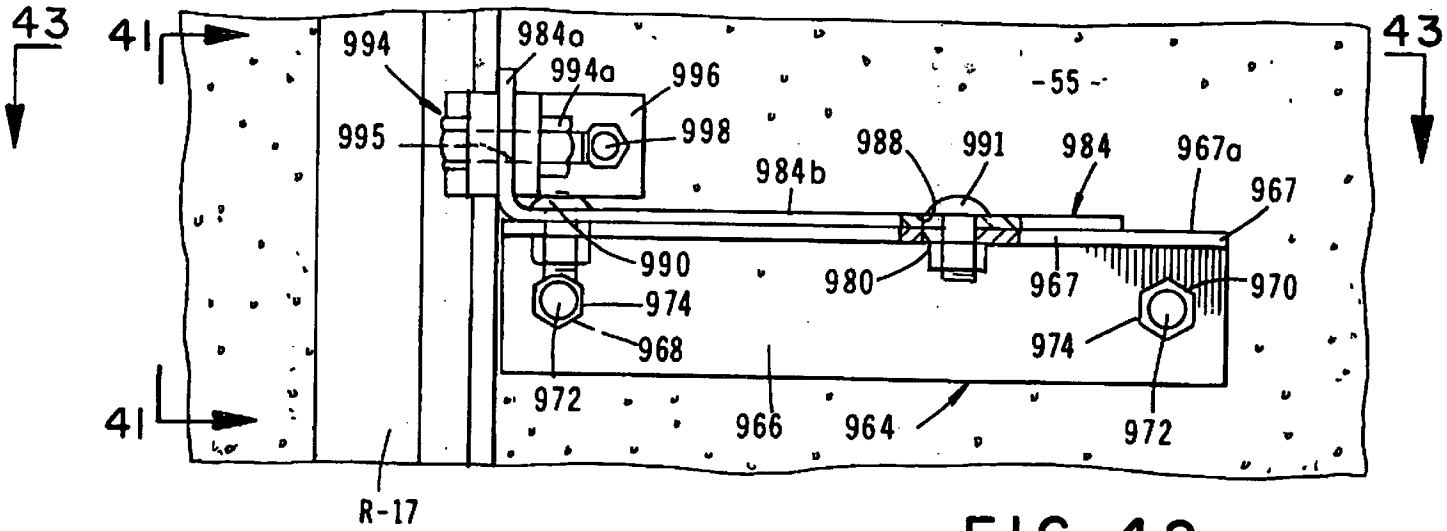
FIG. 42 is a front view of yet another form of rail support system of the invention that is adapted to be connected to a wall of the hoistway.

Turning next to FIGS. 38, 39, 40 and 41 another form of connector apparatus for interconnecting the guide rails of an elevator system with a pair of vertically extending columns is there shown. Referring particularly to FIGS. 39 and 41, the connector assembly of this form of the invention can be seen to comprise a main support structure 820 (FIG. 41) to which first, second, third, and fourth spaced-apart right angle brackets 822, 824, 826 and 828 are connected (FIG. 39). As best seen in FIG. 41, main support structure 820 comprises a base 830 having a pair of spaced-apart elongated sidewalls 832 and 834 respectively and a central, generally planer portion 836. Each of the sidewalls has a circular aperture 838 and elongated aperture 840. Also comprising of main support structure 820 is a generally U-shaped connector member 844 that includes a bight portion 820*a* and a pair of upstanding leg portions 820*b* and 820*c* respectively. Connected to each of the leg portions proximate their center is an inwardly extending apertured connector wall 846 the purpose of which will presently be described. Angle bracket 822 has a first generally planar, outwardly extending leg 822*a* that has an aperture 823 formed therein and a second perpendicularly extending second leg 822*b* that has an aperture 825 extending there through. Similarly, angle bracket 824 has a first generally planar, outwardly extending leg 824*a* that has an aperture 825*a* formed therein and a second perpendicularly extending second leg 824*b* that has an aperture 827 extending there through. In like manner, angle bracket 826 has a first generally planar, outwardly extending leg 826*a* that has an aperture 829 formed therein and a second perpendicularly extending second leg 826*b* that has an aperture 831 extending there through. Similarly, angle bracket 828 has a first generally planar, outwardly extending leg 828*a* that has an aperture 833 formed therein and a second perpendicularly extending second leg 828*b* that has an aperture 835 extending there through.

A tie bolt 850 extends through apertures 825, 840 and 827 and functions to interconnect angle brackets 822 and 824 and to secure them in engagement with vertical column 854. Similarly, a tie bolt 852 extends through apertures 831, 838 and 835 and functions to interconnect angle brackets 826 and 828 and to secure them in engagement with vertical column 856 (FIG. 39).

As is also illustrated in FIG. 39, an elongated, threaded tie bolt 858 extends through apertures 823 and 829 and functions to interconnect angle brackets 822 and 826. Similarly, an elongated tie bolt 860 extends through apertures 825*a* and 833 and functions to interconnect angle brackets 824 and 828. Tie bolts also function to bring tie bolts 850 and 852 into engagement with the vertical columns in the manner shown in FIG. 39. With the construction thus described main support structure 820 can be securely interconnected with vertical columns 854 and 856 at any desired location along the columns.

Formed within bight portion 820*a* of connector 820 are first and second sets of through holes 864 and 866, the purpose of which will presently be described. Holes 864 are disposed along the line 868 that extends at an acute angle with respect to legs 820*b* and 820*c* of connector 820. Similarly, through holes 866 are disposed along a line 870 that extends at an acute angle with respect to legs 820*b* and 820*c* of connector 820. Each of the through holes 864 and 866 are generally rectangular in plan and are of a size and shape to closely receive the square shank portion of threaded connector bolts which, in a manner presently to be described, are used to interconnect member 820 with central, generally planer portion 836 of base 830 of main support structure 820.

Like bight portion 820*a*, portion 836 is provided with first and second sets of through holes 874 and 876 (FIG. 39). Holes 874 are disposed along the line 880 that extends at an acute angle with respect to sides 820*b* and 820*c*. Similarly, through holes 876 are disposed along a line 882 that extends angularly with respect to sides 820*b* and 820*c*. Each of the through holes 874 and 876 are also generally rectangular in plan and are of a size and shape to closely receive the square shank portion of threaded connector bolts 888.

Through holes 864 formed in bracket 820 are so constructed and arranged that a selected one of the through holes can be moved into index with a selected one of the through holes 874 formed in base portion 836 by a sliding movement of bracket 820 relative to base portion 836. Similarly, through holes 866 formed in bracket 820 are constructed and arranged so that a selected one of the through holes can be moved into index with a selected one of the through holes 876 formed in base portion 836 when bracket 820 is moved from a first position to a second position relative to the base portion. More particularly, bracket 820 can be slidably moved relative to the base portion in a first transverse direction generally parallel with sides 820*b* and 820*c* of bracket 820 or, alternatively, can be slidably moved in a second direction generally perpendicular to sides 820*b* and 820*c* of bracket 820.

When connector bracket 820 is correctly aligned with base portion 836 and a selected one of the though holes 864 is indexably aligned with a selected one of the through holes 874, a selected connector bolt 888 can be introduced into the aligned through holes. Similarly, when the connector bracket 820 is correctly aligned with base portion 836 and a selected one of the though holes 866 is indexably aligned with a selected one of the through holes 876, a selected connector bolt 888 can be introduced into the aligned through holes. With the bolts in position with the square shank portions thereof closely received within the aligned holes, nuts such as nut 888*a* can be used to securely interconnect connector bracket 820 with base portion 836 in the manner shown in FIG. 38. When the components are thusly connected, the square shaped shank portions of the bolts will be snugly received within the indexably aligned through holes and will efficiently prevent sliding movement between the components even under severe loading conditions.

Also forming a part of the connector apparatus of the form of the invention shown in FIGS. 38 and 39 are connector means for adjustably interconnecting the guide rails R-15 and R-16 of the system to the side portions of connector bracket 820. In the present form of the invention, this connector means comprises a pair of spaced apart connector clips 890 that are adjustably connected to side 820*b* of connector bracket 820 by threaded bolts 891. Each connector clip has a rail engagement leg 890*a* that is adapted to clampingly engage the legs of the guide rail R-15.

Bolts 891 extend through slots 894 provided in leg 820*b* of bracket 820 (FIG. 41) and also extend through apertures 895 provided in a pair of angle brackets 896 that are connected to side 820*b* by the bolts 891 and nuts 891*a* in the manner best seen in FIG. 39. Brackets 896 include an outwardly extending leg 896*a* that is provided with an aperture 897 that accepts a threaded jackbolt 900.

Each of the previously identified walls 846 that extend inwardly from sides 820*b* and 820*c* are provided with a bore 846*a* that is adapted to receive the shank of a threaded jackbolt 900. As shown in FIG. 39, jackbolt 900 is threadably received within a series of adjustment nuts 902 that bear upon the surfaces of the outwardly extending legs of brackets 895 and also on the opposing surfaces of walls 846 so that, when the jackbolt is threaded inwardly and outwardly with respect to nuts 902, clips 890 can be adjusted longitudinally of side 820*b* to adjustably position rail R-15. It is apparent that by loosening adjustment nuts 902, bolts 891 along with clips 890 can be moved toward and away from guide rail R-15 and can be securely locked in position by retightening the locking nuts.

In the present form of the invention, the connector means also comprises a pair of spaced apart connector clips 906 that are adjustably connected to side 820*c* of connector bracket 820 by threaded bolts 907. Each connector clip has a rail engagement leg 906*a* that is adapted to clampingly engage the legs of the guide rail R-16.

Bolts 907 extend through slots 909 provided in leg 820*c* of bracket 820 (FIG. 41) and also extend through apertures 911 provided in a pair of angle brackets 912 that are connected to side 820*c* by the bolts 907 and nuts 907*a* in the manner best seen in FIG. 39. Brackets 912 include an outwardly extending leg 912*a* that is provided with an aperture 914 that accepts a threaded jackbolt 916. Jackbolt 916 also extends through bore 846*a* one of the previously identified walls 846 that extends inwardly from side 820*c* of bracket 820. As shown in FIG. 39, jackbolt 916 is threadably received within a series of adjustment nuts 918 that bear upon the surfaces of the outwardly extending legs of brackets 912 and also on the opposing surfaces of wall 846 so that, when the jackbolt is threaded inwardly and outwardly with respect to nuts 918, clips 906 can be adjusted longitudinally of side 820*c* to adjustably position rail R-16. It is apparent that by loosening adjustment nuts 918, bolts 907 along with clips 906 can be moved toward and away from guide rail R-16 and can be securely locked in position by retightening the locking nuts.

As in the earlier described embodiments, when the apparatus of this latest form of the invention is appropriately installed within the elevator hoistway the various degrees of adjustment available to the installer permit the installer to precisely locate guide rails R-15 and R-16 in an optimum position relative to the involved elevator cars.

Referring next to FIGS. 42 through 45, an alternate form of a connector apparatus of the invention for use interconnecting a guide rail R-17 with a supporting structure such as a selected wall of the structure that houses the elevator hoistways is there shown. As best seen in FIG. 43, the connector assembly 960 of this latest form of the invention comprises a first connector bracket 964 having a first generally planar first leg 966 that is connected to the supporting structure "SS". Leg 966 extends generally perpendicularly from a second leg 967 that has a generally planar surface 967*a*. Leg 966 is provided with spaced-apart apertures 968 and 970. Received within apertures 968 and 970 are the threaded shank portions 972*a* of a pair of anchor bolts 972, the body portions 970*b* of which are embedded within the concrete of the supporting wall "SS". The threaded shank portions 972*a* of bolts 972 extend through apertures 968 and 970 and are interconnected with leg 966 of bracket 964 by locking nuts 974.

Leg 967 of bracket 964 is provided with a plurality of first through holes 976 that are disposed along a first line 978 that extends at an acute angle with respect to first leg 966. Similarly, leg 967 is provided with a second set of through holes 980 that are disposed along a second line 982 that extends at an acute angle with respect to first leg 966.

Figure 45:
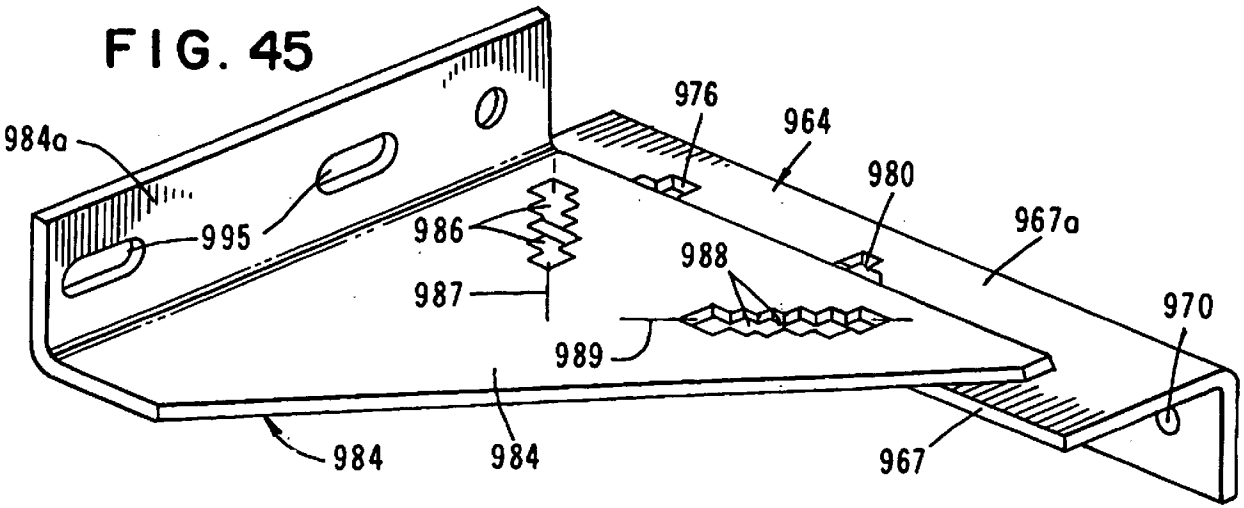
FIG. 45 is a generally perspective view of the specially configured brackets of the connector apparatus shown in FIG. 42.

Adjustably interconnected with first connector bracket 964 is a second connector bracket 984. Second bracket 984 has a first leg 984*a* and a second leg 984*b* that extends generally perpendicular to first leg 984*a*. As best seen in FIGS. 43 and 45, second bracket 984 is also provided with a plurality of through holes 986 that are disposed along a first line 987 that extends at an acute angle with respect to first leg 984*a*. Similarly, leg 984 is provided with another set of through holes 988 that are disposed along a line 989 that extends at an acute angle with respect to first leg 984*a*. Through holes 986 formed in bracket 984 are so constructed and arranged that a selected one of the through holes 986 can be moved into index with a selected one of the through holes 976 formed in bracket 964 by a sliding movement of bracket 984 relative to bracket 964. Similarly, through holes 988 formed in bracket 984 are constructed and arranged so that a selected one of the through holes 988 can be moved into index with a selected one of the through holes 980 formed in bracket 964 when bracket 984 is slidably moved from a first position to a second position relative to bracket 964. More particularly, bracket 984 can be slidably moved relative to bracket 964 in a first direction generally parallel with leg 966 of bracket 964 or, alternatively, can be slidably moved in a second direction generally perpendicular to leg 966 of bracket 964.

When second connector bracket 984 is correctly aligned with first connector bracket 964 and a selected one of the though holes 986 is indexably aligned with a selected one of the through holes 976, a first bolt, such as a bolt 990, can be introduced into the aligned through holes. Similarly, when the connector bracket 984 is correctly aligned with bracket 964 and a selected one of the through holes 988 is indexably aligned with a selected one of the through holes 980, a second bolt, such as a bolt 991, can be introduced into the aligned through holes. With the bolts 990 and 991 in position with the square shank portions thereof (FIG. 43) closely received within the aligned holes, nuts can be used to securely interconnect connector bracket 984 with bracket 964 in the manner shown in FIGS. 43 and 44. When the brackets are thusly connected, the square shaped shank portions of the bolts will be snugly received within the indexably aligned through holes in the two brackets and will efficiently prevent sliding movement between the brackets.

The connector apparatus of this latest form of the invention further includes connector means for connecting guide rail R-17 to first leg 984*a* of second bracket 984 in the manner illustrated in FIGS. 43, 44 and 45. In this latest form of the invention, the connector means comprises first and second spaced-apart connector clips 994 that are of a similar construction to the earlier identified connector clips. Connector clips 994 are adjustably connected to first leg of connector bracket 984 by threaded bolts 994*a*. Each connector clip 994 has a rail engagement leg 944*b* that is adapted to clampingly engage the legs of the guide rail R-17.

Bolts 994*a* extend through slots 995 provided in leg 984*a* of bracket 984 (FIG. 45) and also extend through apertures provided in a pair of angle brackets 996 that are connected to side 984*a* by the bolts 994*a* and mating nuts in the manner best seen in FIG. 43. Brackets 996 include an outwardly extending leg 996*a* that is provided with an aperture that accepts a threaded jackbolt 998. Jackbolt 998 also extends through a bore 1000*a* provided in an outwardly extending angle bracket 1000 that is connected to wall 984*a* of bracket 984. As shown in FIG. 43, jackbolt 998 is threadably received within a series of adjustment nuts 1002 that bear upon the surfaces of the outwardly extending legs of brackets 996*a* and 1000 so that, when the jackbolt is threaded inwardly and outwardly with respect to nuts 1002, clips 994 can be adjusted longitudinally of wall 984*a* to adjustably position rail R-17. It is apparent that by loosening adjustment nuts 1002, bolts 994*a* along with clips 994 can be moved toward and away from guide rail R-17 and can be securely locked in position by retightening the locking nuts.

As in the earlier described embodiments, when the apparatus of this latest form of the invention is appropriately installed within the elevator hoistway the various degrees of adjustment available to the installer permit the installer to precisely locate guide rail R-17 in an optimum position within the hoistway.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A connector apparatus for interconnecting a guide rail of an elevator system with a structural component disposed within a hoistway within which the elevator travels, said connector apparatus comprising:

(a) a first bracket having a first generally planar leg and a second leg extending generally perpendicularly to said first leg, said second leg having;

(i) a plurality of first through holes disposed along a first line extending at an angle with respect to said first generally planar leg;

(ii) a plurality of second through holes disposed along a second line extending at an angle with respect to said first generally planar leg;

(b) interconnection means for interconnecting said first bracket with the structural component;

(c) a second bracket connected to said first bracket, said second bracket having a first generally planar leg and a second generally planar leg extending generally perpendicular to said first generally planar leg of said second bracket and being slidably movable relative to said second leg of said first bracket between first and second positions, said second leg of said second bracket having:

(i) a plurality of third through holes disposed along a third line extending at an angle with respect to said second line;

(ii) a plurality of fourth through holes disposed along a fourth line extending at an angle with respect to said first line a selected first through hole being indexable with a selected fourth through hole and a selected second through hole being indexable with a selected third through hole when said second leg of said second bracket is moved from said first position to said second position; and (d) rail connector means for connecting the guide rail of the elevator system with said second bracket.

2. The connector apparatus as defined in claim 1 in which said interconnection means comprises a pair of spaced-apart bolts and a part of spaced-apart jackbolts.

3. The connector apparatus as defined in claim 1 in which the structural component comprises a beam and in which said interconnection means comprises:

(a) a first angle bracket connected to said first bracket;

(b) a second angle bracket connected to said first bracket, said second angle bracket being spaced apart from said first angle bracket;

(c) a first tie bolt interconnecting said first and second angle brackets; and (d) a capture plate spaced apart from said first and second angle brackets and connected thereto by second and third tie bolts.

4. The connector apparatus as defined in claim 1 in which said rail connector means comprises a pair of connector clips adjustably connected to said second leg of said second bracket, each said connector clip having an engagement leg for engaging the guide rail.

* * * * *